US007704191B2

(12) United States Patent
Smith et al.

(10) Patent No.: US 7,704,191 B2
(45) Date of Patent: Apr. 27, 2010

(54) DUAL TREADMILL EXERCISE DEVICE HAVING A SINGLE REAR ROLLER

(75) Inventors: Bradley J. Smith, Tyler, TX (US); Richard W. Trevino, Whitehouse, TX (US); Douglas A. Crawford, Lafayette, CO (US)

(73) Assignee: Nautilus, Inc., Vancouver, WA (US)

( * ) Notice: Subject to any disclaimer, the term of this patent is extended or adjusted under 35 U.S.C. 154(b) by 1085 days.

(21) Appl. No.: 11/065,770

(22) Filed: Feb. 25, 2005

(65) Prior Publication Data

US 2005/0233864 A1 Oct. 20, 2005

Related U.S. Application Data

(63) Continuation-in-part of application No. 10/789,182, filed on Feb. 26, 2004, and a continuation-in-part of application No. 10/789,294, filed on Feb. 26, 2004, now Pat. No. 7,553,260, and a continuation-in-part of application No. 10/789,579, filed on Feb. 26, 2004, now Pat. No. 7,618,346.

(60) Provisional application No. 60/548,811, filed on Feb. 26, 2004, provisional application No. 60/548,786, filed on Feb. 26, 2004, provisional application No. 60/548,787, filed on Feb. 26, 2004, provisional application No. 60/451,104, filed on Feb. 28, 2003, provisional application No. 60/450,789, filed on Feb. 28, 2003, provisional application No. 60/450,890, filed on Feb. 28, 2003.

(51) Int. Cl.
*A63B 22/00* (2006.01)
*A63B 22/04* (2006.01)

(52) U.S. Cl. ..... 482/51; 482/52; 482/54

(58) Field of Classification Search ..... 482/51–54
See application file for complete search history.

(56) References Cited

U.S. PATENT DOCUMENTS 2,434,760 A 1/1948 Eggleston (Continued)

FOREIGN PATENT DOCUMENTS

AU 233194 8/1959

(Continued)

OTHER PUBLICATIONS

Catalog, Diamond House International Inc., date unknown.

(Continued)

*Primary Examiner*—Steve R Crow
(74) *Attorney, Agent, or Firm*—Dorsey & Whitney LLP

(57) ABSTRACT

The present invention provides an exercise device that generally includes two treadles pivotally connected with a frame so that the treadles may pivot up and down about an axis. Each treadle includes a tread belt that provides a moving surface like a treadmill. Each tread belt is supported by a front roller and a rear roller, which is common to both treadles. The treadles are interconnected to provide an alternating upward and downward movement relative to each other. Opposing end portions of the rear roller are rotatably supported at the rear end of the frame. Outer sides of rear end portions of the treadles are rotatably supported by the outer end portions of the rear roller, and inner sides of rear end portions of the treadles are coupled with the frame through an inner support structure that defines a virtual pivot.

25 Claims, 42 Drawing Sheets

U.S. PATENT DOCUMENTS

| | | | | | |
|---|---|---|---|---|---|
| 3,408,067 | A | * | 10/1968 | Armstrong | 482/30 |
| 3,814,420 | A | | 6/1974 | Encke | |
| 3,826,491 | A | * | 7/1974 | Elder | 482/7 |
| 4,204,673 | A | | 5/1980 | Speer, Sr. | |
| 4,423,864 | A | * | 1/1984 | Wiik | 472/91 |
| 4,747,612 | A | | 5/1988 | Kuhn | |
| 4,974,831 | A | | 12/1990 | Dunham | |
| 5,139,255 | A | | 8/1992 | Sollami | |
| 5,336,146 | A | | 8/1994 | Piaget et al. | |
| 5,372,560 | A | | 12/1994 | Chang | |
| 5,385,520 | A | * | 1/1995 | Lepine et al. | 482/54 |
| 5,411,279 | A | * | 5/1995 | Magid | 280/47.38 |
| 5,509,872 | A | | 4/1996 | Chen | |
| 5,538,489 | A | * | 7/1996 | Magid | 482/54 |
| 5,607,376 | A | * | 3/1997 | Magid | 482/54 |
| 5,626,539 | A | | 5/1997 | Piaget et al. | |
| 5,679,101 | A | * | 10/1997 | Magid | 482/54 |
| 5,733,228 | A | | 3/1998 | Stevens | |
| 5,803,874 | A | | 9/1998 | Wilkinson | |
| 6,461,279 | B1 | | 10/2002 | Kuo | |
| 6,554,749 | B2 | * | 4/2003 | Iund et al. | 482/54 |
| 6,811,517 | B1 | | 11/2004 | Eschenbach | |
| 6,811,519 | B2 | * | 11/2004 | Kuo | 482/54 |
| 6,893,383 | B1 | | 5/2005 | Chang et al. | |
| 7,097,593 | B2 | * | 8/2006 | Chang | 482/54 |
| 7,306,546 | B2 | * | 12/2007 | Lo | 482/52 |
| 2001/0016542 | A1 | | 8/2001 | Yoshimura | |
| 2004/0192514 | A1 | | 9/2004 | Piaget et al. | |
| 2004/0214693 | A1 | | 10/2004 | Piaget et al. | |
| 2005/0202939 | A1 | | 9/2005 | Lull et al. | |
| 2005/0209059 | A1 | | 9/2005 | Crawford et al. | |
| 2005/0209060 | A1 | | 9/2005 | Lull | |
| 2005/0209061 | A1 | | 9/2005 | Crawford et al. | |
| 2005/0245359 | A1 | | 11/2005 | Lo | |
| 2006/0223680 | A1 | | 10/2006 | Chang | |
| 2008/0070758 | A1 | | 3/2008 | Lull et al. | |
| 2009/0029831 | A1 | | 1/2009 | Weier | |

FOREIGN PATENT DOCUMENTS

| | | | |
|---|---|---|---|
| CN | 2510102 | Y | 9/2002 |
| CN | 2675190 | Y | 2/2005 |
| SU | 1 265 113 | A1 | 10/1986 |
| TW | 367860 | | 2/1999 |
| TW | 381497 | | 2/1999 |
| TW | 375944 | | 4/1999 |
| TW | 472593 | | 1/2002 |
| TW | 515306 | Y | 12/2002 |
| TW | 547102 | Y | 8/2003 |
| TW | M249682 | | 11/2004 |
| WO | WO 95/16502 | A1 | 6/1995 |
| WO | WO 99/21620 | A1 | 5/1999 |
| WO | WO 01/58534 | A1 | 8/2001 |
| WO | WO 2004/108225 | A1 | 12/2004 |

OTHER PUBLICATIONS

"Nautilus Home Health & Fitness Catalog", Nautilus, Inc., pp. 1-56 (2004).

Non-Final Office Action and Notice of References Cited, U.S. Appl. No. 11/425,086, mailed Jul. 25, 2008, 9 pages.

Amendment and Response to Office Action, U.S. Appl. No. 11/425,086, dated Nov. 25, 2008, 16 pages.

Terminal Disclaimer, U.S. Appl. No. 11/425,086, dated Nov. 25, 2008, 1 page.

Supplemental Communication, U.S. Appl. No. 11/425,086, dated Dec. 3, 2008, 1 page.

Non-Final Office Action and Notice of References Cited, U.S. Appl. No. 11/425,086, mailed Feb. 23, 2009, 10 pages.

Amendment and Response Filed with RCE, Terminal Disclaimer RE U.S. Pat. No. 7,517,303 (U.S. Appl. No. 11/065,746), Terminal Disclaimer RE U.S. Appl. No. 10/789,294, U.S. Appl. No. 11/425,086, mailed Feb. 23, 2009, 17 pages.

Non-Final Office Action and Notice of References Cited, U.S. Appl. No. 11/425,086, mailed Aug. 3, 2009, 11 pages.

* cited by examiner

DUAL TREADMILL EXERCISE DEVICE HAVING A SINGLE REAR ROLLER

CROSS-REFERENCE TO RELATED APPLICATIONS

The present application is a non-provisional utility application claiming priority to U.S. Provisional Application No. 60/548,811, titled "Dual Treadmill Exercise Device Having a Single Rear Roller" and filed on Feb. 26, 2004, U.S. Provisional Patent Application No. 60/548,786 titled "Control System and Method for an Exercise Apparatus" and filed on Feb. 26, 2004, and U.S. Provisional Patent Application No. 60/548,787 titled "Hydraulic Resistance, Arm Exercise, and Non-Motorized Dual Deck Treadmills" and filed on Feb. 26, 2004, which are all hereby incorporated herein by reference.

The present application is a continuation-in-part of and claims priority to U.S. application Ser. No. 10/789,182, titled "Dual Deck Exercise Device" and filed on Feb. 26, 2004 which claims the benefit under 35 U.S.C. § 119(e) of U.S. Provisional Patent Application Ser. No. 60/451,104 titled "Exercise Device with Treadles" and filed on Feb. 28, 2003. U.S. Provisional Patent Application No. 60/450,789 titled "Dual Deck Exercise Device" and filed on Feb. 28, 2003, and U.S. Provisional Patent Application No. 60/450,890 titled "System and Method for Controlling an Exercise Apparatus" and filed on Feb. 28, 2003; the present application is a continuation-in-part of and claims priority to U.S. Application No. Ser. No. 10/789,294, titled "Exercise Device with Treadles" and filed on Feb. 26, 2004 now U.S. Pat. No. 7,553,260, which claims the benefit of U.S. Provisional Patent Application No. 60/451,104 titled "Exercise Device with Treadles" and filed on Feb. 28, 2003. U.S. Provisional Patent Application No. 60/450,789 titled "Dual Deck Exercise Device" and filed on Feb. 28, 2003; and U.S. Provisional Patent Application No. 60/450,890 titled "System and Method for Controlling an Exercise Apparatus" filed on Feb. 28, 2003; and the present application is a continuation-in-part of and claims priority to U.S. application Ser. No. 10/789,579, titled "System and Method for Controlling an Exercise Apparatus" and filed on Feb. 26, 2004 now U.S. Pat. No. 7,618,346, which claims the benefit of U.S. Provisional Patent Application No. 60/451,104 titled "Exercise Device with Treadles" and filed on Feb. 28, 2003, U.S. Provisional Patent Application No. 60/450,789 titled "Dual Deck Exercise Device" and filed on Feb. 28, 2003; and U.S. Provisional Patent Application No. 60/450,890 titled "System and Method for Controlling an Exercise Apparatus" filed on Feb. 28, 2003; which are all hereby incorporated herein by reference.

INCORPORATION BY REFERENCE

The present application incorporates by reference in its entirety, as if fully described herein, the subject matter disclosed in:

U.S. Provisional Patent Application No. 60/548,265 titled "Exercise Device with Treadles (Commercial)" and filed on Feb. 26, 2004.

The present application is also related to and incorporates by reference in its entirety, as if fully described herein, the subject matter disclosed in the following U.S. applications, filed on the same day as the present application:

U.S. patent application Ser. No. 11/065,891 entitled "Exercise Device With Treadles" and filed on Feb. 25, 2005;

U.S. patent application Ser. No. 11/067,538 entitled "Control System and Method for an Exercise Apparatus" and filed on Feb. 25, 2005; and U.S. patent application Ser. No. 11/065,746 entitled "Upper Body Exercise and Flywheel Enhanced Dual Deck Treadmills" and filed on Feb. 25, 2005.

BACKGROUND OF THE INVENTION a. Field of the Invention

This invention relates to exercise devices, and more particularly, to exercise devices having more than one treadle with each treadle sharing a common rear roller.

b. Background Art

A recent development in the fitness equipment industry is an exercise device having a separate treadmill (hereafter a "treadle") for each foot of a user. The exercise device can be configured such that each treadle pivots around its respective rearward end during use. Typically, each treadle includes a frame supporting a belt extending in an endless loop around a front roller and a rear roller. The exercise device may also include a motor coupled with the rear rollers to drive the belt around the treadle frame. Each rear roller on each treadle has an inner end portion which must be supported in a rotatable manner. Typically, a solid axle extends through both rear rollers. Outer ends of each rear roller axle are rotatably supported to allow the rollers to be driven directly or indirectly by the motor. The inner ends of each roller axle are typically rotatably supported by a bracket to help stabilize the rear rollers as well as minimize any deflection during use.

Support structures for the inner ends of the rear rollers sometimes include one or more bearings to support the rear axles on the brackets. As such, these support structures require that there be sufficient space between the adjacent treadles in order to fit between the inner ends of the rollers. This space requires a user of the exercise device to keep his feet a particular distance apart when using the exercise device in order to avoid stepping on the inside edge of the treadle during use, which can be an inconvenience. The need for two inner support structures and associated bearings also add to the manufacturing costs of the exercise device.

BRIEF SUMMARY OF THE INVENTION

An exercise device conforming to the present invention generally includes two treadmill-like assemblies (referred to herein as a "treadle" or a "treadle assembly") pivotally connected with a frame so that the treadles may pivot up and down about an axis. Each treadle includes a tread belt that provides a moving surface like a treadmill. Each tread belt is supported by a front roller and a rear roller, which is common to both treadles. In use, a user will walk, jog, or run on the treadles and the treadles will reciprocate about the treadle pivot axis. The treadles are interconnected to provide an alternating upward and downward movement. Opposing end portions of the rear roller are rotatably supported at the rear end of the frame. Outer sides of rear end portions of the treadles are rotatably supported by the outer end portions of the rear roller, and inner sides of rear end portions of the treadles are coupled with the frame through an inner support structure that defines a virtual pivot. The inner support structure allows each treadle to be positioned more closely to one another along the inner sides than a comparable exercise device having two separate rear rollers. Using a single rear roller also eliminates the need for two inner rear roller support structures and associated bearings.

In one aspect of the present invention, an exercise device includes a frame; a first roller including a cylindrical hollow tube having a first end portion and a second end portion, a first cap end connected with the first end portion, and a second cap end connected with the second end portion, the first cap end and the second cap end rotatably supported by the frame; a first treadle assembly including a second roller and a first endless belt in rotatable engagement with the second roller and the first roller, the first treadle assembly arranged to pivot relative to the frame; and a second treadle assembly including a third roller and a second endless belt in rotatable engagement with the third roller and the first roller, the second treadle assembly arranged to pivot relative to the frame.

In another form, an exercise device includes: a frame; a first roller including a cylindrical hollow tube having a first end portion and a second end portion, a first cap end connected with the first end portion, and a second cap end connected with the second end portion, the first cap end and the second cap end rotatably supported by the frame; a first treadle assembly including a second roller and a first endless belt in rotatable engagement with the second roller and the first roller; and a second treadle assembly including a third roller and a second endless belt in rotatable engagement with the third roller and the first roller. The first treadle assembly and the second treadle assembly are pivotally supported by the first roller.

In yet another form, an exercise device includes a frame, a first roller rotatably supported by a first axle end and a second axle end, the first axle end coupled with the frame through an adjustable axle support, a first treadle assembly including a second roller and a first endless belt in rotatable engagement with the second roller and the first roller, the first treadle assembly arranged to pivot relative to the frame; and a second treadle assembly including a third roller and a second endless belt in rotatable engagement with the third roller and the first roller, the second treadle assembly arranged to pivot relative to the frame.

In still another form, an exercise device includes a frame, a first roller rotatably supported by the frame defining a first axis of rotation, a first treadle assembly including a second roller and a first endless belt in rotatable engagement with the second roller and the first roller, the first treadle assembly arranged to pivot relative to the frame about a first pivot axis, a second treadle assembly including a third roller and a second endless belt in rotatable engagement with the third roller and the first roller, the second treadle assembly arranged to pivot relative to the frame about the first pivot axis, and wherein the first axis of rotation is offset from the first pivot axis.

The features, utilities, and advantages of various embodiments of the invention will be apparent from the following more particular description of embodiments of the invention as illustrated in the accompanying drawings and defined in the appended claims.

DETAILED DESCRIPTION OF THE INVENTION

Figure 1:
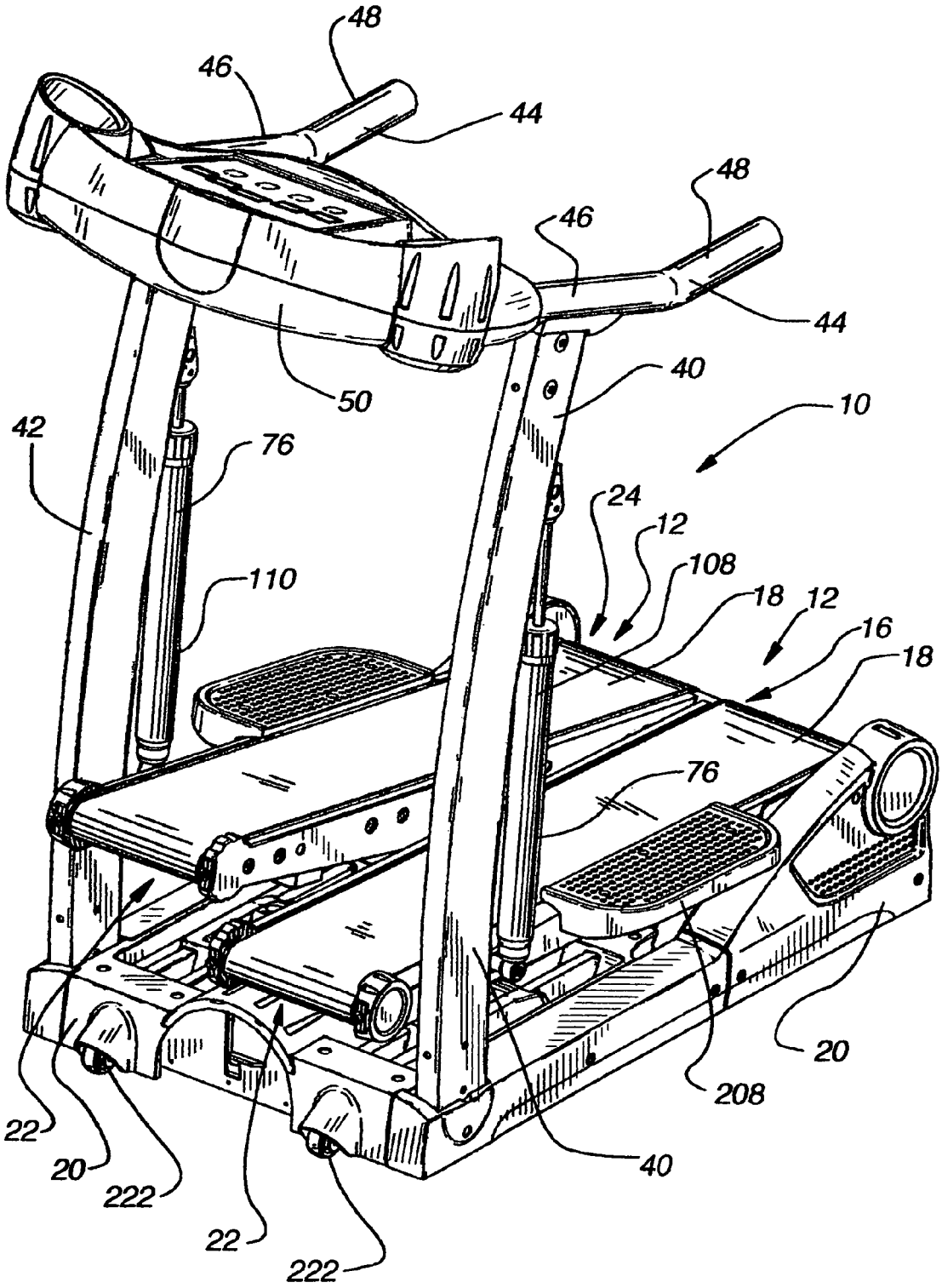
FIG. 1 is an isometric view of one embodiment of an exercise device.

An exercise device 10 conforming to the present invention may be configured to provide a user with a walking-type exercise, a stepping-type exercise or a climbing-like exercise that is a combination of both walking and stepping. The exercise device generally includes two treadmill-like assemblies 12 (referred to herein as a "treadle" or a "treadle assembly") pivotally connected with a frame 14 so that the treadles may pivot up and down about an axis 16. The axis may be a physical axis (axle) or may be a virtual axis defined by assemblies of components that pivotally support each treadle. In one implementation, each treadle includes a tread belt 18 that provides a moving surface like a treadmill. Each tread belt is supported by a front roller and a rear roller. The rear roller is common to both treadles. Further, the rear roller may be supported on the frame or treadle, and may share an axis of rotation with the treadles or may have a unique axis of rotation forward, rearward, above an/or below the pivot axis of the treadles.

In use, a user will walk, jog, or run on the treadles and the treadles will reciprocate about the treadle pivot axis. The treadles are interconnected so that upward movement of one treadle is accompanied by downward movement of the other treadle. The combination of the moving surface of the tread belts and the coordinated and interconnected reciprocation of the treadles provides an exercise that is similar to climbing on a loose surface, such as walking, jogging, or running up a sand dune where each upward and forward foot movement is accompanied by the foot slipping backward and downward. Extraordinary cardiovascular and other health benefits are achieved by such a climbing-like exercise. Moreover, as will be recognized from the following discussion, the extraordinary health benefits are achieved in a low impact manner.

As discussed in more detail below, in one implementation, opposing end portions of the rear roller are rotatably supported at the rear end of the frame. Outer sides of rear end portions of the treadles are rotatably supported by the outer end portions of the rear roller. However, inner sides of rear end portions of the treadles are not coupled with the rear roller, but instead, are coupled with the frame through an inner support structure that defines a virtual pivot. More particularly, the inner support structure includes brackets extending rearward from the inner sides of the treadles, which are movingly coupled with at least one stud connected with the rear end of the frame. As such, the treadles do not utilize an inner rear support structure that engages the rear roller. The inner support structure thus allows each treadle to be positioned more closely to one another along the inner sides than a comparable exercise device having two separate rear rollers. The inner support structure also allows the inner sides of each treadle to move about a central pivot of the rear end of each treadle as if it was supported at the central pivot even though the inner support structure is not located directly at the location of the pivot motion. In a second embodiment of the exercise device discussed below, the treadles utilize an inner rear support structure coupled with the rear roller. The rear roller in the second embodiment includes annular grooves that allow the belts to pass over the rear support structure, which also allows each treadle to be positioned relatively close to one another along the inner sides.

The following discussion provides a general structural framework for various embodiments of a dual treadmill exercise device having a single rear roller. Further detail concerning other structural frameworks for the various embodiments discussed herein are provided in the various related applications incorporated by reference herein. Aspects of the present invention involve various structures that may be employed to support the treadles used on an exercise device having a single rear roller.

Figure 2:
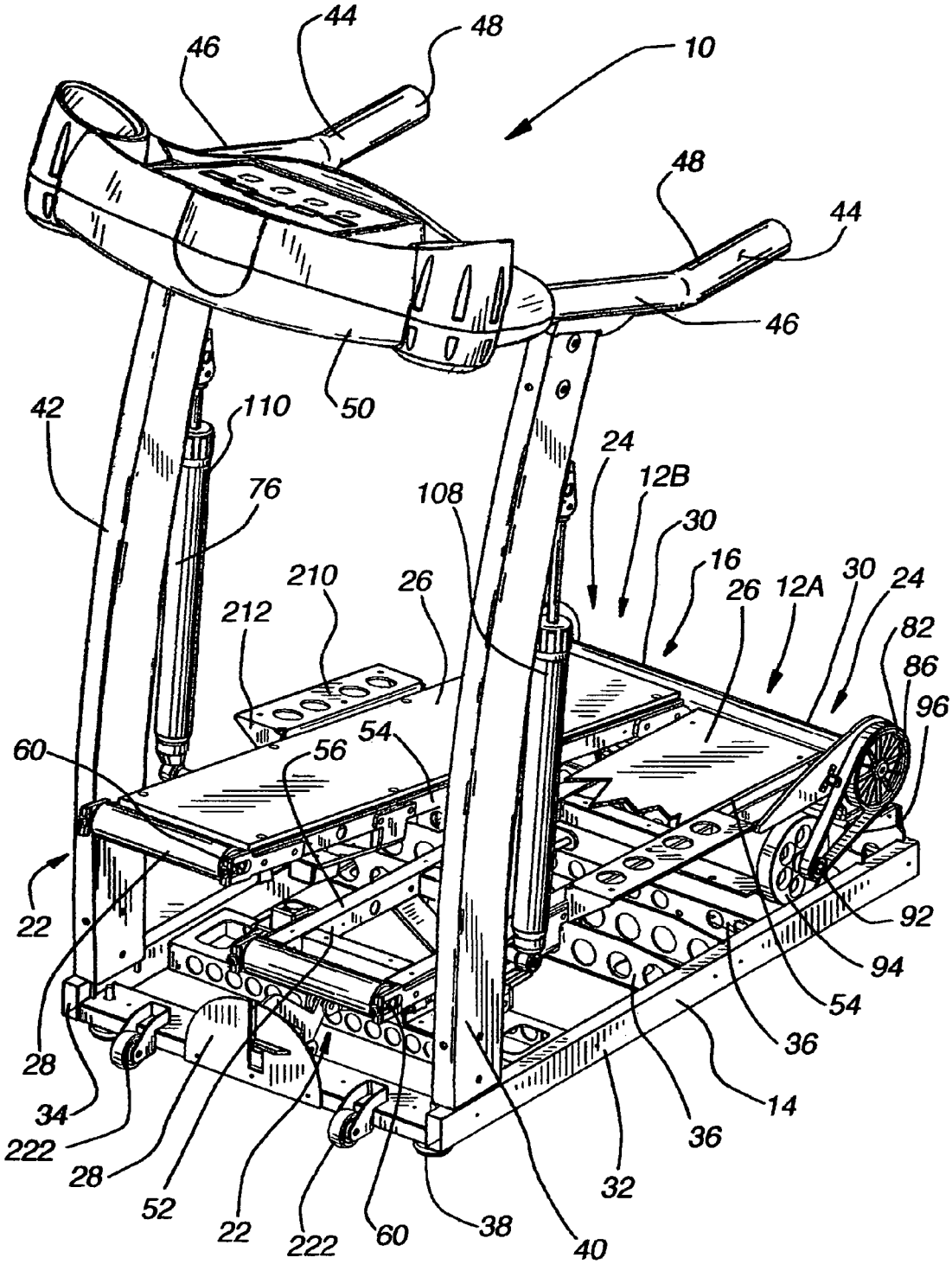
FIG. 2 is an isometric view of the exercise device shown in FIG. 1 with decorative and protective side panels removed to better illustrate various components of the exercise device.

FIG. 1 is an isometric view of one example of an exercise device conforming to aspects of the present invention. The embodiment of the exercise device illustrated in FIG. 1 includes protective and decorative panels 20, which in some instances obscure the view of some components of the exercise device. FIG. 2 is an isometric view the exercise device illustrated in FIG. 1 with the protective and decorative panels removed to better illustrate all of the components of the device. Views of the exercise device shown in FIGS. 3-8, and others, in most instances, do not include the protective and decorative panels.

Referring to FIGS. 1, 2 and others, the exercise device includes a first treadle assembly 12A and a second treadle assembly 12B, each having a front portion 22 and a rear portion 24. The rear portions of the treadle assemblies 12 are pivotally supported at the rear of the exercise device 10. The front portions 22 of the treadle assemblies are supported above the frame 14, and are configured to reciprocate in a generally up and down manner during use. It is also possible to pivotally support the treadles at the front of the exercise device, and support the rear of the treadle assemblies above the frame. Each treadle assembly also supports an endless belt or "tread belt" that rotates over a deck 26 and about a front roller 28 and a common rear roller 30 to provide either a forward or rearward moving surface.

A user may perform exercise on the device facing toward the front of the treadle assemblies (referred to herein as "forward facing use") or may perform exercise on the device facing toward the rear of the treadle assemblies (referred to herein as "rearward facing use"). The term "front," "rear," and "right" are used herein with the perspective of a user standing on the device in the forward facing manner the device will be typically used. During any method of use, the user may walk, jog, run, and/or step on the exercise device in a manner where each of the user's feet contact one of the treadle assemblies. For example, in forward facing use, the user's left foot will typically only contact the left treadle assembly 12A and the user's right foot will typically only contact the right treadle assembly 12B. Alternatively, in rearward facing use, the user's left foot will typically only contact the right treadle assembly 12B and the user's right foot will typically only contact the left treadle assembly 12A.

An exercise device conforming to aspects of the invention may be configured to only provide a striding motion or to only provide a stepping motion. For a striding motion, the treadle assemblies are configured to not reciprocate and the endless belts 18 configured to rotate. The term "striding motion" is meant to refer to any typical human striding motion such as walking, jogging and running. For a stepping motion, the treadle assemblies are configured to reciprocate and the endless belts are configured to not rotate about the rollers. The term "stepping motion" is meant to refer to any typical stepping motion, such as when a human walks up stairs, uses a conventional stepper exercise device, strides up a hill, etc.

As mentioned above, the rear 24 of each treadle assembly is pivotally supported at the rear of the exercise device. The front of each treadle assembly is supported above the front portion of the exercise device so that the treadle assemblies may pivot upward and downward about the rear of each treadle. When the user steps on a tread belt 18, the associated treadle assembly 12A, 12B (including the belt) will pivot downwardly. As will be described in greater detail below, the treadle assemblies 12 are interconnected such that downward or upward movement of one treadle assembly will cause a respective upward or downward movement of the other treadle assembly. Thus, when the user steps on one belt 18, the associated treadle assembly will pivot downwardly while the other treadle assembly will pivot upwardly. With the treadle assemblies configured to move up and down and the tread belts configured to provide a moving striding surface, the user may achieve an exercise movement that encompasses a combination of striding and stepping.

FIG. 2 is a partial cutaway isometric view of the embodiment of the exercise device 10 shown in FIG. 1. With regard to the left and right treadle assemblies, the tread belt is removed to show the underlying belt platform or "Deck" 26 and the front roller 28 and the rear roller 30. In addition, the belt platform of the left treadle is partially cut away to show the underlying treadle frame components. Referring to FIG. 2 and others, the exercise device includes the underlying main frame 14. The frame provides the general structural support for the moving components and other components of the exercise device. The frame includes a left side member 32, a right side member 34 and a plurality of cross members 36 interconnecting the left side and right side members to provide a unitary base structure. The frame may be set directly on the floor or a may be supported on adjustable legs, cushions, bumpers, wheels, or combinations thereof. In the implementation of FIG. 2, adjustable legs 38 are provided at the bottom front left and front right corners of the frame.

Figure 5:
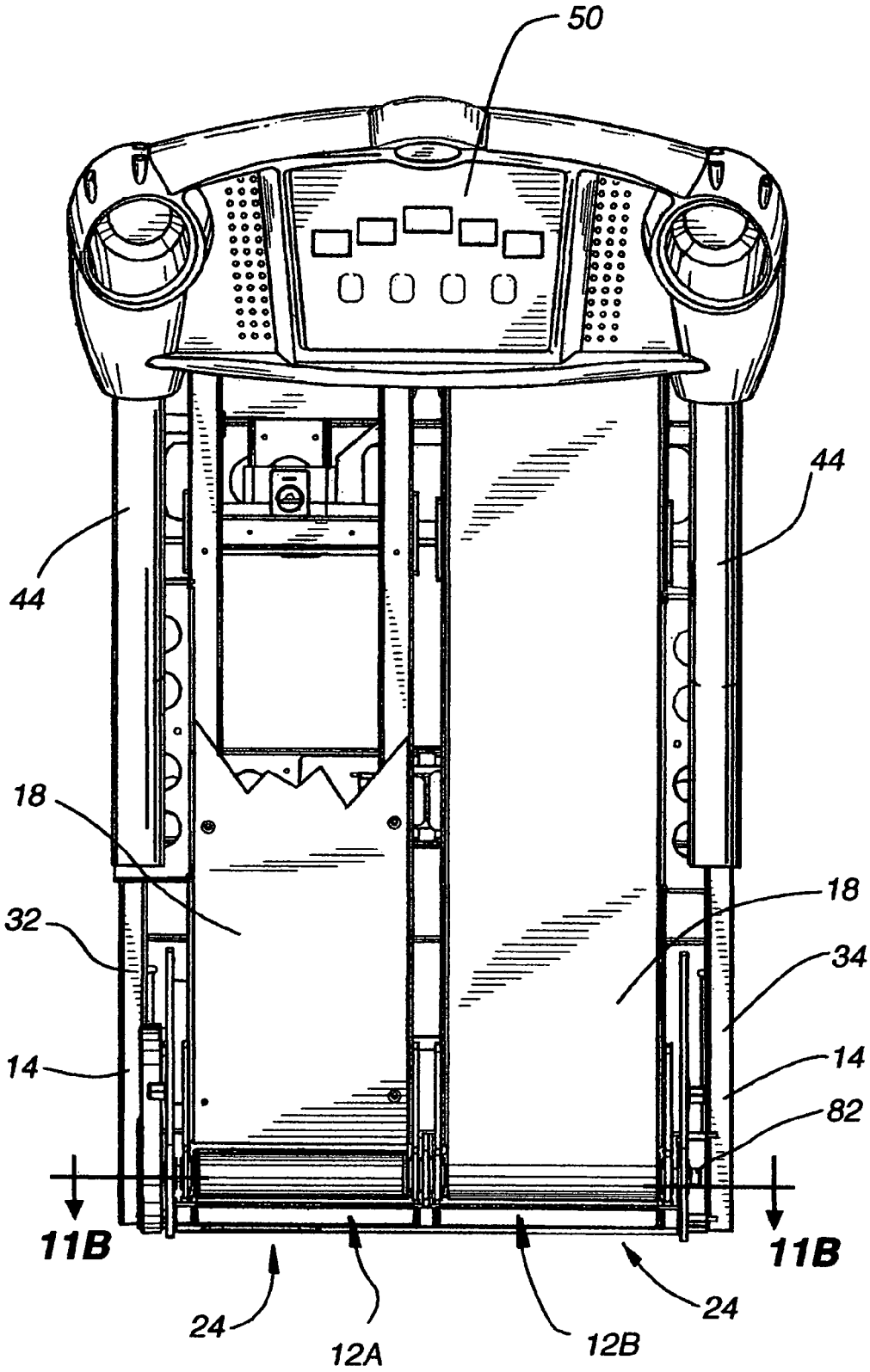
FIG. 5 is top view of the exercise device shown in FIG. 2.
Figure 7:
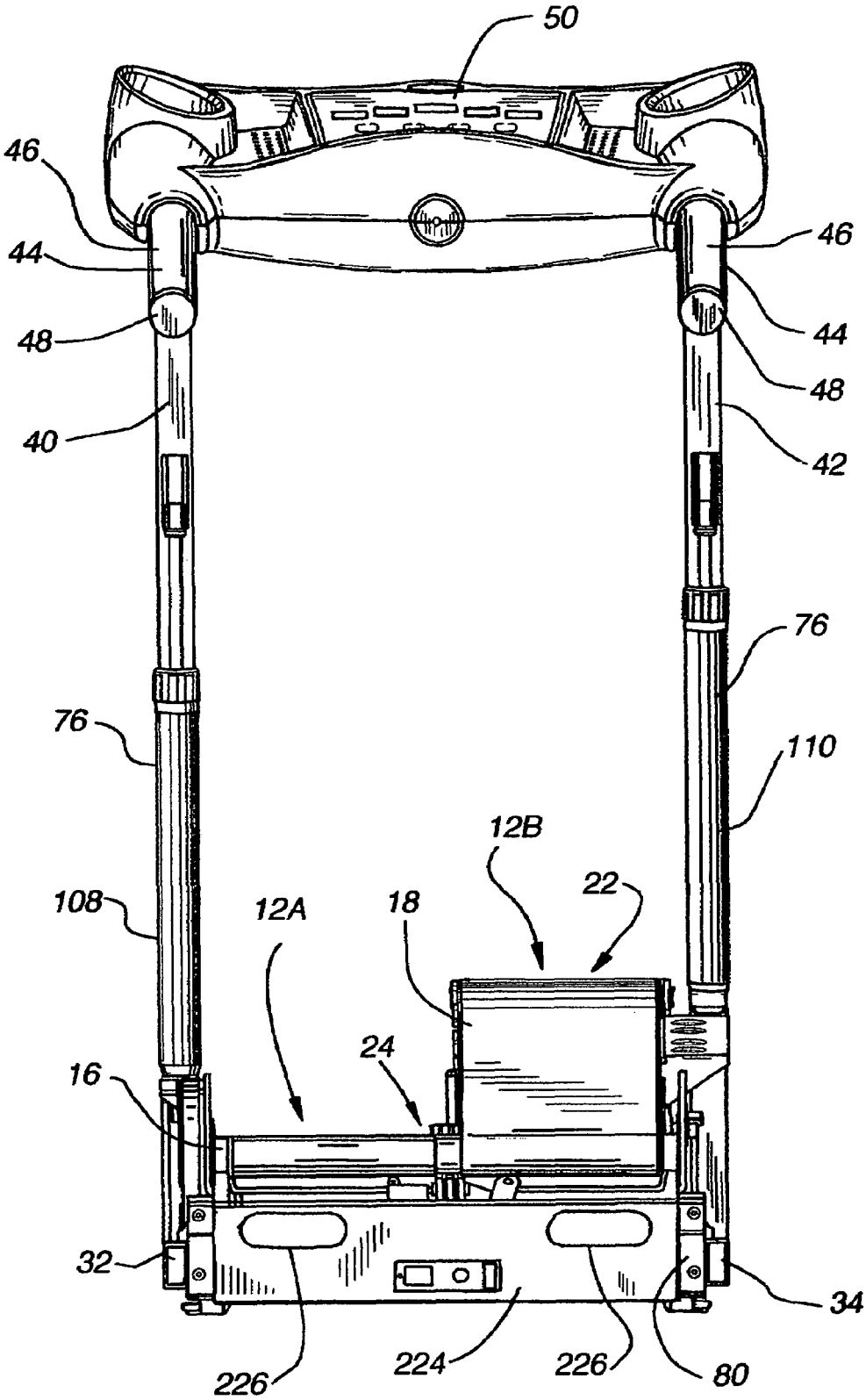
FIG. 7 is a rear view of the exercise device shown in FIG. 2.
Figure 8:
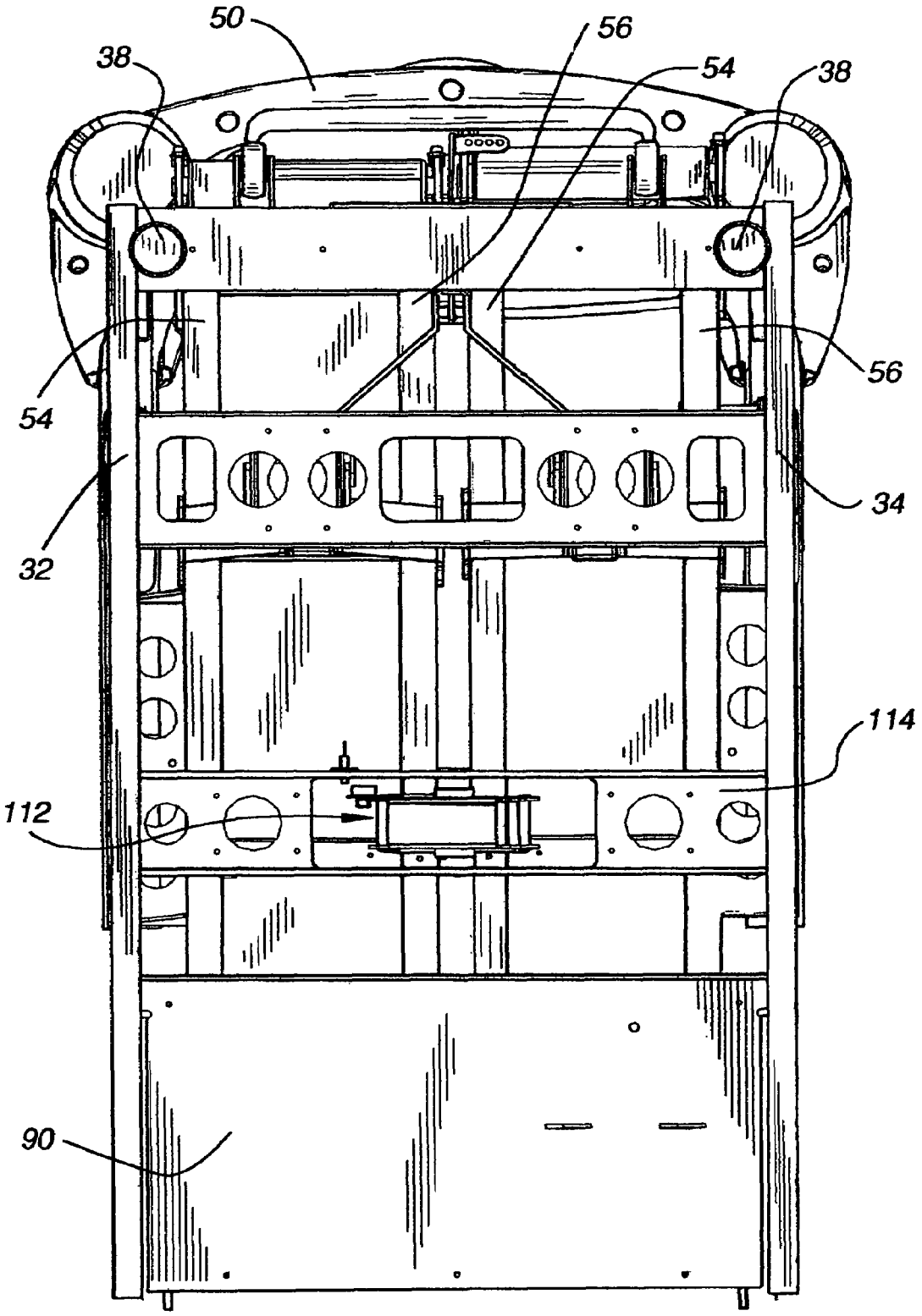
FIG. 8 is a bottom view of the exercise device shown in FIG. 2.

A left upright 40 is connected with the forward end region of the left side member 32. A right upright 42 is connected with the forward end region of the right side member 34. The uprights extend generally upwardly from the frame, with a slight rearward sweep. Handles 44 extend transversely to the top of each upright in a generally T-shaped orientation with the upright. The top of the T is the handle and the downwardly extending portion of the T is the upright. The handles may be arranged generally in the same plane as the respective underlying side members 32, 34. The handles define a first section 46 connected with the uprights, and a second rearwardly section 48 extending angularly oriented with respect to the first section. The handle is adapted for the user to grasp during use of the exercise device. A console 50 is supported between the first sections of the handles. The console includes one or more cup holders, an exercise display, and one or more depressions adapted to hold keys, a cell phone, or other personal items. The console is best shown in FIGS. 5 and 7.

Figure 3A:
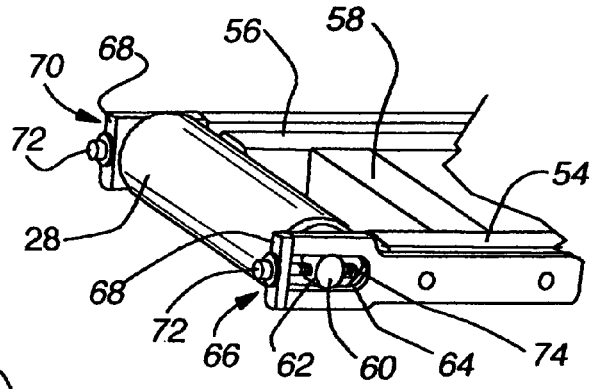
FIG. 3A is a detailed view of an adjustable front roller.
Figure 3:
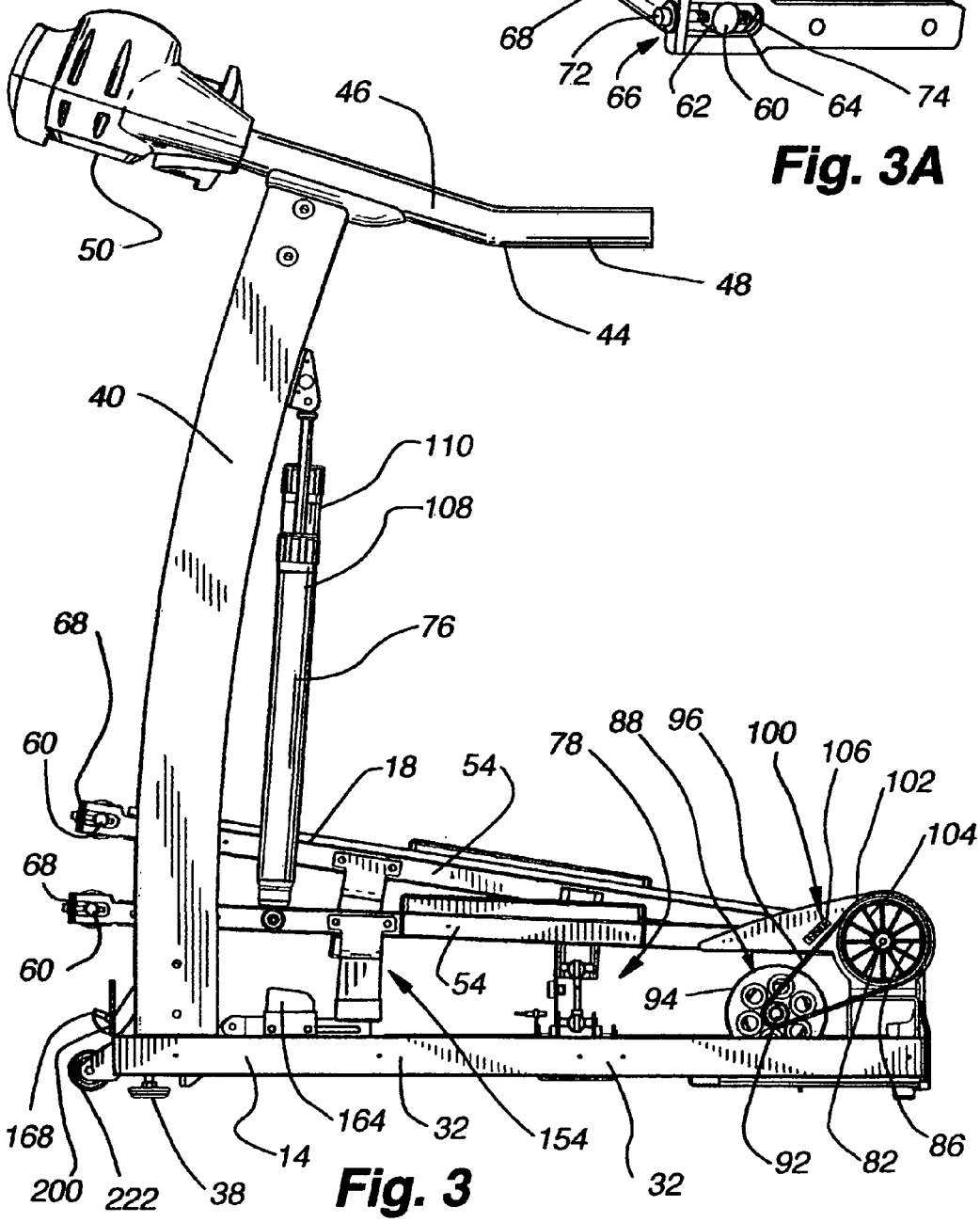
FIG. 3 is a left side view of the exercise device shown in FIG. 2.
Figure 4:
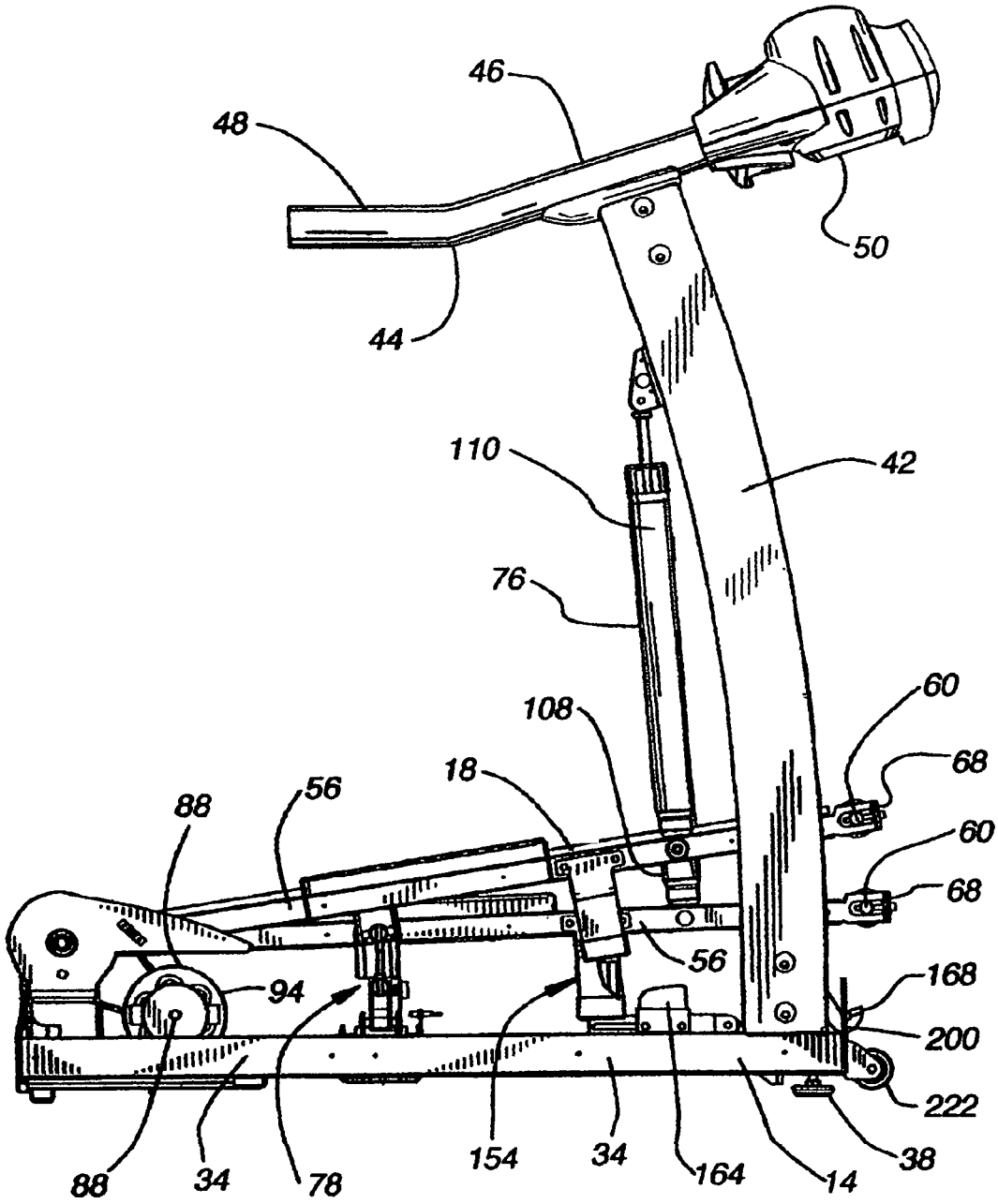
FIG. 4 is a right side view of the exercise device shown in FIG. 2.
Figure 6:
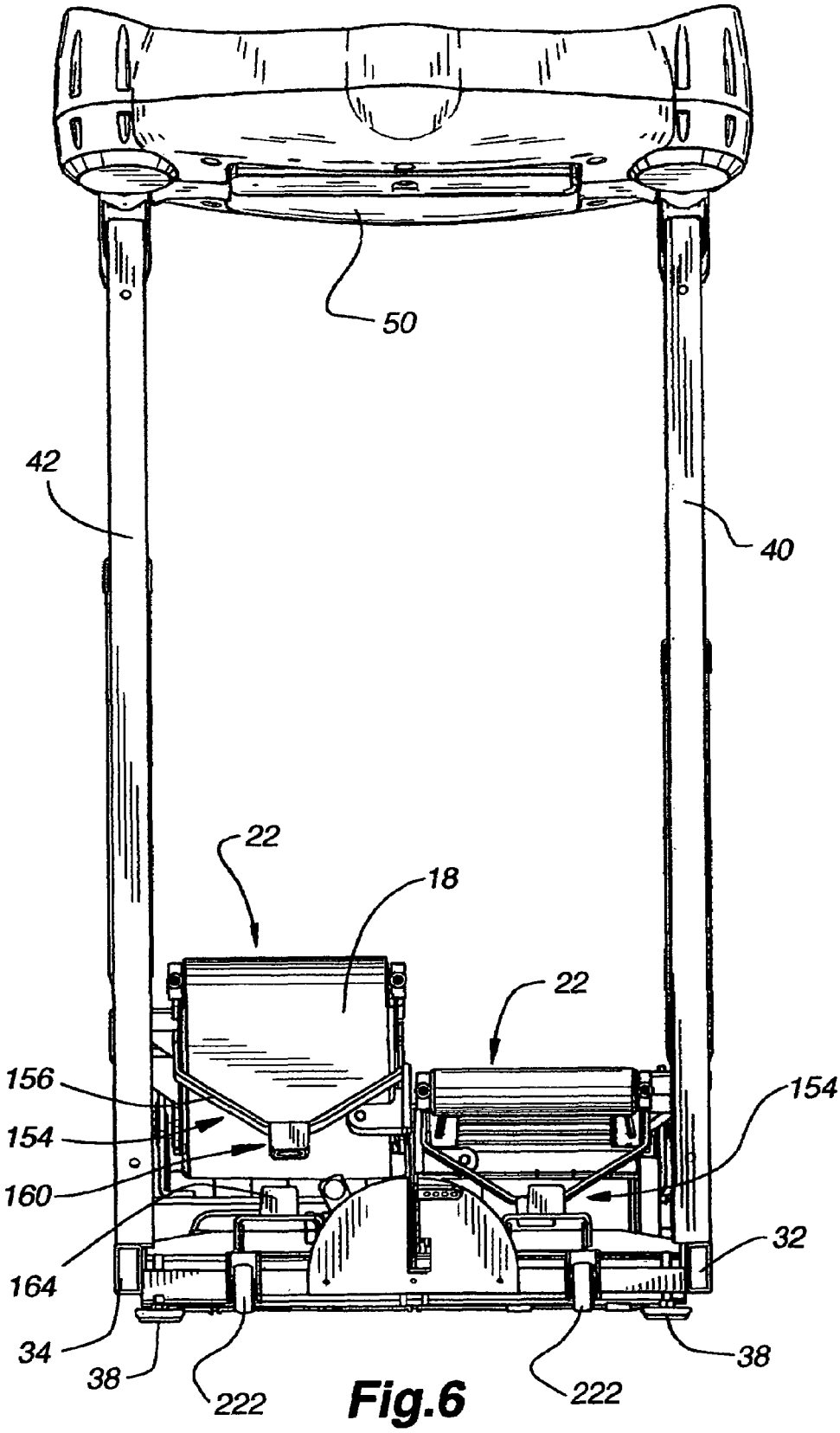
FIG. 6 is a front view of the exercise device shown in FIG. 2.
Figure 10A:
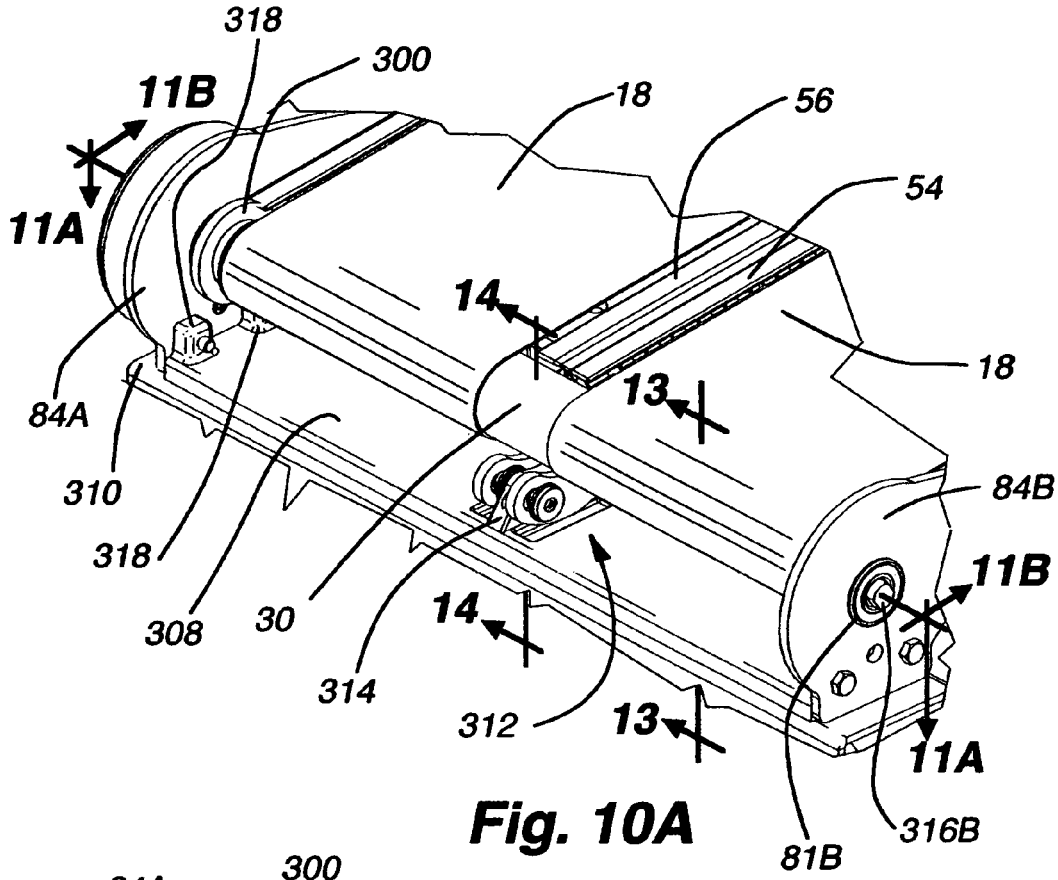
FIG. 10A is a detailed view of a rear roller of the exercise device shown in FIG. 9.
Figure 11A:
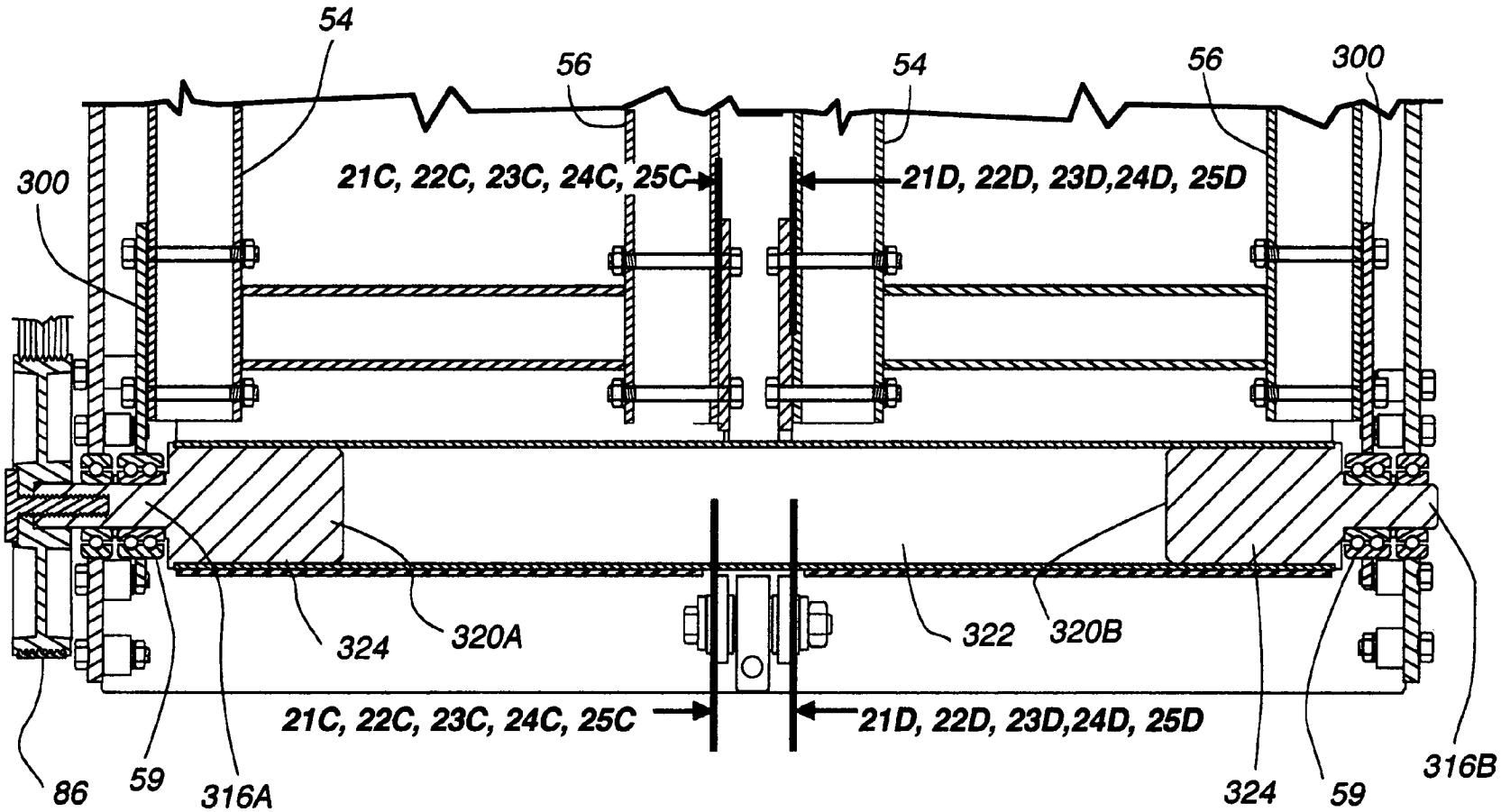
FIG. 11A is a cross-sectional view of the rear roller depicted in FIG. 10A, taken along line 11A-11A.
Figure 11B:
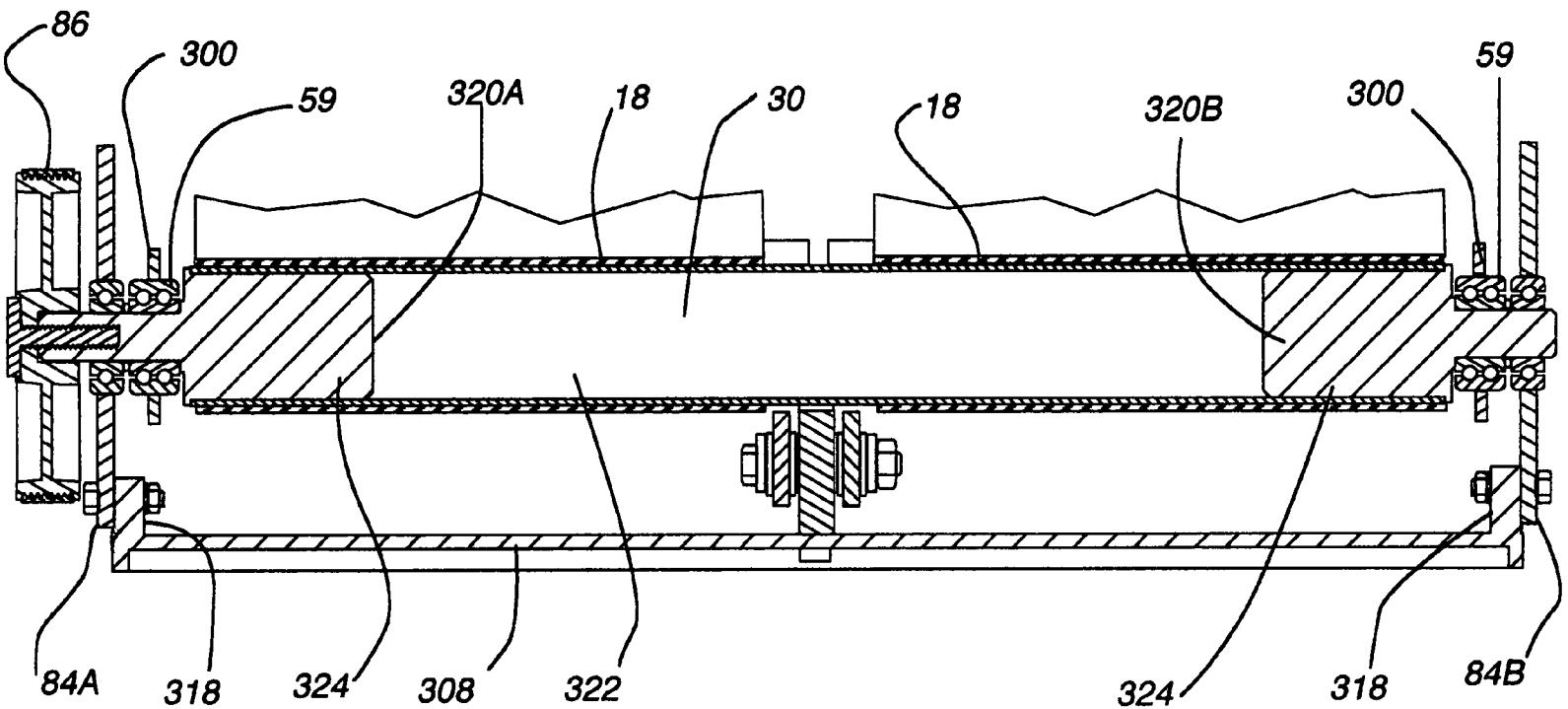
FIG. 11B is a cross-sectional view of the rear roller depicted in FIG. 10A, taken along line 11B-11B.

FIG. 3 is a left side view and FIG. 4 is right side view of the exercise device 10 shown in FIG. 2. FIG. 5 is a top view and FIG. 6 is a front view of the embodiment of the exercise device shown in FIG. 2. Referring to FIGS. 2-6, and others, each treadle assembly includes a treadle frame 52 having a left member 54, a right member 56, and a plurality of treadle cross members 58 extending between the left and right members. As best shown in FIGS. 10A, 11A, and 11B, the outside longitudinal members 54, 56 of each treadle are pivotally coupled to the rear axis (axle) 16 by radial ball bearings 59. More particularly, outer brackets 300 are connected with the outside longitudinal members 54, 56. The outer brackets 300 include an extended portion 302 connected with a bearing end 304. The bearing ends of the outer brackets are coupled with the rear roller 30 through the radial ball bearings. It is to be appreciated that the outer brackets can be separate parts or integrally formed with the outside longitudinal members.

The front rollers 28 are rotatably supported at the front of each treadle frame and the rear roller 30 is pivotally supported at the rear of each treadle frame. To adjust the tread belt tension and tracking, the front rollers or rear roller may be adjustably connected with the treadle frame. In one particular implementation as best shown in FIGS. 3, 3A, and 4, each front roller is adjustably connected with the front of each respective treadle frame. The front roller includes an axle 60 extending outwardly from both ends of the roller. The outwardly extending ends of the axle each define a threaded aperture 62 and are supported in a channel 64 defined in the forward end of the left 54 and right 56 treadle frame side members. The channel defines a forwardly opening end 66. A plate 68 defining a threaded aperture is secured to the front end of the left and right members so that the centerline of the aperture 70 is in alignment with the forward opening end 66 of the channel 64. A bolt is threaded into the threaded aperture and in engagement with the corresponding threaded aperture in the end of the roller axle 60 supported in the channel. Alternatively, a spring is located between the closed rear portion of the channel and the pivot axle to bias the pivot axle forwardly. By adjusting one or both of the bolts at the ends of the axle, the corresponding end of the axle may be moved forwardly or rearwardly in the channel to adjust the position of the front roller. Adjustment of the front roller can loosen or tighten the tread belt or change the tread belt travel.

The belt decks 26 are located on the top of each treadle frame 52. The deck may be bolted to the treadle frame, may be secured to the frame in combination with a deck cushioning or deck suspension system, or may be loosely mounted on the treadle frame. Each belt deck is located between the respective front roller 28 and common rear roller 30 of each treadle assembly 12A, 12B. The belt decks are dimensioned to provide a landing platform for most or all of the upper run of the tread belts 18.

The rear 24 of each treadle assembly 12 is pivotally supported at the rear of the frame 14, and the front 22 of each treadle assembly is supported above the frame by one or more dampening elements 76, an interconnection member 78, or a combination thereof, so that each treadle assembly 12 may pivot up and down with respect to the lower frame.

Figure 9:
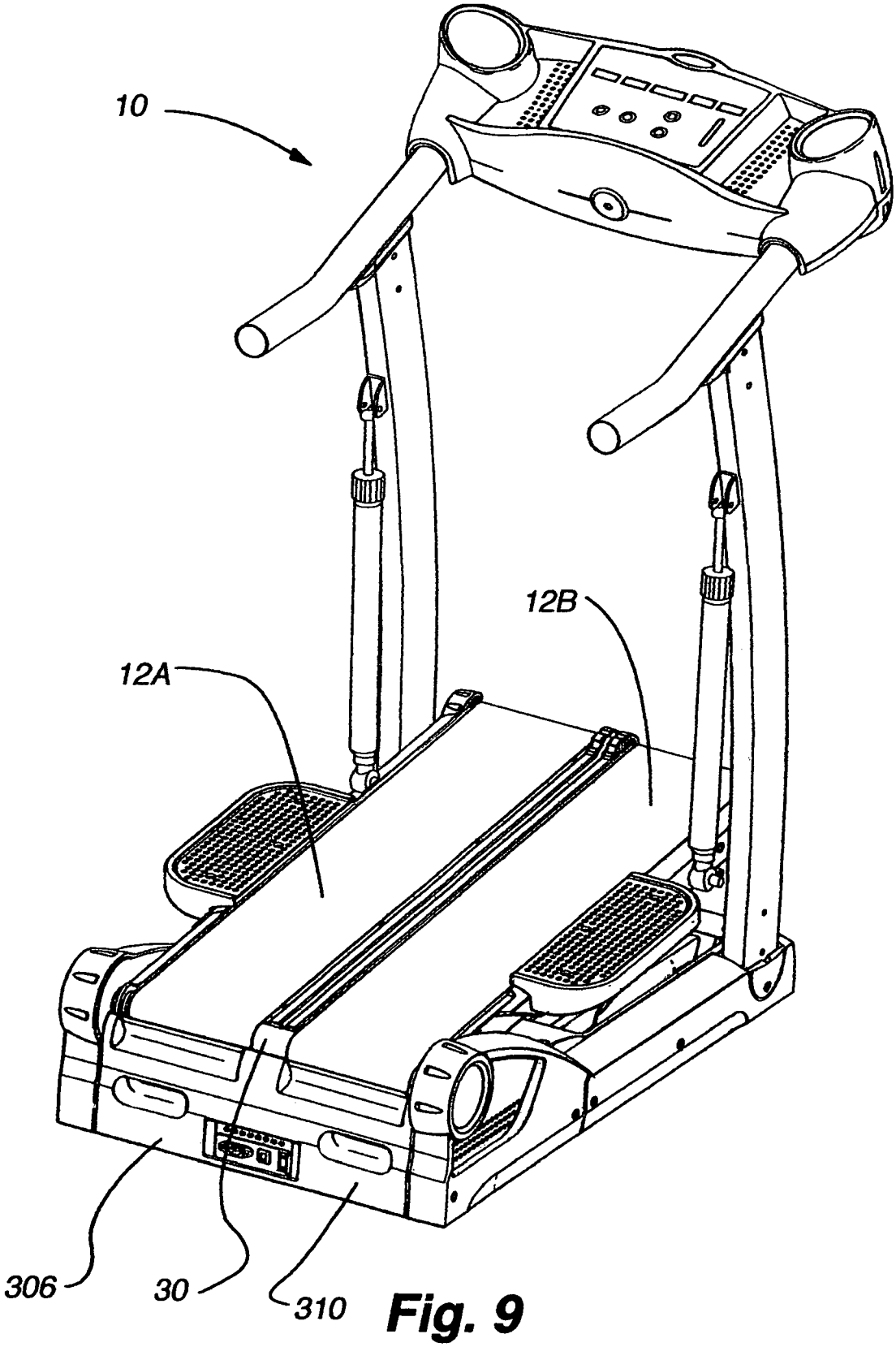
FIG. 9 is a rear isometric view of the exercise device shown in FIG. 2.
Figure 10B:
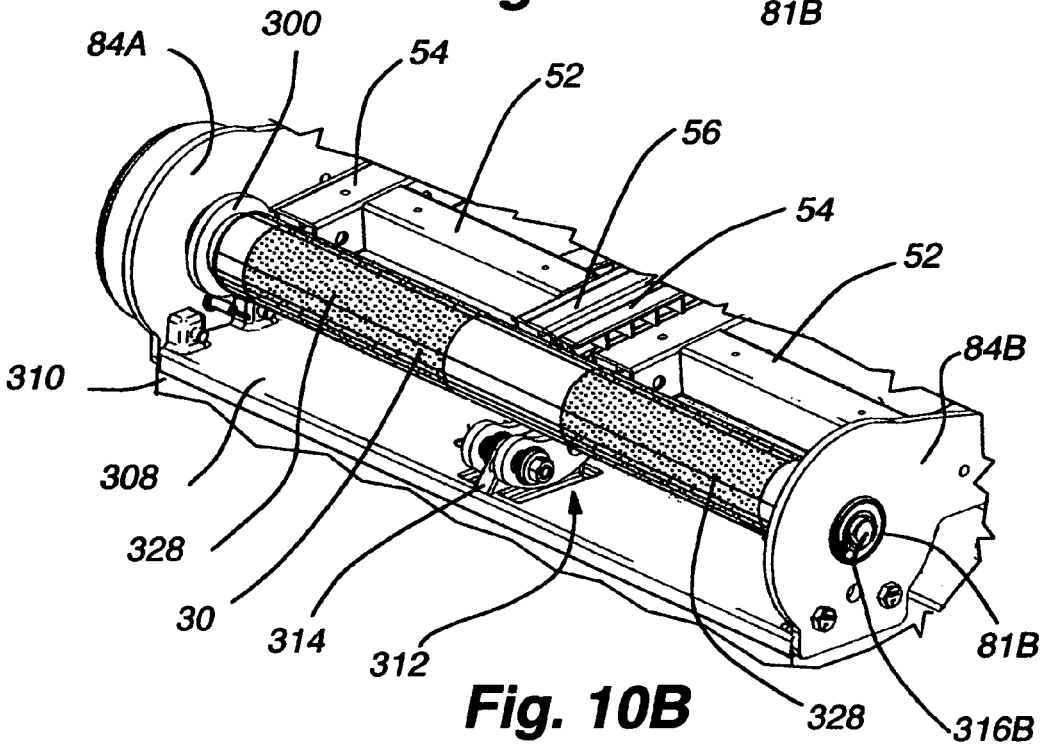
FIG. 10B is a detailed view of the rear roller shown in FIG. 10A with treadle belts removed.

Referring to FIGS. 9, 10A, 10B, and others, each treadle assembly 12 is pivotally supported above a rear support structure 306 of the main frame 14. More particularly, the rear support structure includes a rear drive casting 308 supported by a rear frame support 310. As discussed in more detail below, drive brackets extending upward from the rear drive casting rotatably support opposing end portions of the rear roller 30. An inner support structure 312 pivotally supporting the insides of the treadle frames includes a mounting block 314 extending upwardly from the rear drive casting between opposing end portions thereof. As described in more detail below, the mounting block supports the inside longitudinal members 54, 56 of the treadle frames 52.

Figure 10C:
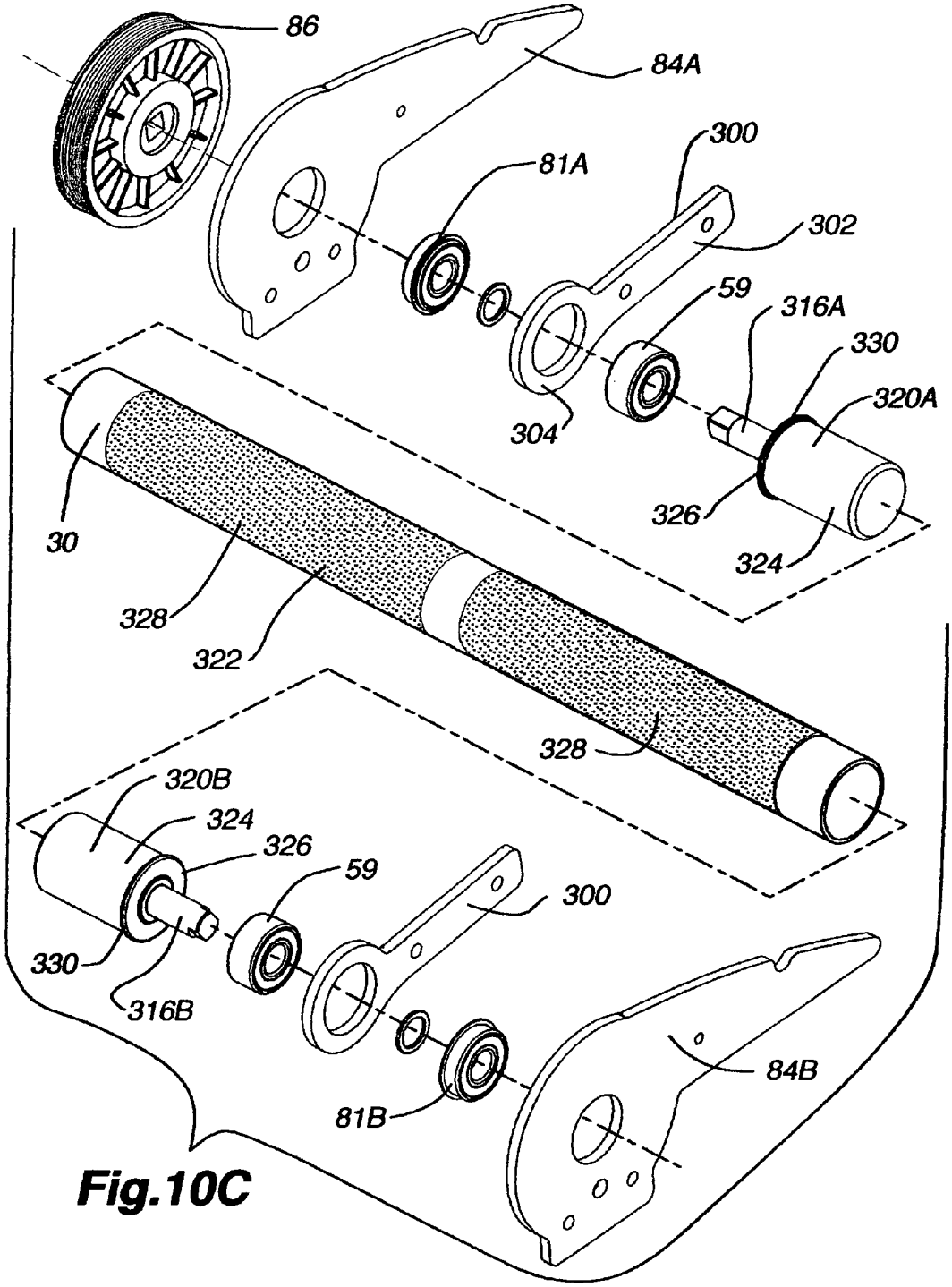
FIG. 10C is an exploded view of the rear roller shown in FIG. 10B.

As shown in FIGS. 10B-10C, axle ends 316A, 316B of the rear roller 30 are rotatably supported above the rear drive casting 308 by a left drive bracket 84A and a right drive bracket 84B. Corresponding radial bearings 81A and 81B rotatably support the axle ends in the brackets. Thus, the rear roller is rotatably supported about a common drive axis 82, which is also the common rear pivot axis 16 of the treadles 12. As best shown in FIGS. 10A and 11B, the right and left drive brackets are bolted to a pair of flanges 318 extending upward from opposing end portions of the rear drive casting. Although the drive brackets are bolted to the rear drive casting, it is to be appreciated that the drive brackets can be connected with the rear drive casting in any known manner, such as by screws, welding, or other such fastening technique.

As shown in FIGS. 10C, 11A, and 11B, the rear roller 30 includes right and left stub ends 320A, 320B inserted into opposing end portions of an elongated, generally cylindrical hollow tube 322. More particularly, the stub ends each include a cylindrical portion 324 connected with an end cap portion 326. The cylindrical portion of the stub end is adapted to be received within an end portion of the hollow tube. When the rear roller is installed on the exercise device, each treadle belt is positioned over the outer surface of the hollow tube. In some embodiments, the outer surface of the hollow tube includes knurled areas 328, as shown in FIG. 10B. Referring to FIG. 10C, the diameter of the end cap portion is larger than the diameter of the cylindrical portion of each stub end, defining an annular rim 330 therebetween. The annular rim acts as a stop that defines the maximum distance which the stub ends can be inserted into the hollow tube. The axle stubs can be connected with the hollow tube in various ways. For example, in one embodiment, the cylindrical portion of each axle stub is press fit into the end portions of the hollow tube. Other methods of attachment can also be used, such as welding, set screw, key way, or the like. As shown in FIG. 10C, the left and right axle ends 316A, 316B extend from the end cap portions 326 of the left stub end 320A and the right stub end 320B. When installed, the stub ends are configured so that the axle ends extend outwardly from the stub ends coextensive with the center line of the hollow tube. As discussed in more detail below, one axle end can be adapted to connect with a pulley used to drive the rotation of the rear roller. Although the end cap portions are depicted as solid, it is to be appreciated that the end cap portions may be configured in other ways. For example, the end cap portions can include a plurality of spokes connected with the cylindrical portion and the axle end. Further, although the rear roller embodiment described above includes stub ends, it is to be appreciated that the rear roller can be configured in different ways. For example, other rear roller embodiments can include a continuous axle extending through and connected with the roller.

A pulley 86 is secured to a portion of one of the axle ends. As shown in FIGS. 2, 3, 10C, and others, in one particular implementation, the drive pulley 86 is secured to the left axle end 316A. However, the drive pulley may be secured to the right axle end 316B, or somewhere along the length of the rear roller 30 between the left and right end regions. The pulley can be secured to the axle end by welding, set screw, or other such attachment structure. A motor 88 is secured to a bottom plate 90 (best shown in the bottom view of FIG. 8) that extends between the right 56 and left 54 side members. A motor shaft 92 extends outwardly from the left side of the motor. The motor is mounted so that the motor shaft is generally parallel to the drive shaft 82. A flywheel 94 is secured to the outwardly extending end region of the motor shaft. A drive belt 96 is connected between the drive shaft pulley and a motor pulley 98 connected with the motor shaft. Accordingly, the motor is arranged to cause rotation of the left axle end 316A and the rear roller 30.

Figure 12A:
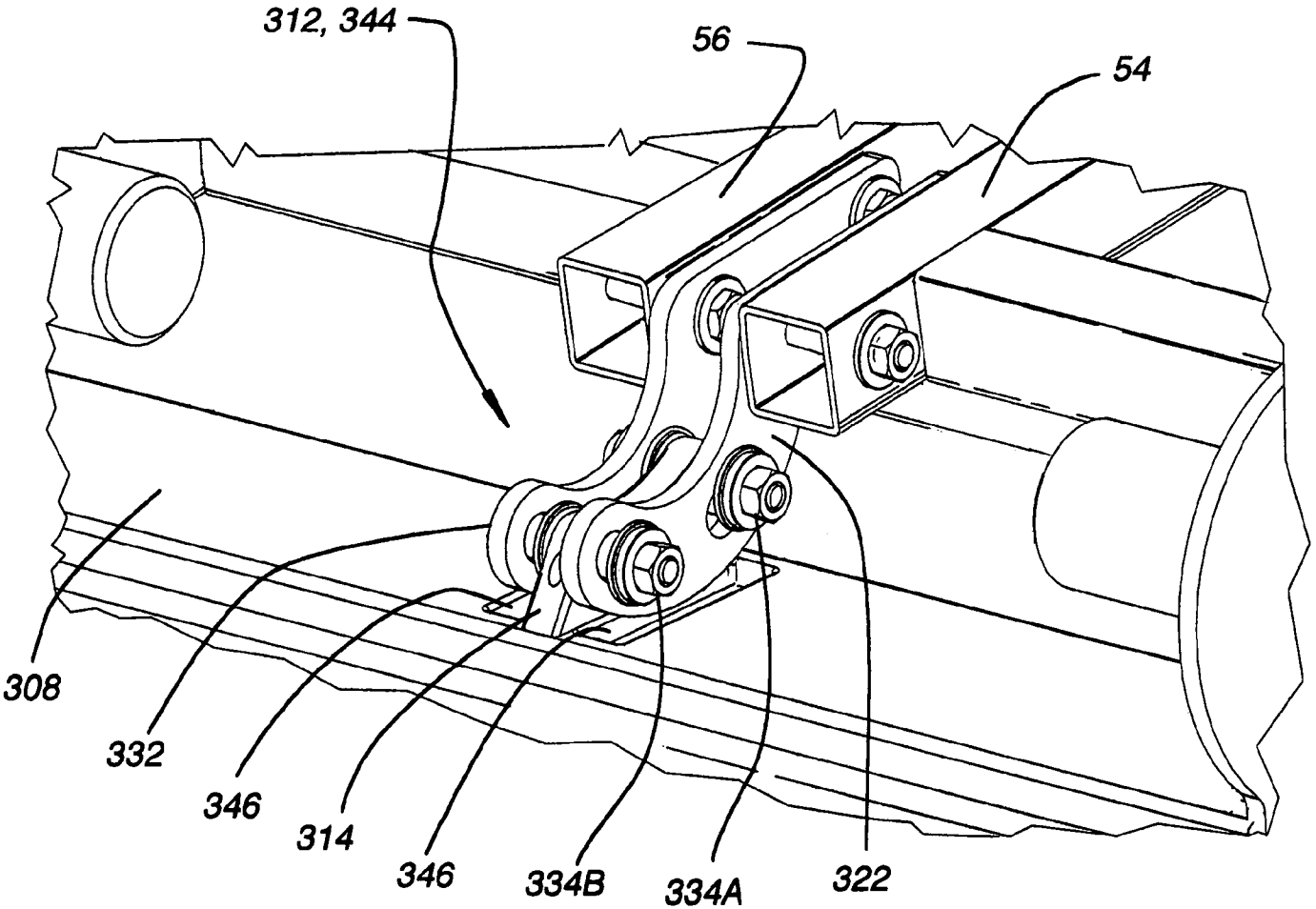
FIG. 12A is a detailed view of the rear of the exercise device shown in FIG. 9 with the rear roller removed and showing an inner support structure.
Figure 12B:
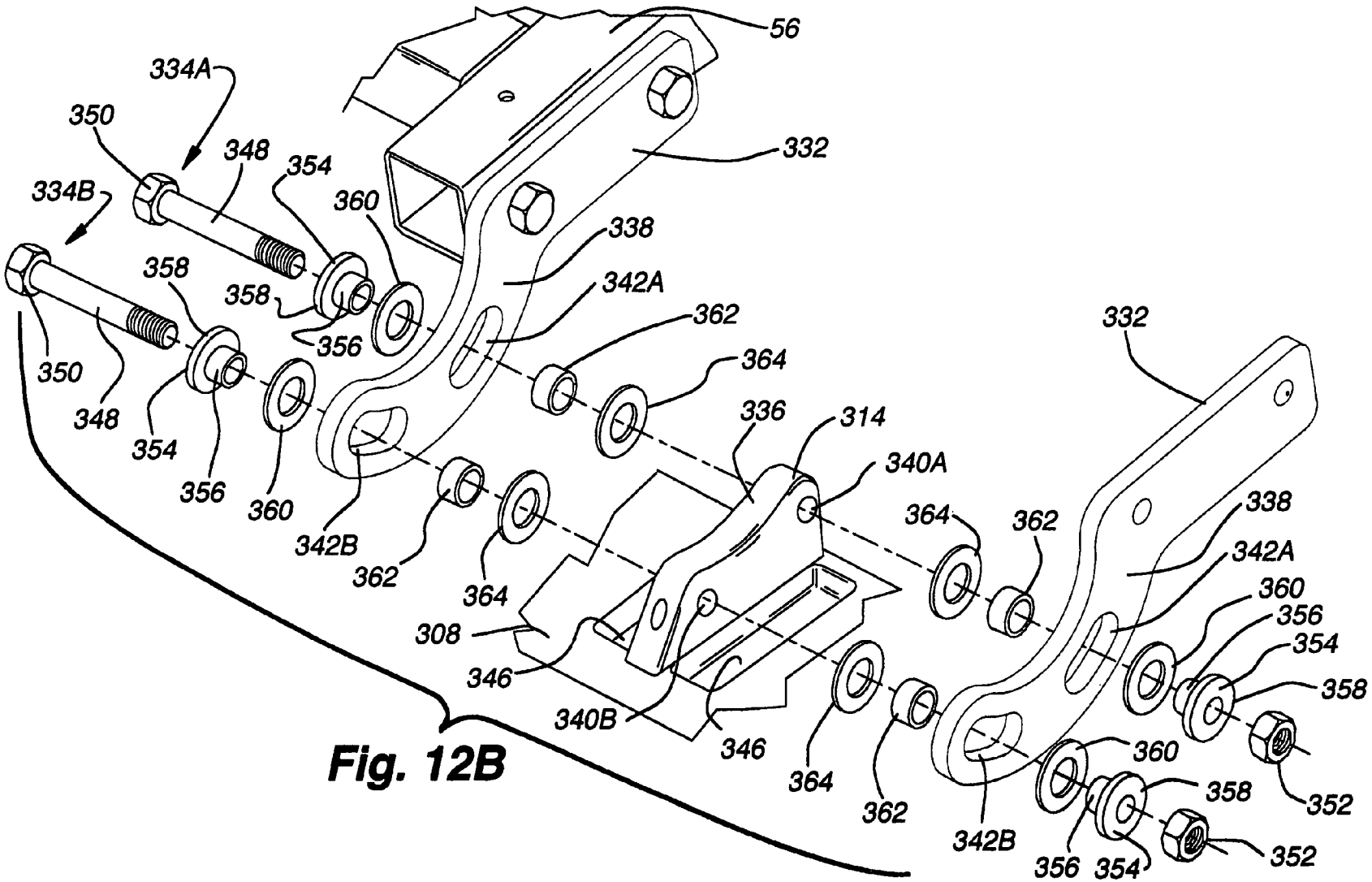
FIG. 12B is an exploded view of the inner support structure shown in FIG. 12A.
Figure 13:
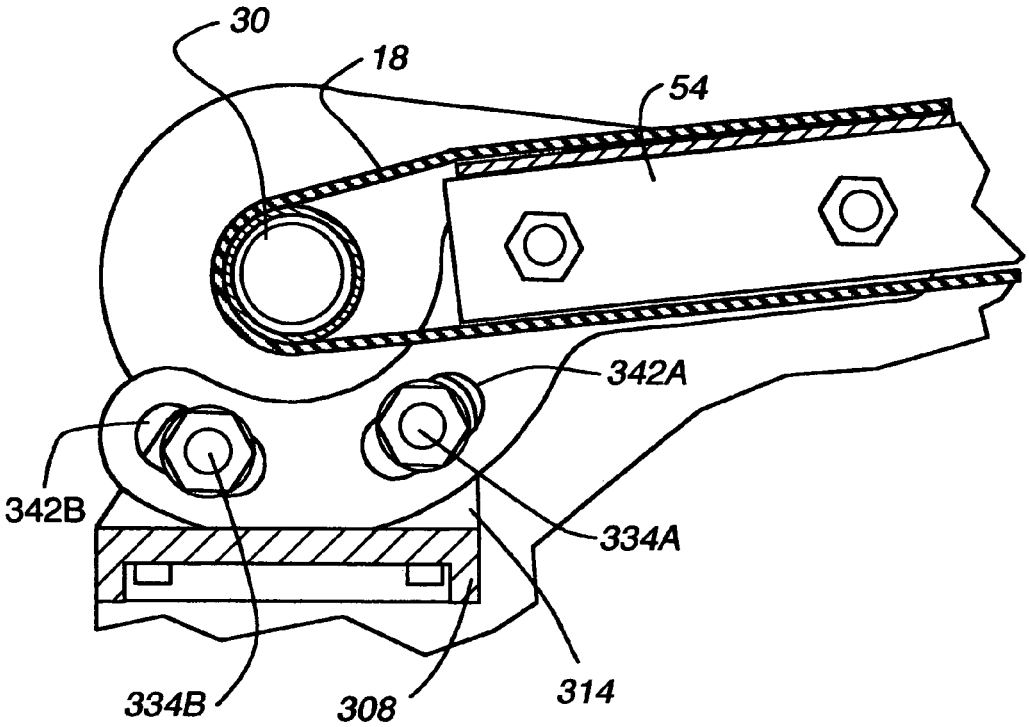
FIG. 13 is a cross-sectional view of the inner support structure depicted in FIG. 10A, taken along line 13-13.
Figure 14:
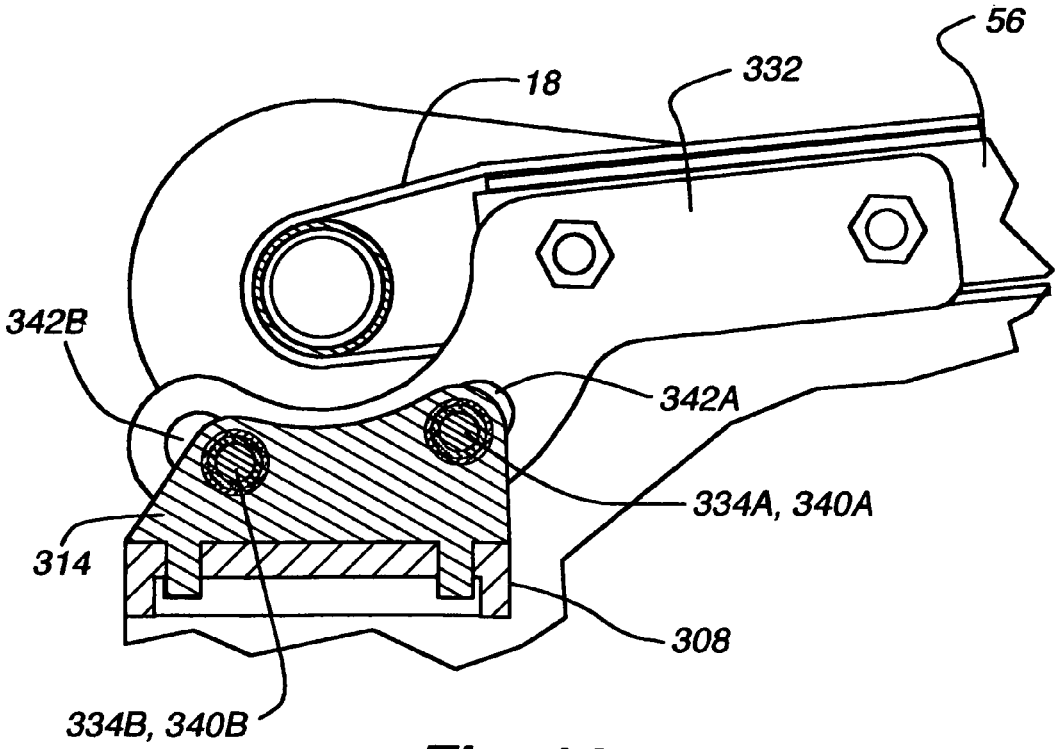
FIG. 14 is a cross-sectional view of the inner support structure depicted in FIG. 10A, taken along line 14-14.

As previously mentioned, the inner support structure 312 acts to support the inside longitudinal members 54, 56 of the treadle frames 14. More particularly, the inner support structure includes inner brackets 332 extending from the treadle frames slidingly coupled with studs 334A, 334B extending from opposite sides of the mounting block 314. It is to be appreciated that the inner brackets can be separate parts or integrally formed with the inside longitudinal members. In addition, the mounting block can be integrally formed with the rear drive casting or comprise a separate piece connected with the rear drive casting. In the embodiment shown in FIG. 12A, the mounting block is positioned near the middle of the rear drive casting and is connected by fasteners extending upward through the rear drive casting. As shown in FIG. 12B, the mounting block also includes a concave curved top surface 336 that follows the shape of the rear roller 30 positioned above. As discussed in more detail below, the studs 334A, 334B are supported by forward and rear apertures 340A, 340B extending through the mounting block. As shown in FIG. 14, the forward aperture is positioned relatively higher than the rear aperture.

As previously mentioned, inner brackets connected with the treadle frames are slidingly coupled with the studs on the mounting block and act to support the inside longitudinal members of the treadle frames. As shown in FIG. 12B, the inner brackets 332 include curved portions 338 extending downwardly and rearwardly from the rear ends of the inside longitudinal members 54, 56. The curved portions of the inner brackets each define at least one slot 342 therein which are slidingly supported by the studs 334A, 334B extending from the mounting block. As each treadle pivots around the rear pivot axis 16, the studs on the mounting block glide through the slots and thereby support inside longitudinal member of the treadle frame. The interaction of the curved portions of the inner brackets and the studs defines a virtual pivot 344 having a pivot center in common with the rear pivot axis. The virtual pivot eliminates the need to connect the inner ends of the treadle frames directly to the rear roller. Although the inner brackets have curved portions and curved slots, it is to be appreciated that the inner brackets need not have curved portions. As shown in FIGS. 12A and 12B, two recesses 346 are formed in the top surface of the rear drive casting 308 adjacent opposite sides of the mounting block 314. The two recesses allow bottom surfaces of the curved portions of the inner brackets to move back and forth without impacting or otherwise contacting the upper surface of the rear drive casting.

In one particular implementation, two arcuate slots are formed in the curved portions of each inner bracket, which are supported by corresponding studs 334A, 334B extending from the mounting block 314. More particularly as shown in FIG. 12B, the curved portion of each inner bracket includes a forward slot 342A and a rear slot 342B adapted to receive the forward stud 334A and the rear stud 334B, respectively. Having two slots supported by two studs helps provide sufficient lateral and longitudinal support to create sufficient rigidity to support the insides of each of the treadles during the pivoting motion. Although each inner bracket includes two slots located therein, other embodiments include a single slot supported by a single stud. The arc of each slot is defined at least in part by the distance from the center of rotation at which the slot is formed, and the length of the slot along the arc is defined at least in part by the distance that each treadle is allowed to pivot on the particular piece of fitness equipment. In one particular implementation, each slot defines a section of an arc of a circle, having a length defined by the amount of pivot motion each treadle moves through during use. The center of curvature of each arc is the rear pivot axis, which is also the same center of the axis of rotation of the rear roller as shown herein. It is to be appreciated that in other embodiments, the rear roller may be offset from the rear pivot axis for performance or other technical reasons.

As previously mentioned, each slot 342A, 342B in the inner brackets are adapted to receive corresponding studs 334A, 334B on the mounting block 314. As such, the inner bracket extending from each treadle is supported on opposite sides of the mounting block as shown in FIG. 12A. The studs preferably fit closely within the slots while at the same time sliding easily along the slots so as to not create any undesired friction. FIG. 12B shows the structures of the studs 334A, 334B in one implementation used to support the inner brackets 332. As shown in particular in FIG. 12B, each stud includes at least a through bolt 348 having a head portion 350 and a nut portion 352. A shim collar 354 is located at opposing ends of each bolt. More particularly, the shim collar 354 has a hollow sheath section 356 fitting over a portion of the bolt and a flange portion 358 extending radially from the hollow sheath section. The flange portion of one shim collar is positioned adjacent the head of the bolt, and the flange portion of the other shim collar is positioned adjacent the nut. A first friction bushing (washer) 360 is positioned around the sheath section 356 between the inner bracket 332 and the flange portion 354 of each shim collar. The first friction bushing can be made of various materials. For example, in one embodiment, the friction bushing is made of IGUS L280 or similar material. A bearing 362 is positioned on either side of the mounting block around the sheath section of the shim collar. The bearing can be constructed in various ways. For example, the bearing can be a sealed cartridge bearing, such as ball bearings, or can be made of a solid construction of a material, such as IGUS L280 or similar material. A second friction bushing (washer) 364 is positioned between the each inner bracket 332 and each side of the mounting block 314. The second bushing is also positioned over the sheath section of the shim collar. The second friction bushing can be made from various material, such as Teflon™ or other friction-reducing material. The bushings are sized to extend beyond the edges of the slots in the inner brackets to keep the inner brackets from rubbing against the mounting block. The diameter of each bearing is sized to fit closely within each slot and provide a surface over which the walls of the slot slide when the treadles pivot up and down around the axle. It is to be appreciated that different stud structures can be used providing a sliding surface for the inner brackets, and should not be limited to that which is described and depicted herein. As discussed in more detail below with reference to FIGS. 21A-25D, the slots in the inner brackets slide along the studs as the treadles pivot up and down.

A belt speed sensor 100 is operably associated with the tread belt 18 to monitor the speed of the tread belt. In one particular implementation the belt speed sensor is implemented with a reed switch 102 including a magnet 104 and a pick-up 106. The reed switch is operably associated with the drive pulley to produce a belt speed signal. The magnet is imbedded in or connected with the drive pulley 86, and the pick-up is connected with the main frame 14 in an orientation to produce an output pulse each time the magnet rotates past the pick-up.

As previously mentioned, the rear roller 30 is secured to the drive shaft 82. Thus, rotation of the drive shaft causes the rear roller along with the associated endless belts 18 to rotate at, or nearly at, the same pace. The motor may be configured or commanded through user control to drive the endless belts in a forward direction (i.e., from the left side perspective, counterclockwise about the front and rear rollers) or configured to drive the endless belts in a rearward direction (i.e., from the left side perspective, clockwise about the front and rear rollers).

During use, the tread belt 18 slides over the deck 26 with a particular kinetic friction dependant on various factors including the material of the belt and deck and the downward force on the belt. In some instances, the belt may slightly bind on the deck when the user steps on the belt and increases the kinetic friction between the belt and deck. Besides the force imparted by the motor 88 to rotate the belts, the flywheel 94 secured to the motor shaft has an angular momentum force component that helps to overcome the increased kinetic friction and help provide uniform tread belt movement. In one particular implementation, the deck is a ⅜" thick medium density fiber based (or "MDF") with an electron beam low friction cured paint coating. Further, the belt may be a polyester weave base with a PVC top. The belt may further incorporate a low friction material, such as low friction silicone.

Certain embodiments of the present invention may include a resistance element 76 operably connected with the treadles. As used herein the term "resistance element" is meant to include any type of device, structure, member, assembly, and configuration that resists the vertical movement, such as the pivotal movement, of the treadles. The resistance provided by the resistance element may be constant, variable, and/or adjustable. Moreover, the resistance may be a function of load, of time, of heat, or of other factors. Such a resistance element may provide other functions, such as dampening the downward, upward, or both movement of the treadles. The resistance element may also impart a return force on the treadles such that if the treadle is in a lower position, the resistance element will impart a return force to move the treadle upward, or if the treadle is in an upper position, the resistance element will impart a return force to move the treadle downward. The term "shock" or "dampening element" is sometimes used herein to refer to a resistance element, or to a spring (return force) element, or a dampening element that may or may not include a spring (return) force.

In one particular configuration of the exercise device, a resistance element 76 extends between each treadle assembly 12 and the frame 14 to support the front of the treadle assemblies and to resist the downward movement of each treadle. The resistance element or elements may be arranged at various locations between treadle frame and the main frame. In the embodiments shown in FIGS. 1-7, and others, the resistance elements include a first 108 and a second 110 shock. The shock both resists and dampens the movement of the treadles. More particularly, the first or left shock 108 extends between the left or outer frame member 54 of the left treadle assembly and the left upright frame member 40. The second shock 110 extends between the right or outer frame member 56 of the right treadle assembly and the right upright frame member 42.

In one particular implementation, the shock (108, 110) is a fluid-type or air-type dampening device and is not combined internally or externally with a return spring. As such, when a user's foot lands on the front of a treadle, the shock dampens and resists the downward force of the footfall to provide cushioning for the user's foot, leg and various leg joints such as the ankle and knee. In some configurations, the resistance device may also be adjusted to decrease or increase the downward stroke length of a treadle. The shock may be provided with a user adjustable dampening collar, which when rotated causes the dampening force of the shock to either increase or decrease to fit any particular user's needs. One particular shock that may be used in an exercise device conforming to the present invention is shown and described in U.S. Pat. No. 5,762,587 titled "Exercise Machine With Adjustable-Resistance, Hydraulic Cylinder," the disclosure of which is hereby incorporated by reference in its entirety.

Generally, the shock includes a cylinder filled with hydraulic fluid. A piston rod extends outwardly from the cylinder. Within the cylinder, a piston is connected with the piston rod. The piston defines at least one orifice through which hydraulic fluid may flow, and also includes a check valve. The piston subdivides the cylinder into two fluid filled chambers. During actuation of the shock, the piston either moves up or down in the cylinder. In downward movement or extension of the shock, the fluid flows through the orifice at a rate governed partially by the number of orifices and the size of the orifices. In upward movement or compression of the shock, the fluid flows through the check valve. The collar is operably connected with a plate associated with the orifice or orifices. Rotation of the collar, will expose or cover orifices for fluid flow and thus reduce or increase the dampening force of the shock. Alternatively, the dampening resistance collar is connected with a tapered plunger directed into an orifice between the hydraulic chambers of the shock. The depth of the plunger will govern, in part, the resistance of the shock. Preferably, the return spring shown in FIG. 4 of the '587 patent is removed.

Another particular shock that may be used in an exercise device conforming to the present invention is shown and described in U.S. Pat. No. 5,622,527 titled "Independent action stepper" and issued on Apr. 22, 1997, the disclosure of which is hereby incorporated by reference in its entirety. The shock may be used with the spring 252 shown in FIG. 10 of the '527 patent. The spring provides a return force that moves or returns the treadles upward after they are pressed downward. Preferably, however, the spring 252 is removed. As such, in one implementation of the present invention, the shock only provides a resistance and does not provide a return force. In an embodiment that does not employ a spring, the shock may be arranged to provide a resistance in the range of 47 KgF to 103 KgF. Alternative resistance elements are discussed in more detail below.

Figure 15:
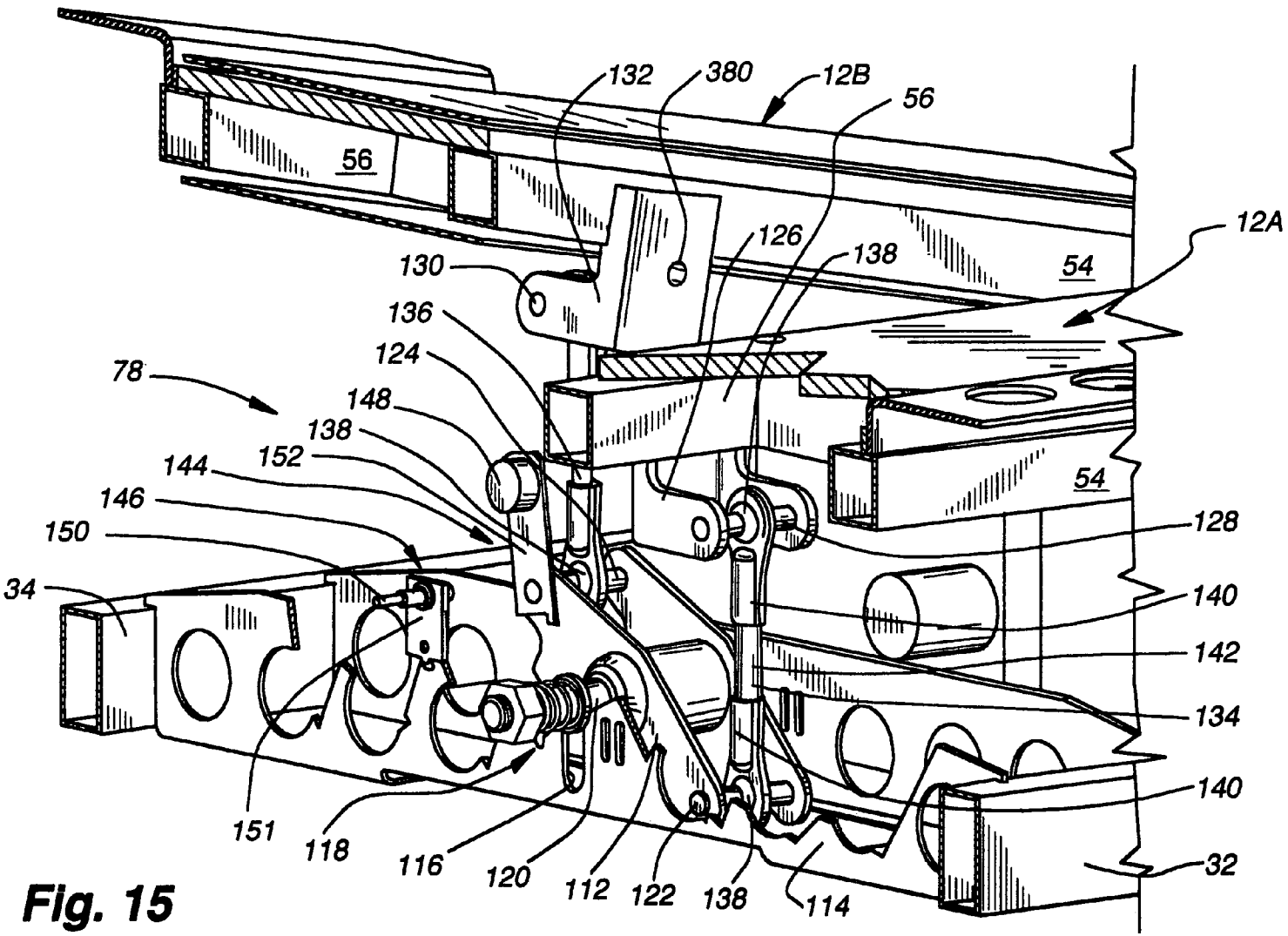
FIG. 15 is a partial cut away isometric view of the exercise device shown in FIG. 2, the view illustrating the rocker arm orientated in a position corresponding with the left treadle in about the lowest position and the right treadle in about the highest position.
Figure 16:
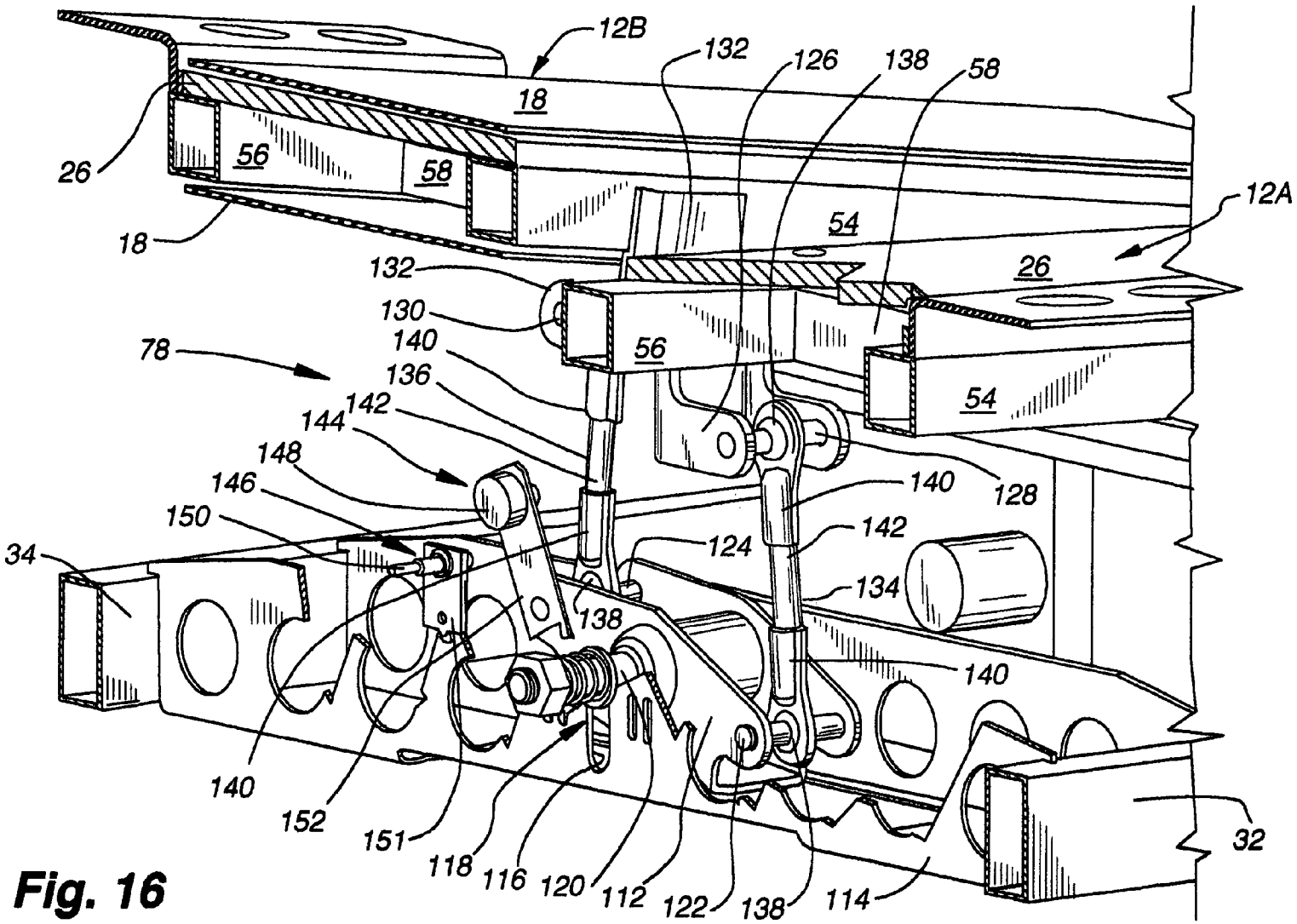
FIG. 16 is a partial cut away isometric view of the exercise device shown in FIG. 2, the view illustrating the rocker arm orientated in a position corresponding with the left treadle in a position higher than in FIG. 15 and the right treadle in a position lower than in FIG. 15.
Figure 17:
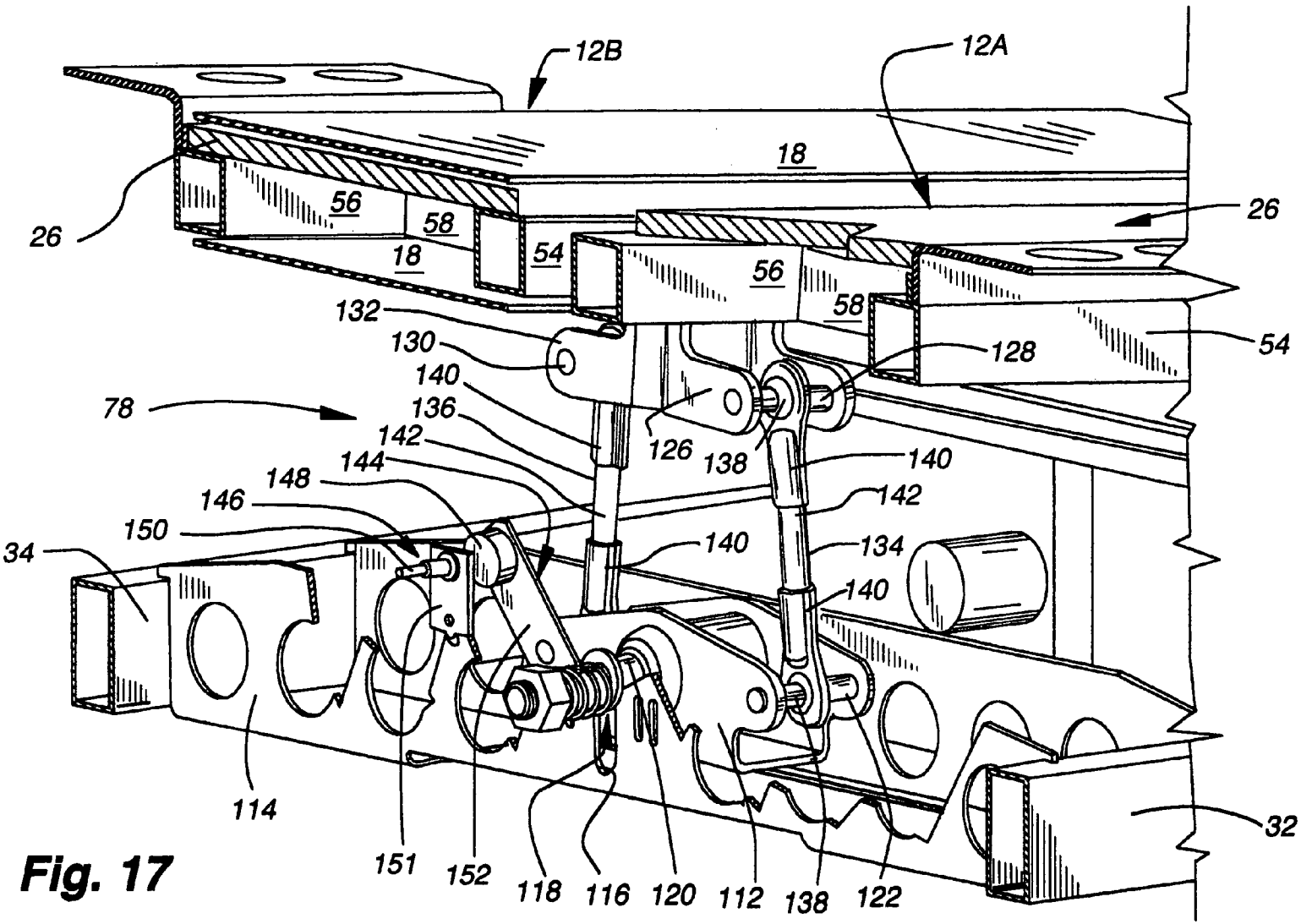
FIG. 17 is a partial cut away isometric view of the exercise device shown in FIG. 2, the view illustrating the rocker arm orientated in a position corresponding with the left treadle about parallel with the right treadle.
Figure 18:
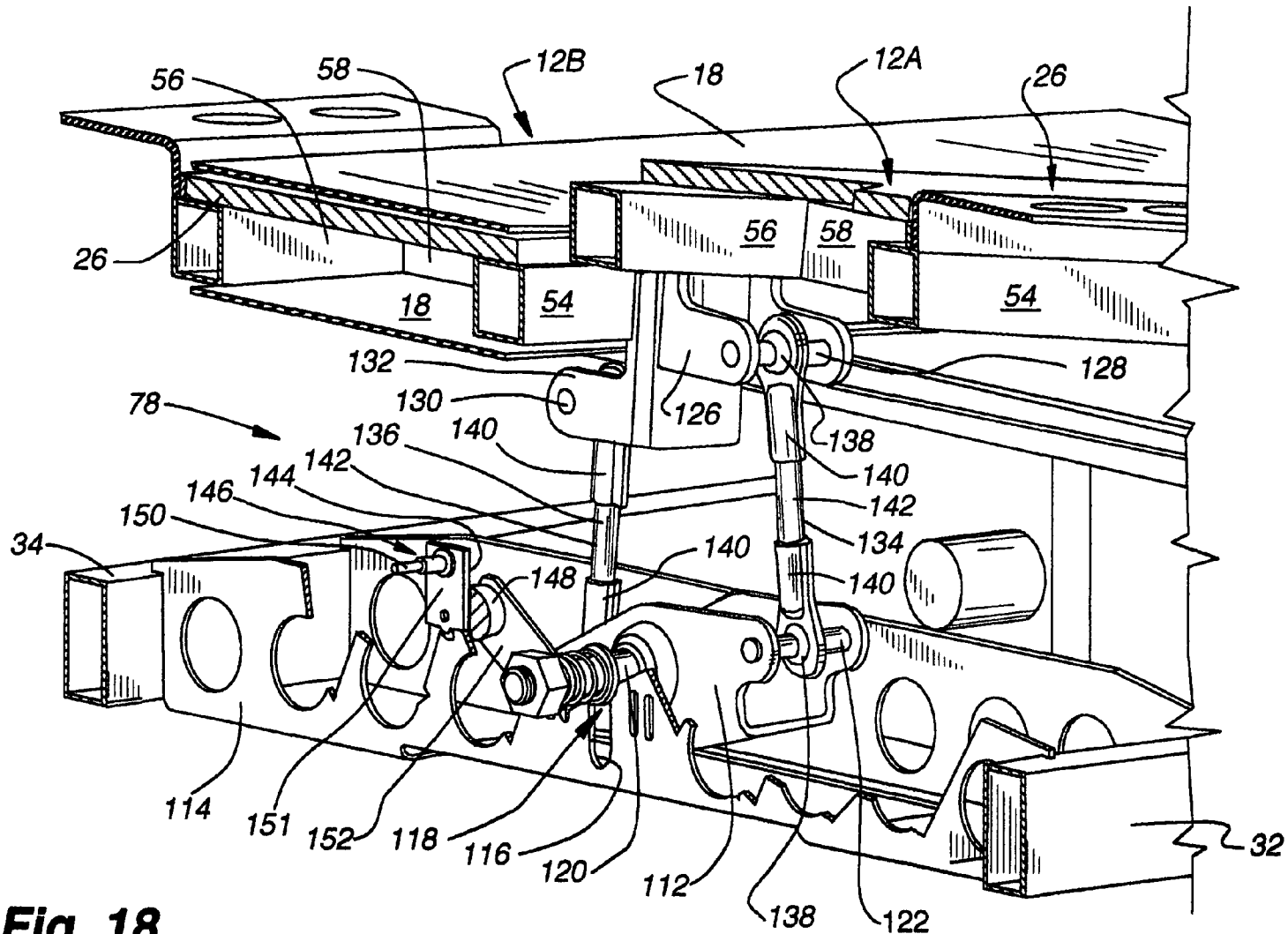
FIG. 18 is a partial cut away isometric view of the exercise device shown in FIG. 2, the view illustrating the rocker arm orientated in a position corresponding with the left treadle in a position higher than in FIG. 17 and the right treadle in a position lower than in FIG. 17.
Figure 19:
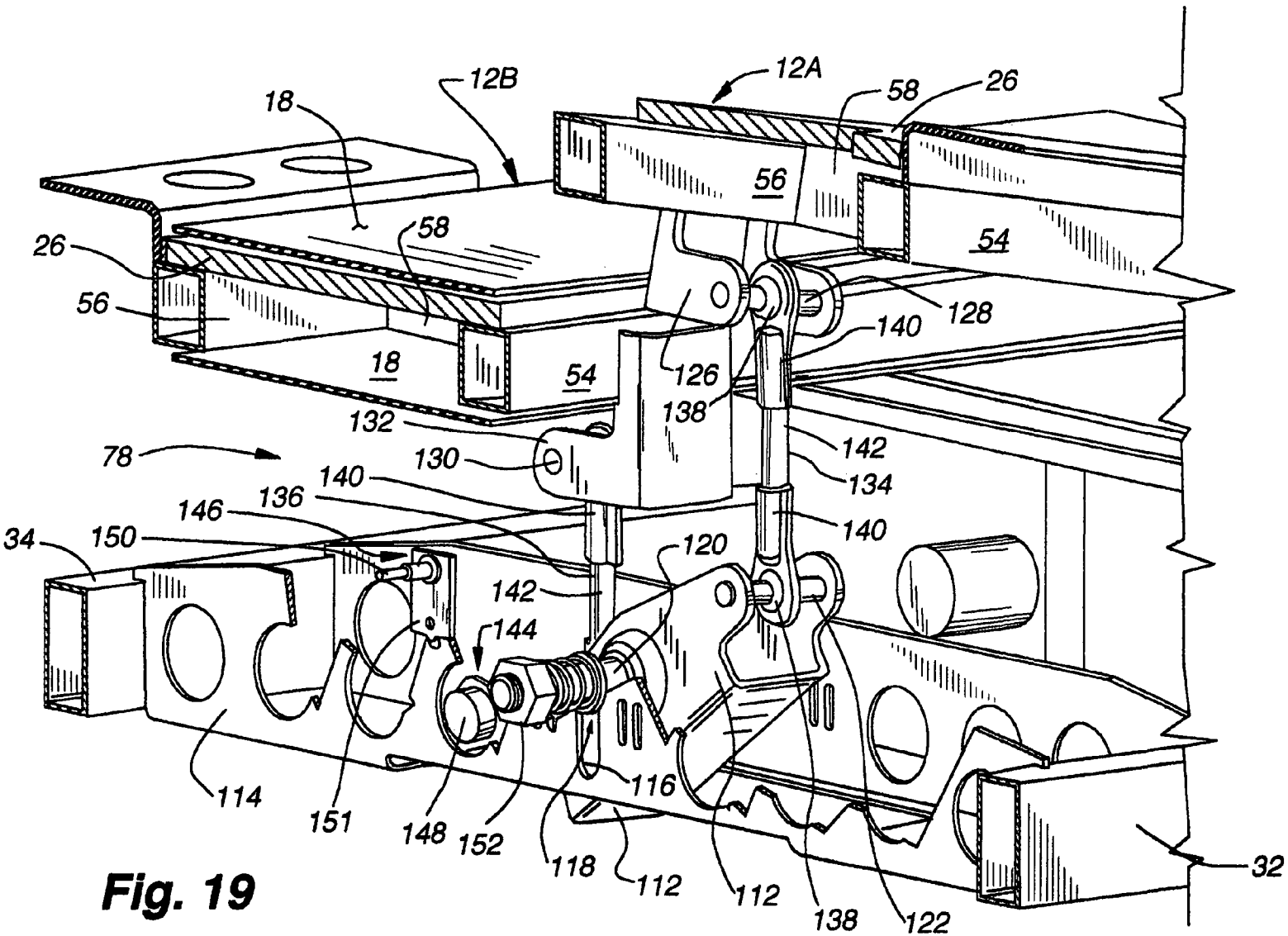
FIG. 19 is a partial cut away isometric view of the exercise device shown in FIG. 2, the view illustrating the rocker arm orientated in a position corresponding with the left treadle in a position higher than in FIG. 18 and the right treadle in a position lower than in FIG. 18.
Figure 20:
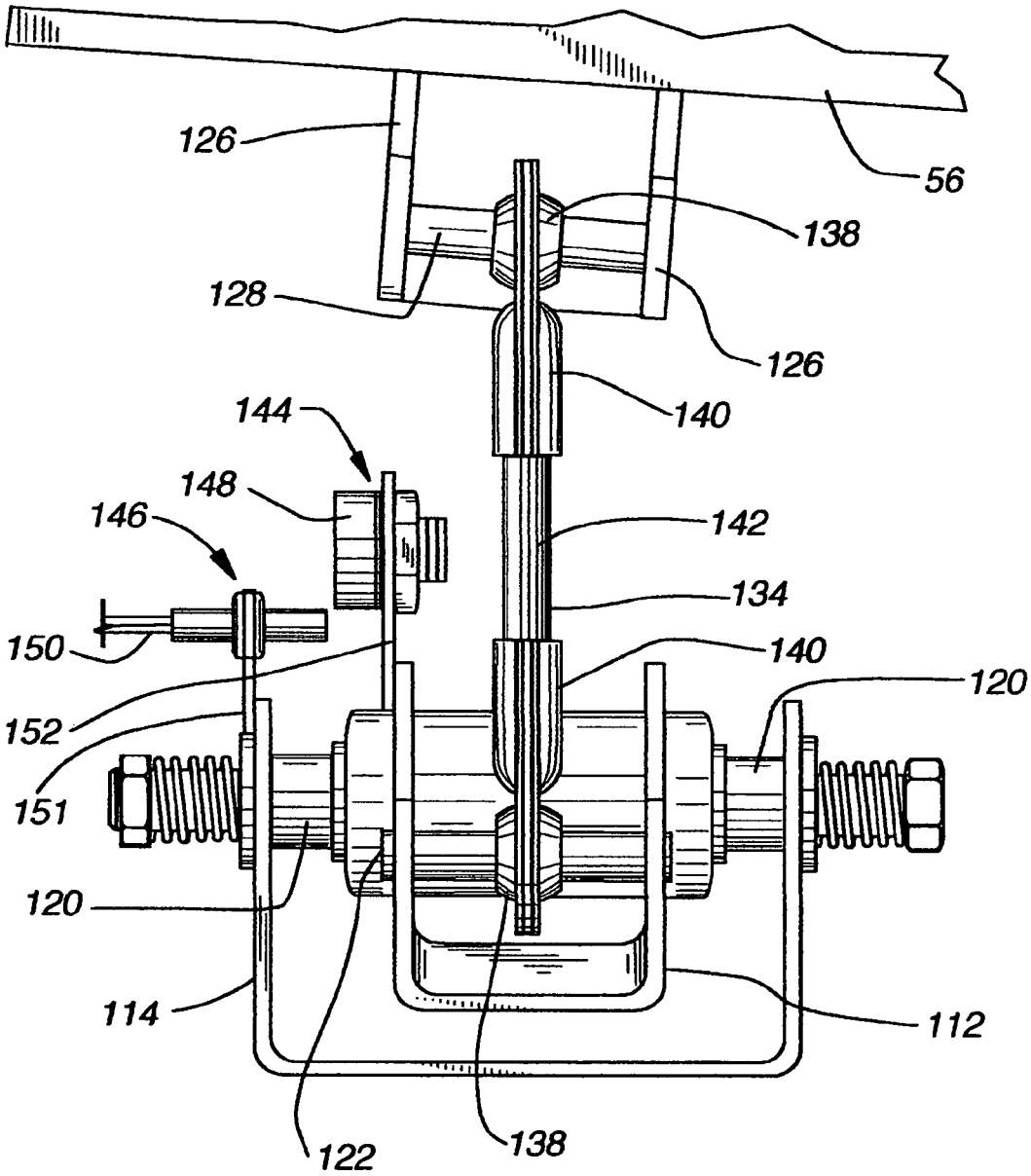
FIG. 20 is a left side view of one embodiment of the rocker arm.

FIGS. 15-19 are partial isometric views of the exercise device particularly illustrating the treadle interconnection structure 78. Each of FIGS. 15-19 show the interconnection structure in a different position. FIG. 20 is a side view of the treadle interconnection structure in the same position as is shown in FIG. 17. FIGS. 21(A,B)-25(A,B) are isometric views of the exercise device corresponding with the views shown in FIGS. 15-19. In the particular implementation of the interconnection structure illustrated in FIGS. 15-20 and others, the interconnection structure includes a rocker arm assembly 112 pivotally supported on a rocker cross member 114 extending between the left 32 and right 34 side members of the frame. The rocker arm assembly is operably connected with each treadle assembly 12. As best shown in FIG. 20, the rocker cross member defines a U-shaped cross section. Each upstanding portion of the U defines a key way 116, (see, e.g., FIG. 19). The top of the key way defines a pivot aperture 118. The rocker arm includes a rocker pivot axle 120 that is supported in and extends between each pivot aperture to pivotally support the rocker arm. As discussed in more detail below, the key way provides a way for the interconnect structure to be moved between a "shipping" position and a "use" position.

The left and right outer portions of the rocker arm include a first or left lower pivot pin 122 and a second or right lower pivot pin 124, respectively. A generally L-shaped bracket 126 supporting a first upper pivot pin 128 extends downwardly from the inner or right side member 56 of the left treadle 12A so that the upper pivot pin is supported generally parallel, below, and outwardly of the inner side member. A second generally L-shaped bracket 132 supporting a second upper pivot pin 130 extends downwardly from the inner or left side tube 54 of the right treadle assembly 12B so that the upper pivot pin is supported generally parallel, below, and outwardly of the inner side member.

A first rod 134 is connected between the left upper 128 and lower 122 pivot pins. A second rod 136 is connected between the right upper 130 and lower 124 pivot pins. The rods couple the treadles to the rocker arm. In one particular implementation, each rod (134, 136) defines a turnbuckle with an adjustable length. The turnbuckles are connected in a ball joint 138 configuration with the upper and lower pivot pins. A turnbuckle defines an upper and a lower threaded sleeve 140. Each threaded sleeve defines a circular cavity with opposing ends to support a pivot ball. The pivot pins are supported in the pivot balls. A rod defines opposing threaded ends 142, each supported in a corresponding threaded sleeve.

As will be discussed in more detail below, the treadle assemblies 12 may be locked-out so as to not pivot about the rear axis 16. When locked out, the belts 18 of the treadle assemblies collectively provide an effectively single non-pivoting treadmill-like striding surface. By adjusting the length of one or both of the turnbuckles 134, 136 through rotation of the rod 142 during assembly of the exercise device or afterwards, the level of the two treadles may be precisely aligned so that the two treadles belts, in combination, provide parallel striding surfaces in the lock-out position.

The interconnection structure 78 (e.g., the rocker arm assembly) interconnects the left treadle with the right treadle in such a manner that when one treadle, (e.g., the left treadle) is pivoted about the rear pivot axis 16 downwardly then upwardly, the other treadle (e.g., the right treadle) is pivoted upwardly then downwardly, respectively, about the rear pivot axis in coordination. Thus, the two treadles are interconnected in a manner to provide a stepping motion where the downward movement of one treadle is accompanied by the upward movement of the other treadle and vice versa. During such a stepping motion, whether alone or in combination with a striding motion, the rocker arm 112 pivots or teeters about the rocker axis 120.

Although one embodiment of the treadle interconnection structure is configured to have a "use" position and a "shipping" position, the exercise device can also be configured to be shipped partially disassembled, which eliminates the need to have an interconnection structure with a "shipping" position. For example, the exercise can be configured to be shipped in three boxes: a first box containing the base frame, a second box containing the treadle assemblies, and a third box containing the uprights and console. The second box containing the treadle assemblies includes the two treadles including the treadle frame, front and rear rollers, treadle decks, treadle belts, drive brackets, the rear drive casting, and the inner support structure. The treadle assemblies are connected with the base frame by attaching the rear drive casting to the rear frame support. The interconnection structure can be shipped as part of the treadle assembly and when the treadle assembly is connected with the frame, the interconnection structure is simply connected with the frame by connecting the rocker arm with the rocker pivot axle.

Referring now to FIGS. 15-19 and 21(A,B)-25(A,B), the climbing-like exercise provided by the motion of the exercise device 10 is described in more detail. A representative user (hereinafter the "user") is shown in forward facing use in FIGS. 21B-25B. The user is walking forward and the device is configured for climbing-type use, i.e., so the treadles reciprocate. The foot motion shown is representative of only one user. In some instances, the treadles 12 may not move between the upper-most and lower-most position, but rather points in between. In some instances, the user may have a shorter or longer stride than that shown. In some instances, a user may walk backward, or may face backward, or may face backward and walk backward.

Figure 21A:
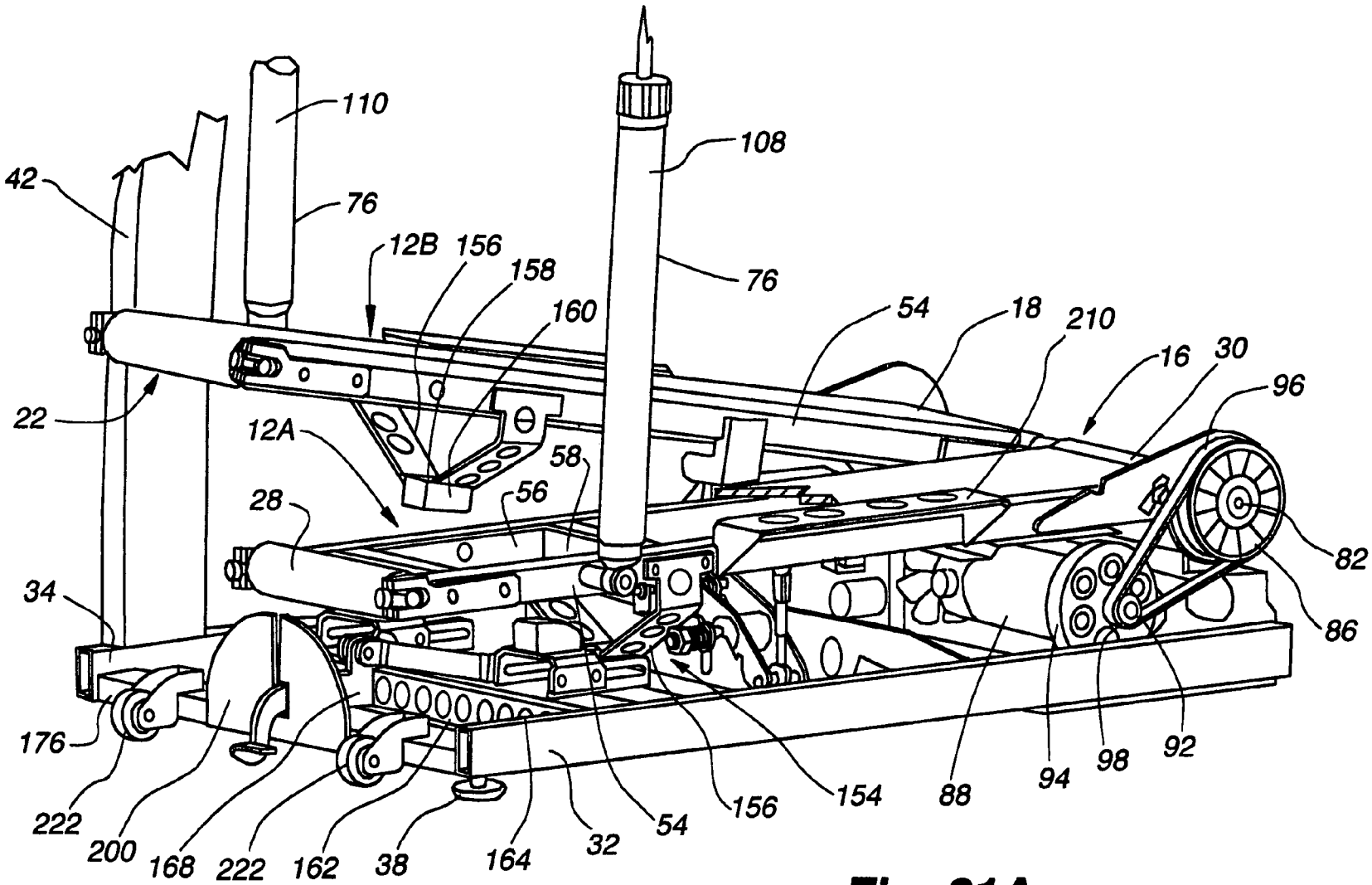
FIG. 21A is an isometric view of the exercise device shown in FIG. 2, the exercise device with the left treadle in about the lowest position and the right treadle in about the highest position.
Figure 21B:
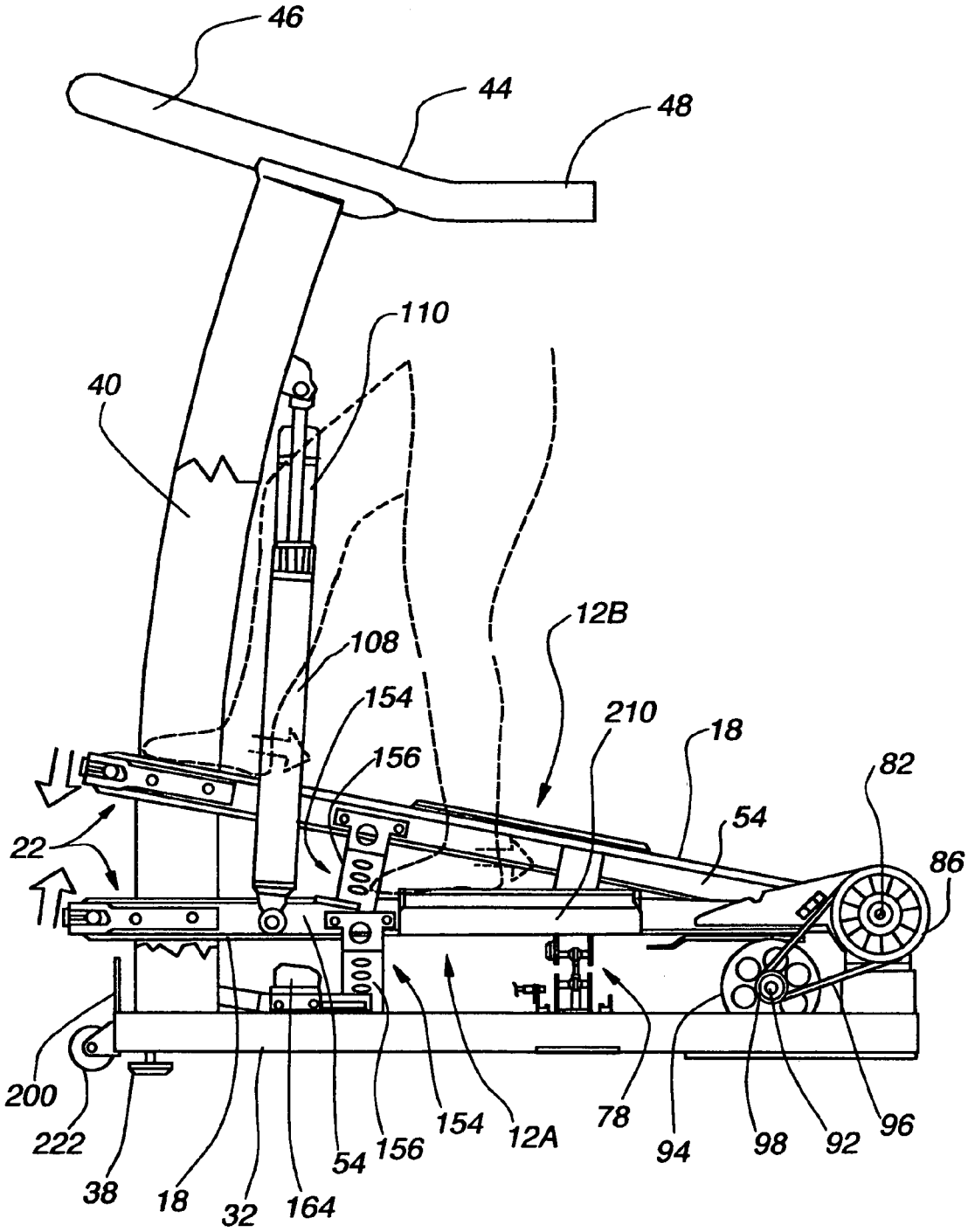
FIG. 21B is a left side view of the exercise device in the orientation shown in FIG. 16A and with a representative user.
Figure 21C:
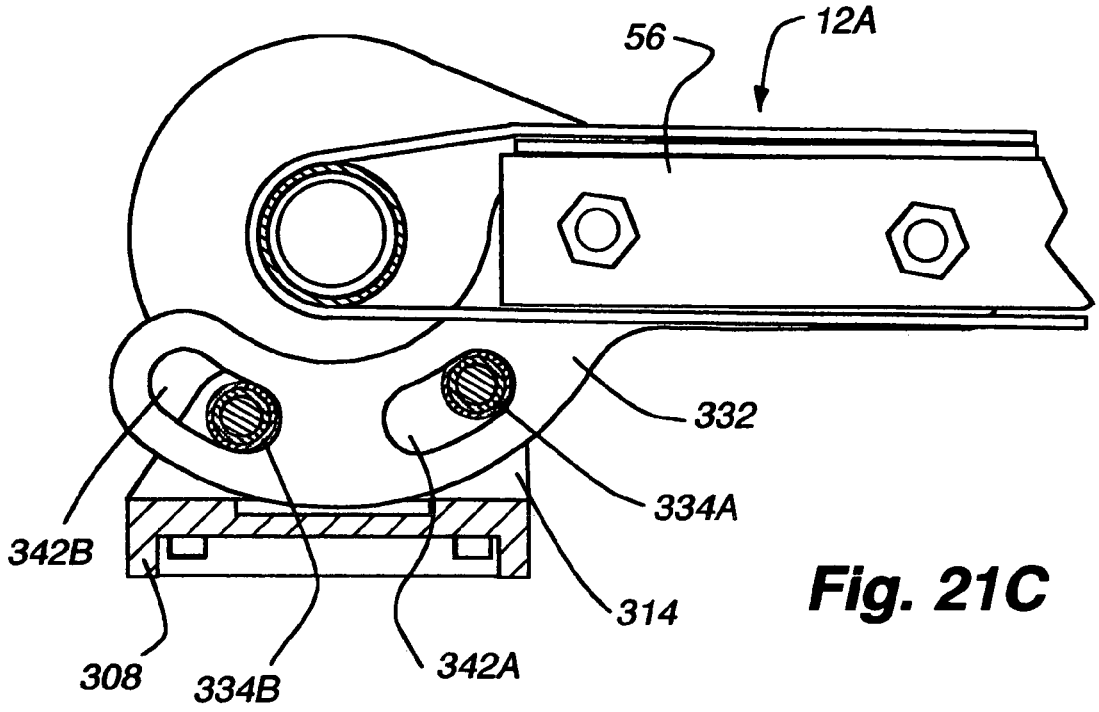
FIG. 21C is a cross sectional view showing the orientation of a left inner bracket corresponding the left treadle position in FIG. 21A, taken along line 21C-21C in FIG. 10A.
Figure 21D:
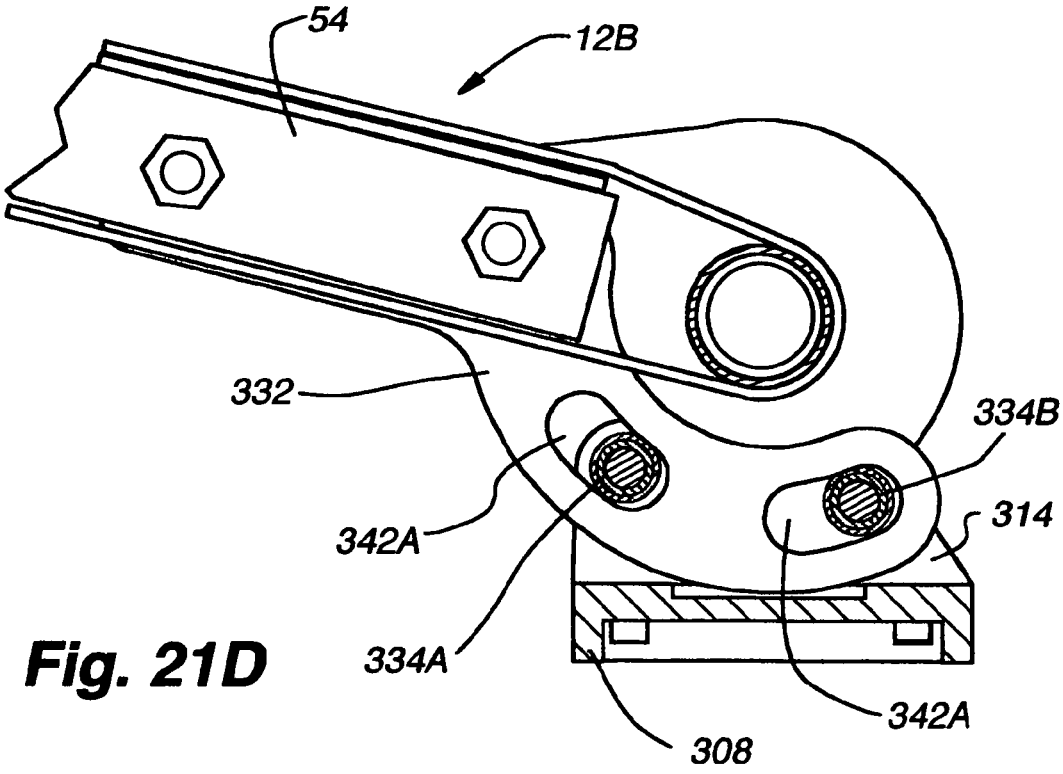
FIG. 21D is a cross sectional view showing the orientation of a right inner bracket corresponding the right treadle position in FIG. 21A, taken along line 21D-21D in FIG. 10A.

In FIGS. 15 and 21A, the left treadle 12A is in a lower position and the right treadle 12B is in an upper position. Referring to FIG. 21C, the studs 334A, 334B on the mounting block 314 are positioned near forward end portions of the slots 342A, 342B in the inner bracket 332 connected with the left treadle. In contrast, as shown in FIG. 21D, the studs 334A, 334B on the mounting block 314 are positioned near rear end portions of the slots 342A, 342B in the inner bracket 332 connected with the right treadle. Referring to FIGS. 15 and 19, the left side of the rocker arm 112 is pivoted downwardly and the right side of the rocker arm is pivoted upwardly. In FIG. 21B, the user is shown with his right foot forward and on the front portion of the right tread belt. In the orientation of the user shown in FIG. 21B, during forward facing climbing-type use, the user's left leg will be extended downwardly and rearwardly with the majority of the user's weight on the left treadle. The user's right leg will be bent at the knee and extended forwardly so that the user's right foot is beginning to press down on the right treadle. From the orientation shown in FIG. 21B, the user will transition his weight to a balance between the right leg and the left leg, and begin to press downwardly with his right leg to force the right treadle downwardly. Due to the movement of the belts, both feet will move rearwardly from the position shown in FIG. 21B.

Figure 22A:
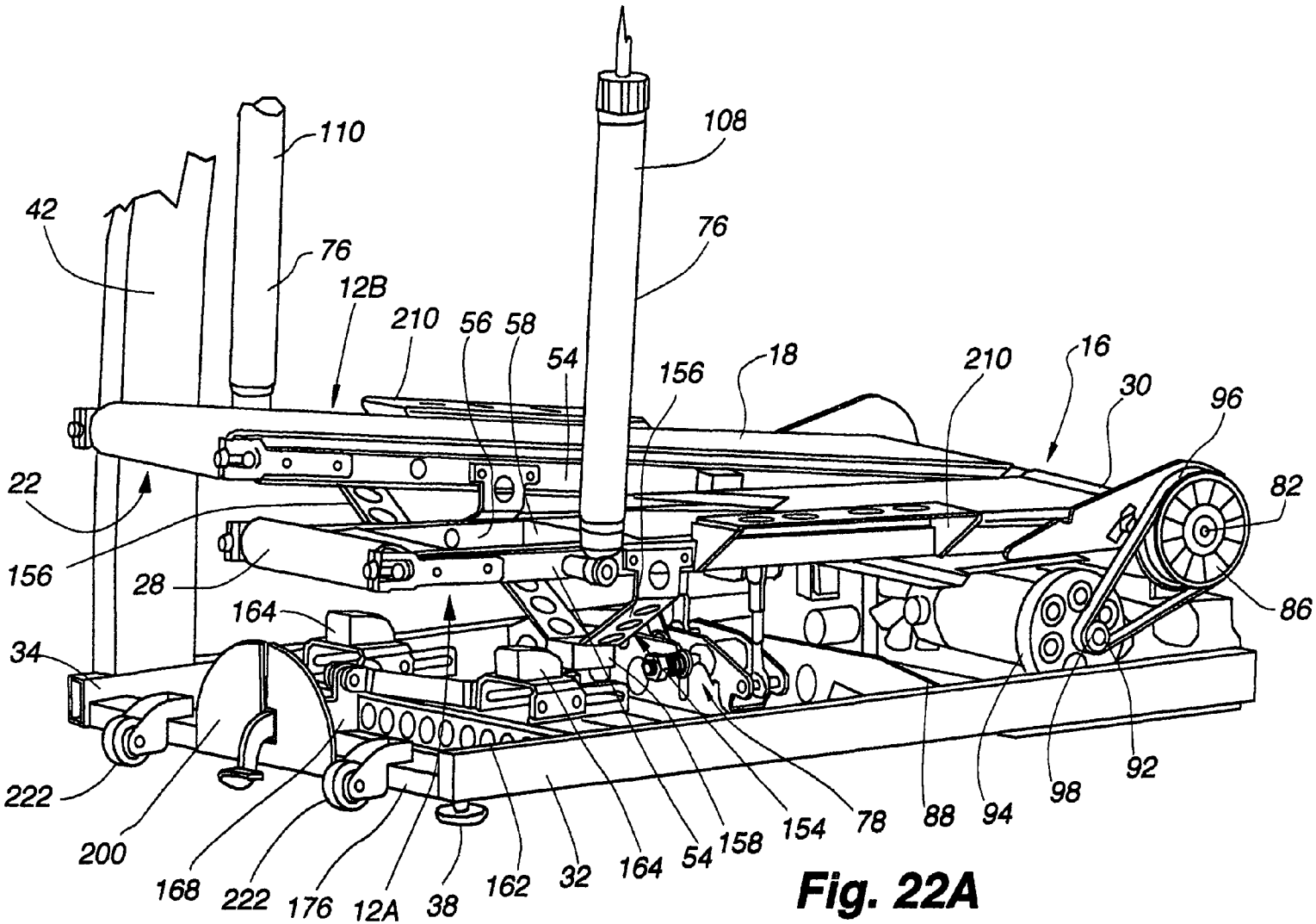
FIG. 22A is an isometric view of the exercise device shown in FIG. 2, the exercise device with the left treadle higher than shown in FIG. 21A, and the right treadle lower than shown in FIG. 21A.
Figure 22B:
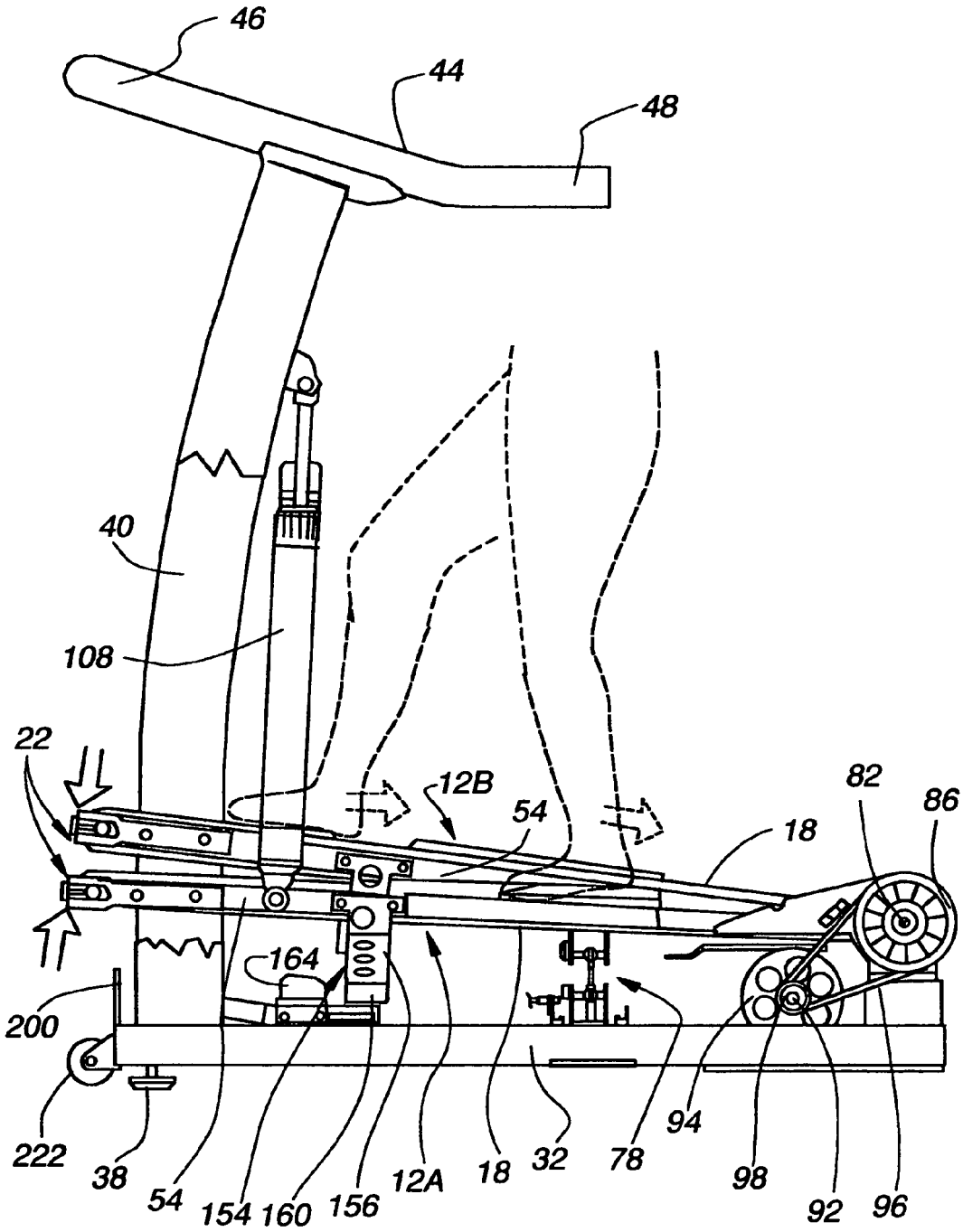
FIG. 22B is a left side view of the exercise device in the orientation shown in FIG. 22A and with a representative user.
Figure 22C:
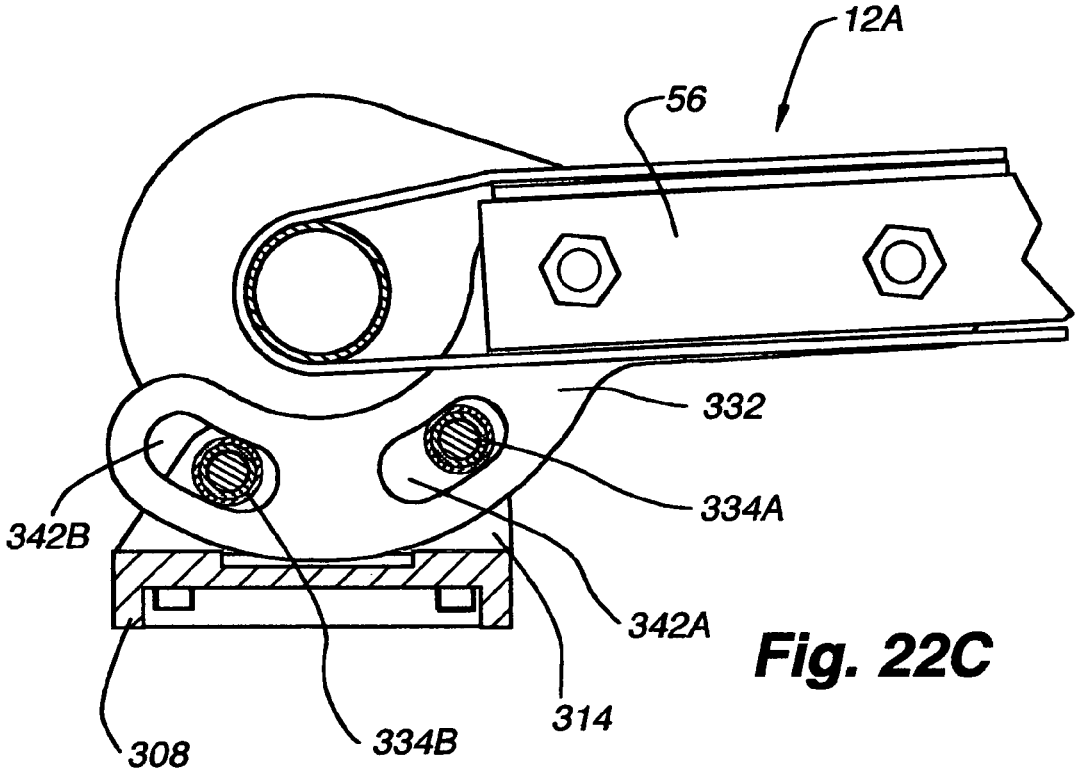
FIG. 22C is a cross sectional view showing the orientation of the left inner bracket corresponding the left treadle position in FIG. 22A, taken along line 22C-22C in FIG. 10A.
Figure 22D:
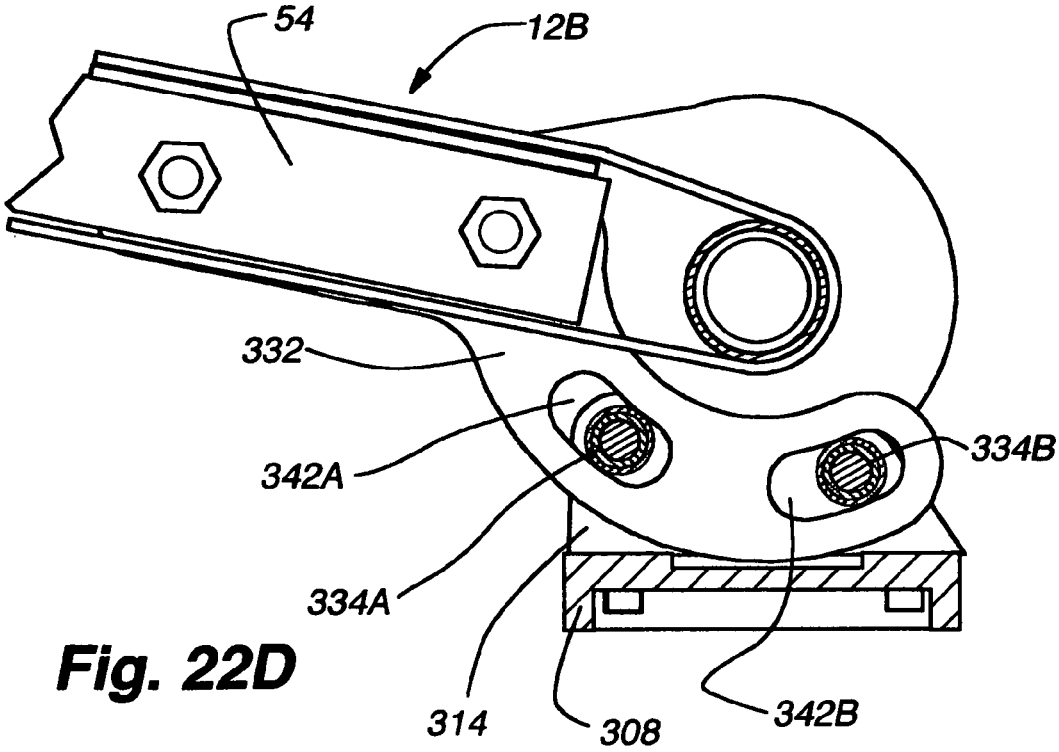
FIG. 22D is a cross sectional view showing the orientation of the right inner bracket corresponding the right treadle position in FIG. 22A, taken along line 22D-22D in FIG. 10A.

FIGS. 16 and 22A show the orientation of the device 10 and FIG. 22B shows the user in a position after that shown in FIGS. 15, 21A, and 21B, respectively. The right treadle 12B is being pressed downwardly, which, via the rocker interconnection structure 78, causes the left treadle 12A to begin to rise. The user's right foot has moved rearwardly and downwardly from the position shown in FIG. 21B. The user's left foot has moved rearwardly and upwardly from the position shown in FIG. 21B. In addition, as shown in FIG. 22C, the inner bracket connected with the left treadle has pivoted to position the studs 334A, 334B rearward of the forward end portions of the slots 342A, 342B. Further, as shown in FIG. 22D, the inner bracket connected with the right treadle has pivoted to position the studs 334A, 334B forward of the rear end portions of the slots 342A, 342B.

Figure 23A:
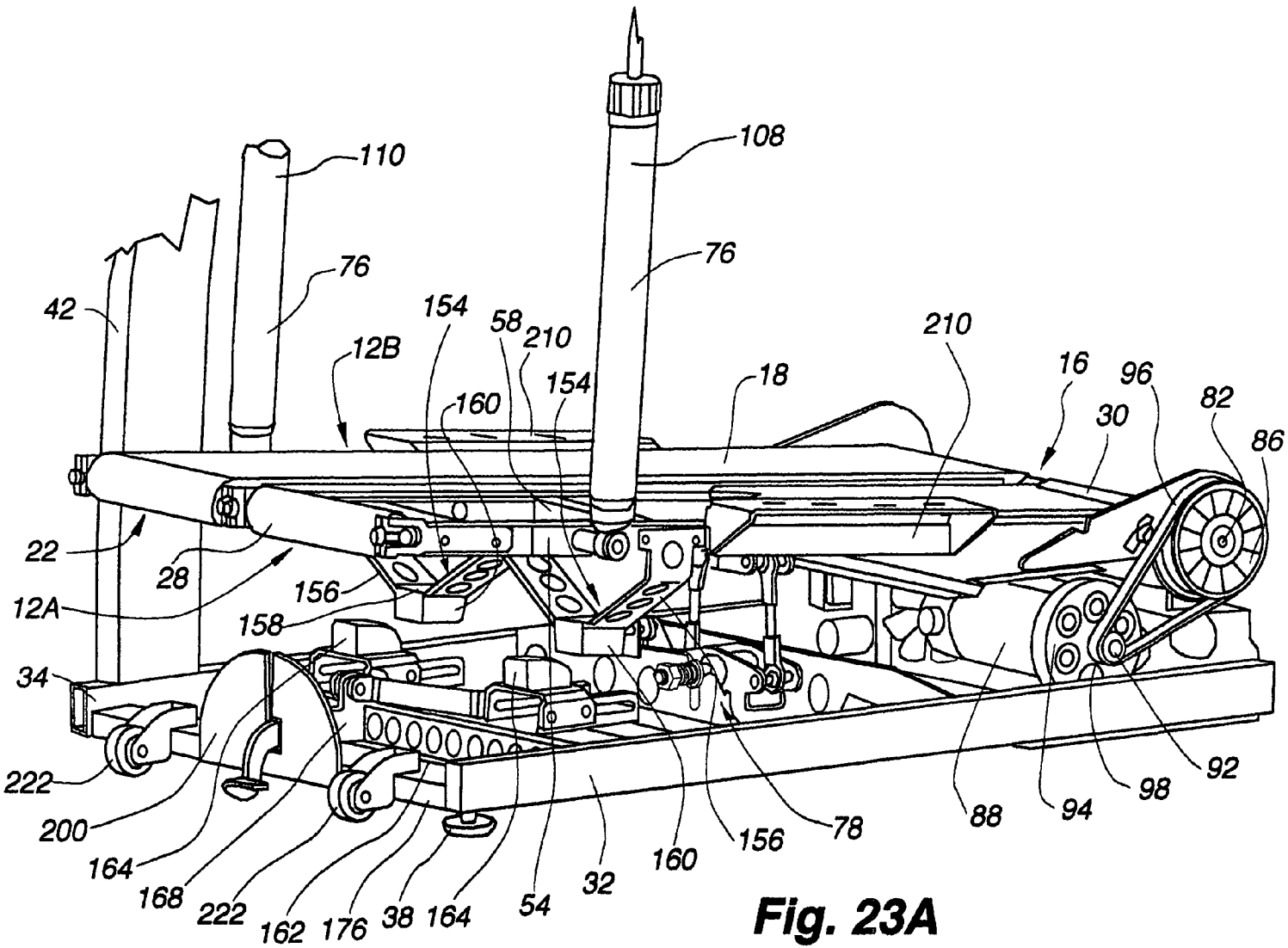
FIG. 23A is an isometric view of the exercise device shown in FIG. 2, the exercise device with the left and right treadle about parallel and collectively at about a 10% grade.
Figure 23B:
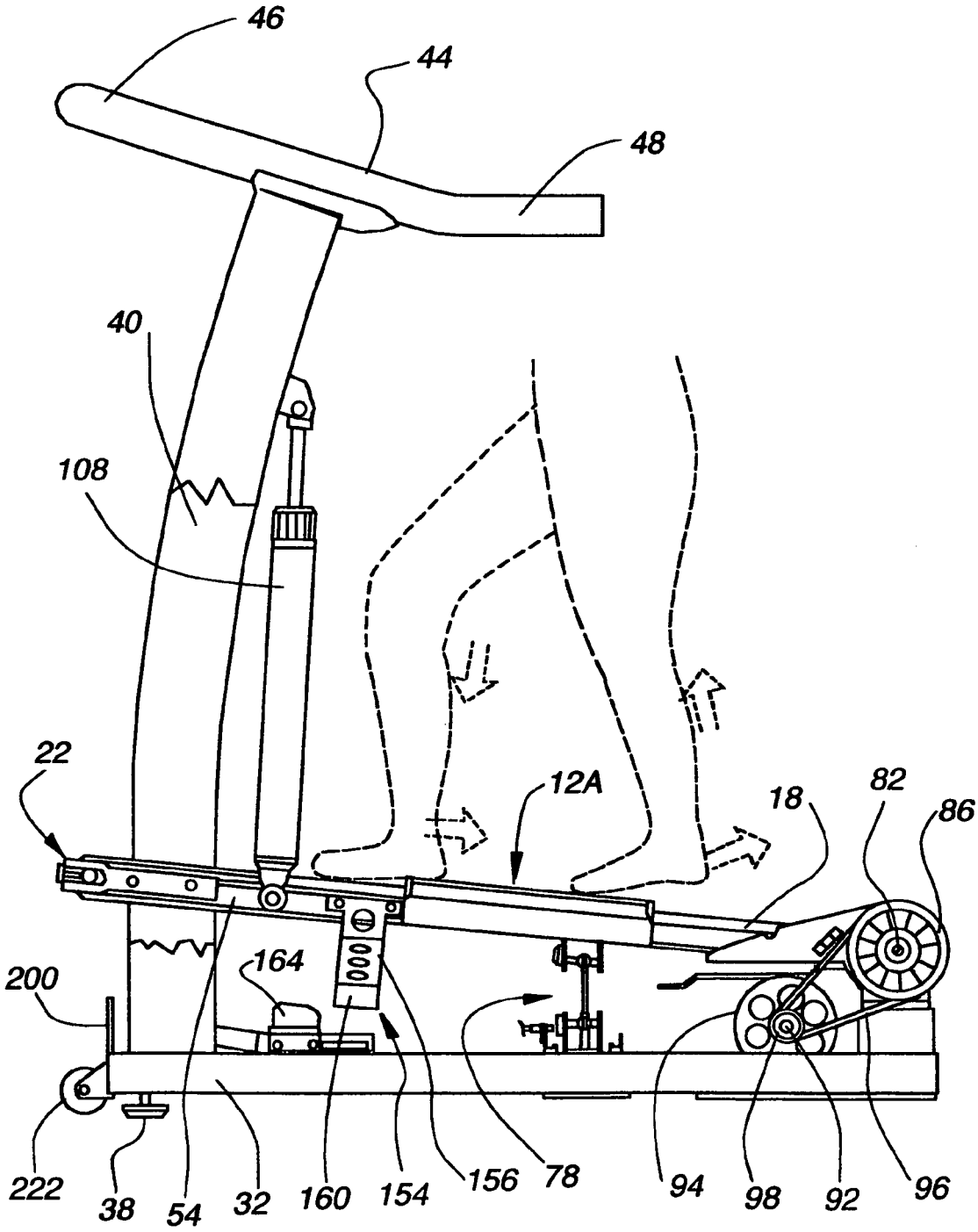
FIG. 23B is a left side view of the exercise device in the orientation shown in FIG. 23A and with a representative user.
Figure 23C:
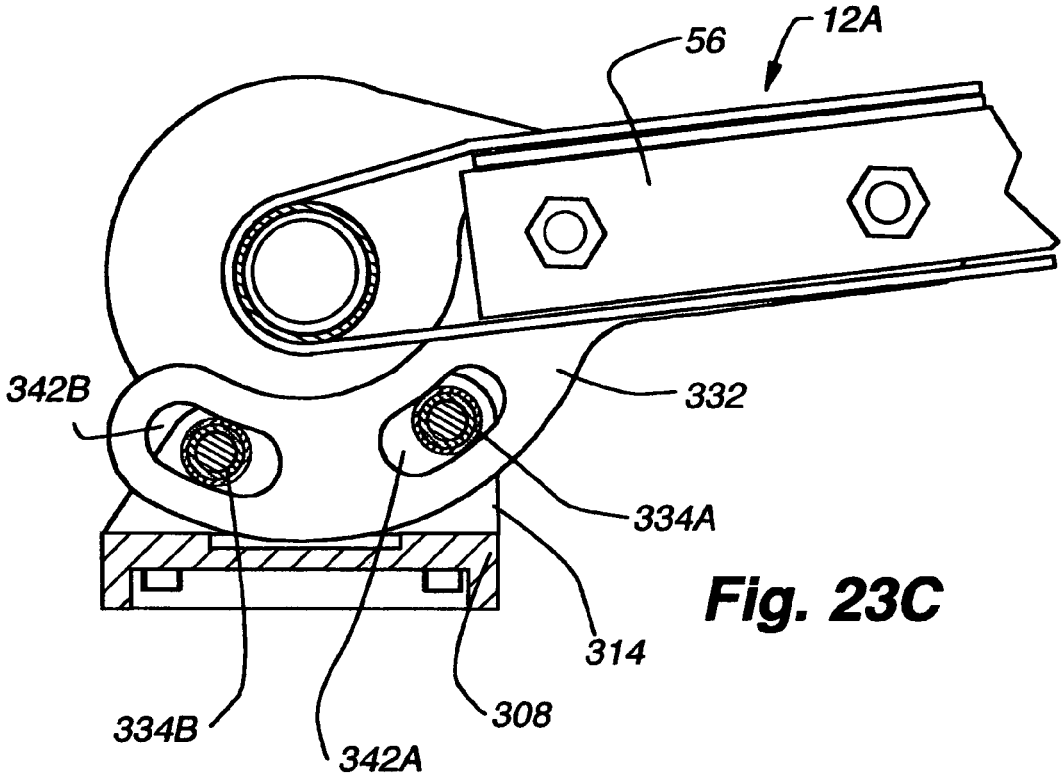
FIG. 23C is a cross sectional view showing the orientation of the left inner bracket corresponding the left treadle position in FIG. 23A, taken along line 23C-23C in FIG. 10A.
Figure 23D:
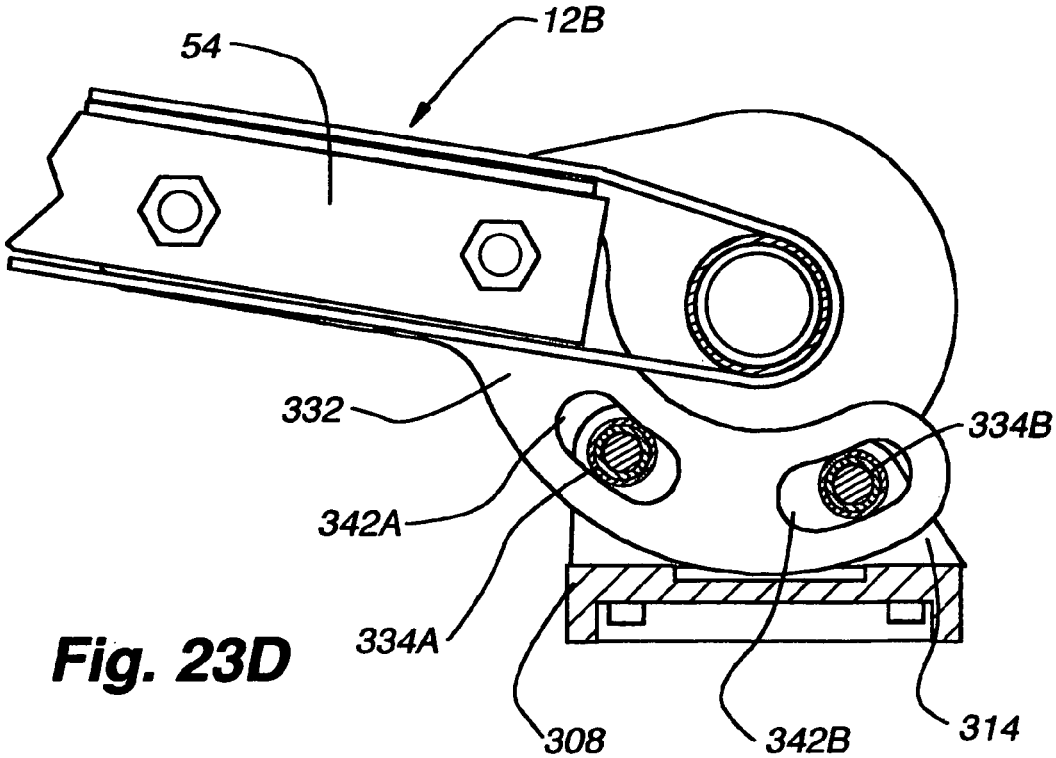
FIG. 23D is a cross sectional view showing the orientation of the right inner bracket corresponding the right treadle position in FIG. 23A, taken along line 23D-23D in FIG. 10A.

FIGS. 17, 23A, and 23B show the right treadle 12B about midway through its upward stroke, and the left treadle 12A about midway through its downward stroke. As such, the treadle assemblies are nearly at the same level above the frame 14 and the endless belts 18 are also at the same level. As shown in FIGS. 23C and 23D, the studs are positioned near mid portions of the length of each slot in the inner brackets connected with the left and right treadles. As shown in FIG. 23B, the user's right foot and leg have moved rearwardly and downwardly from the position shown in FIG. 22B. The user's left foot has moved rearwardly and upwardly from the position shown in FIG. 21B. At this point, the user has begun to lift the left foot from the left tread belt in taking a forward stride; thus, the left heel is lifted and the user has rolled onto the ball of the left foot. Typically, more weight will now be on the right treadle than the left treadle.

Figure 24A:
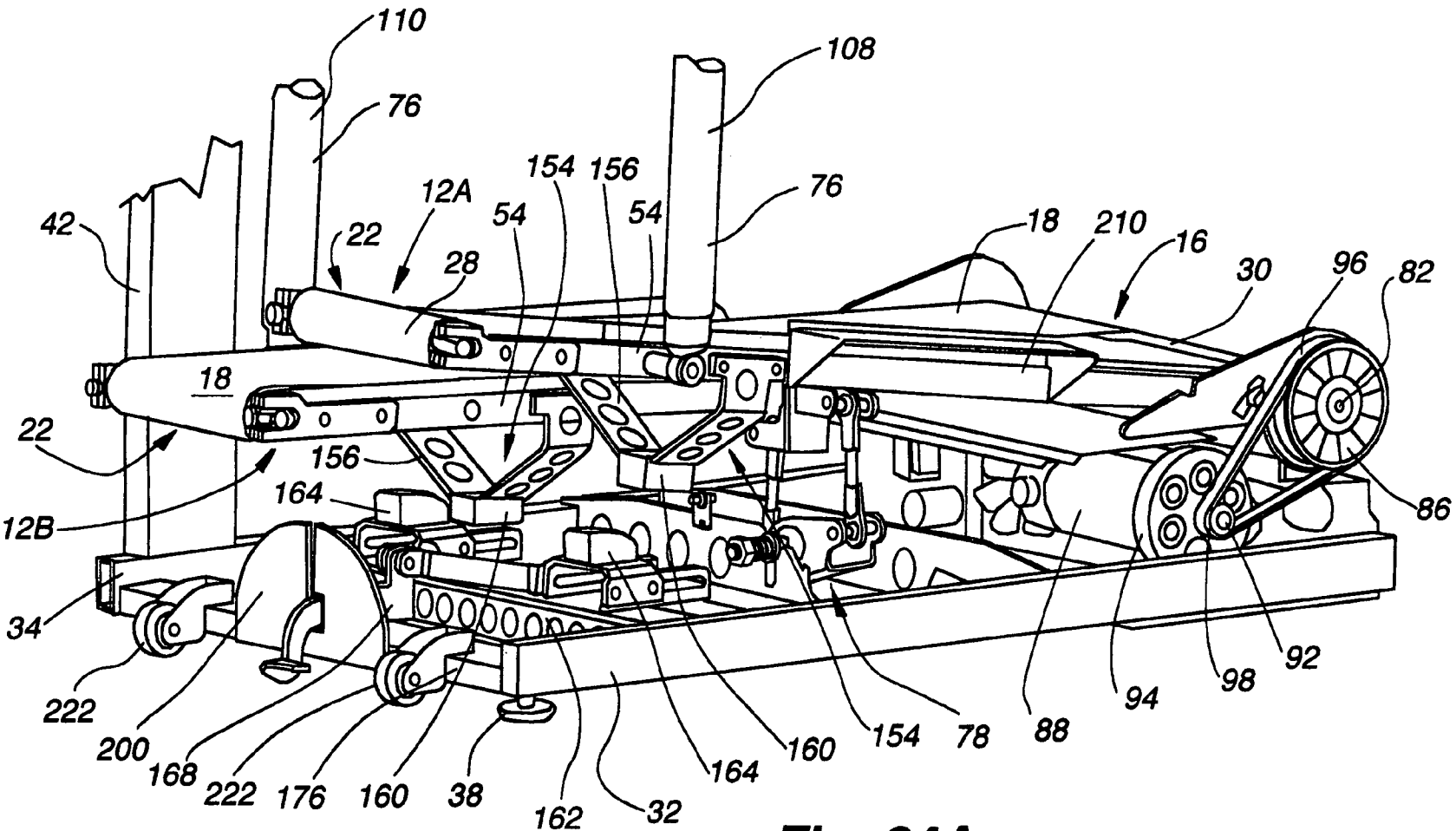
FIG. 24A is an isometric view of the exercise device shown in FIG. 2, the exercise device with the left treadle higher than shown in FIG. 23A, and the right treadle lower than as shown in FIG. 23A.
Figure 24B:
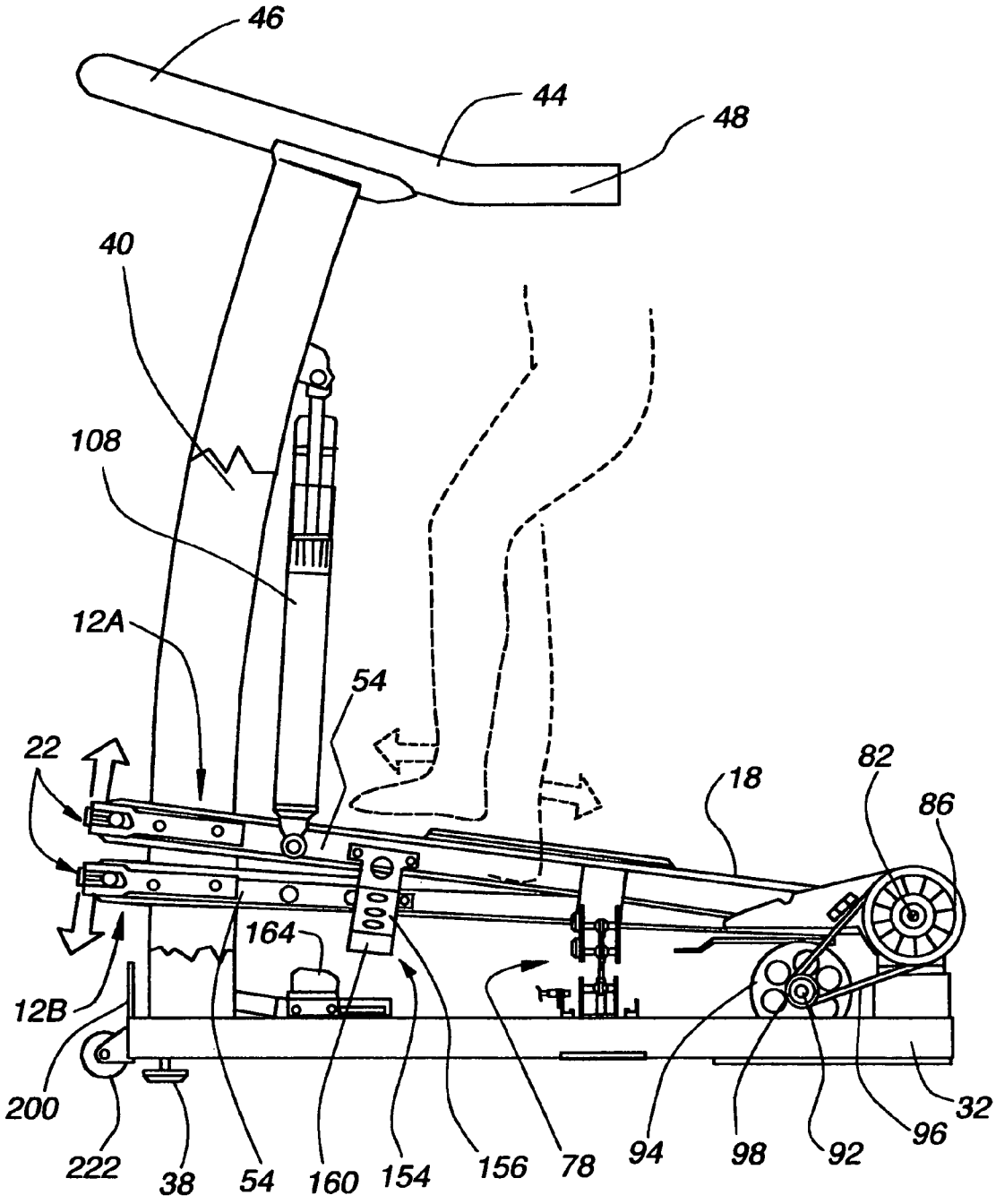
FIG. 24B is a left side view of the exercise device in the orientation shown in FIG. 24A and with a representative user.
Figure 24C:
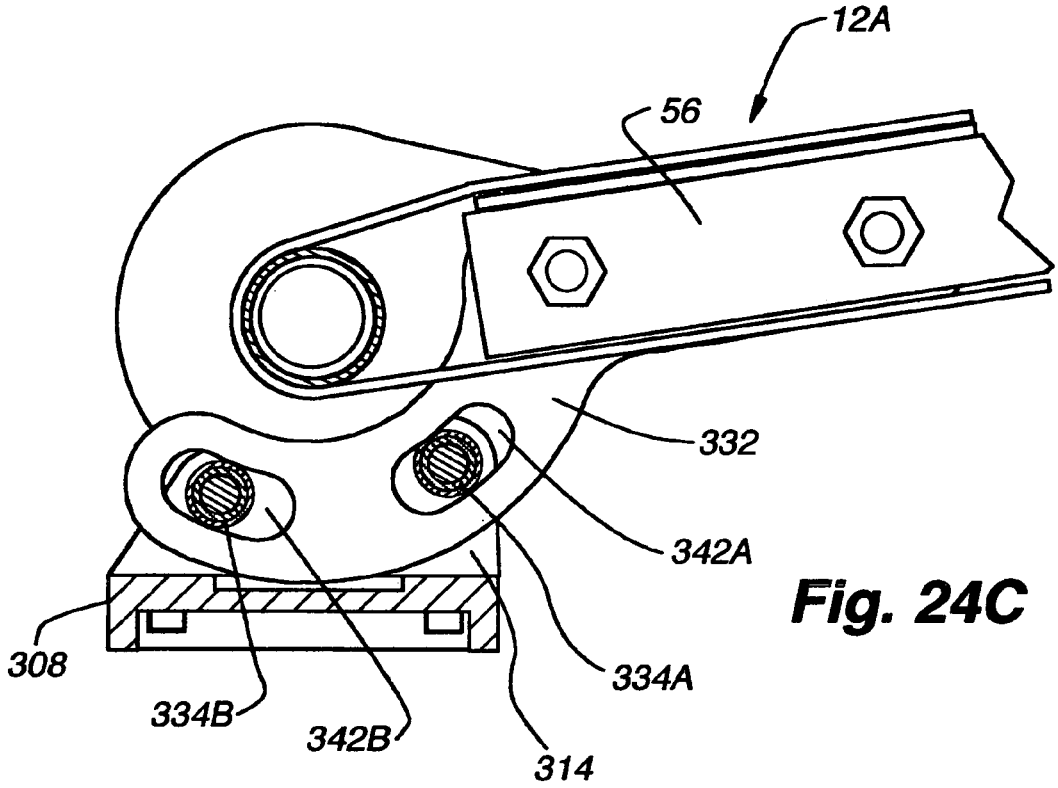
FIG. 24C is a cross sectional view showing the orientation of the left inner bracket corresponding the left treadle position in FIG. 24A, taken along line 24C-24C in FIG. 10A.
Figure 24D:
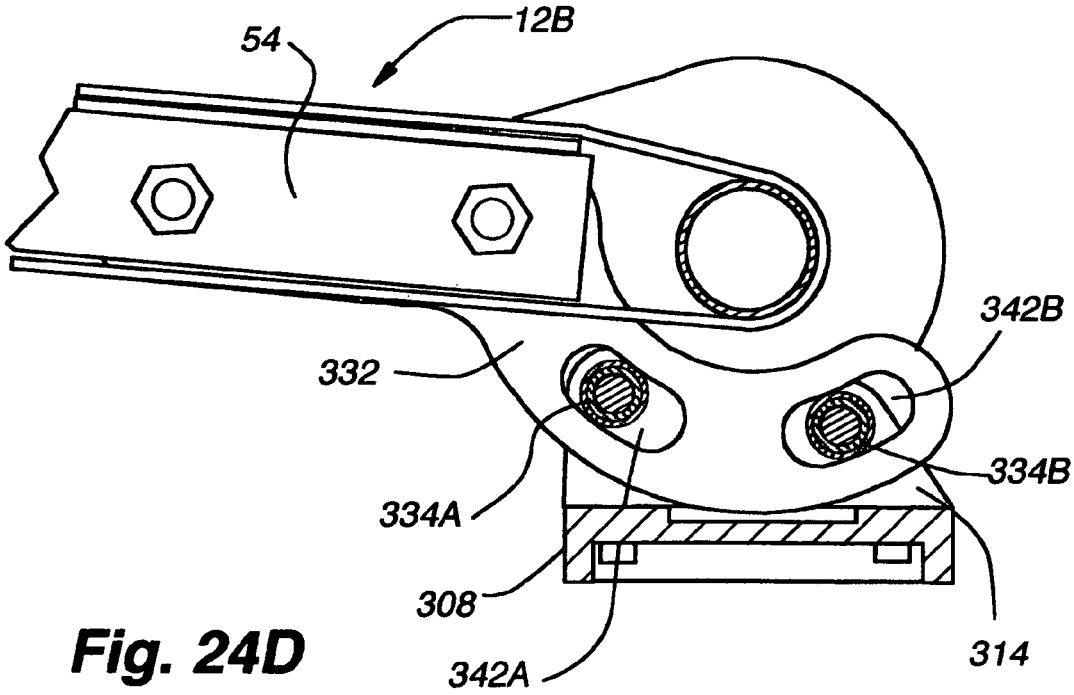
FIG. 24D is a cross sectional view showing the orientation of the right inner bracket corresponding the right treadle position in FIG. 24A, taken along line 24D-24D in FIG. 10A.

After the orientation shown in FIGS. 17, 23A, and 23B, the right treadle 12B continues its downward movement and the left treadle 12A continues its upward movement to the orientation of the device as shown in FIGS. 18, 24A, and 24B. In FIGS. 18, 24A, and 24B, the left treadle is higher than the right treadle, and the rocker arm 112 is pivoted about the rocker pivot axis 120 such that its right side is lower than its left side. In addition, as shown in FIG. 24C, the inner bracket connected with the left treadle has pivoted to position the studs 334A, 334B rearward of the mid portions of the slots 342A, 342B. Further, as shown in FIG. 24D, the inner bracket connected with the right treadle has pivoted to position the studs 334A, 334B forward of the mid portions of the slots 342A, 342B. In this position, the user's right leg continues to move rearward and downward. The user has lifted the right leg off the left treadle and is moving it forward. At about the upper position of the left treadle, the user will step down with his left foot on the front portion of the treadle belt. All of the user's weight is on the right treadle until the user places his left foot on the left treadle. The user continues to provide a downward force on the right treadle forcing the left treadle up.

Figure 25A:
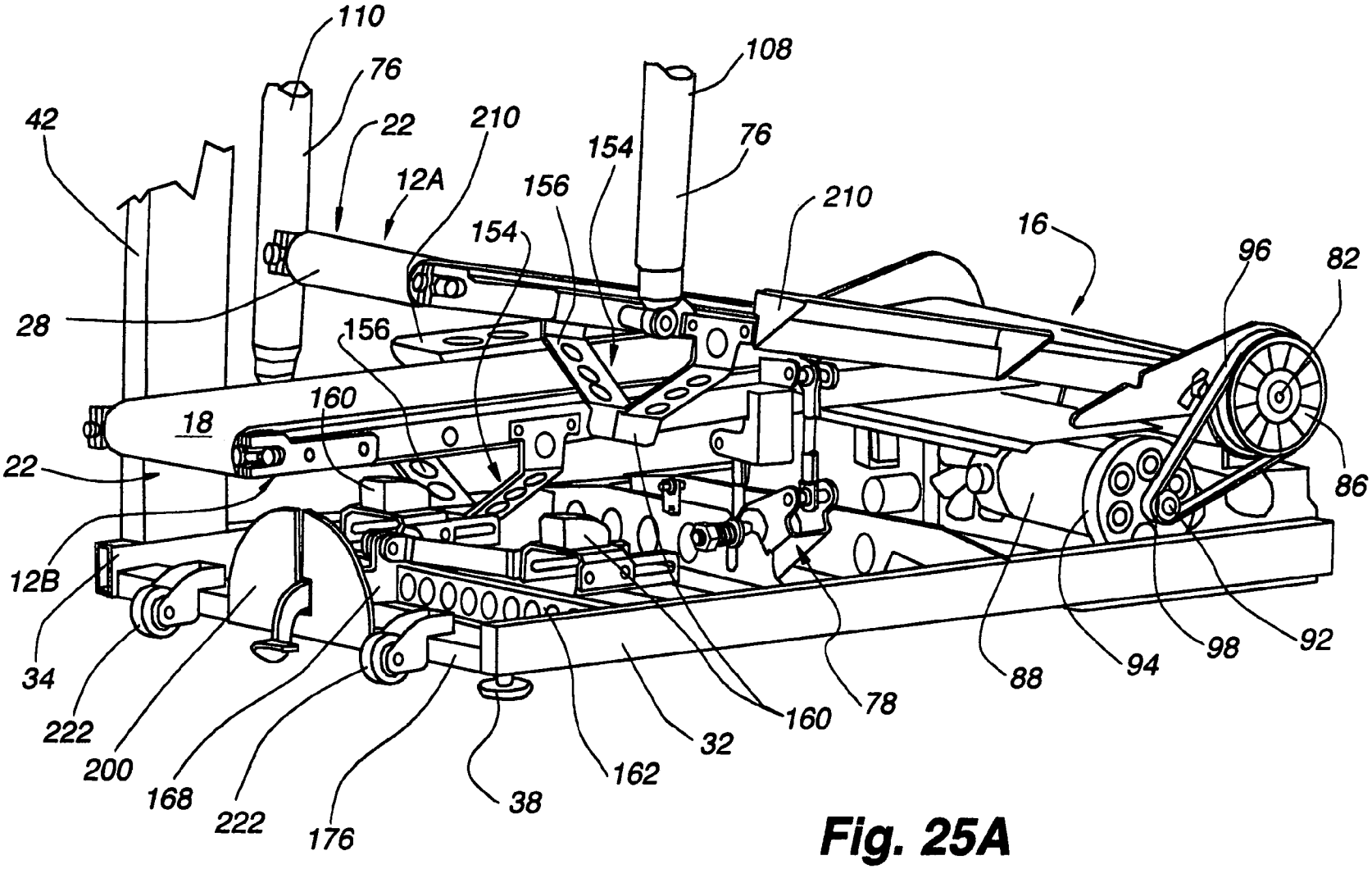
FIG. 25A is an isometric view of the exercise device shown in FIG. 2, the exercise device with the left treadle in about its highest position and the right treadle in about its lowest position.
Figure 25B:
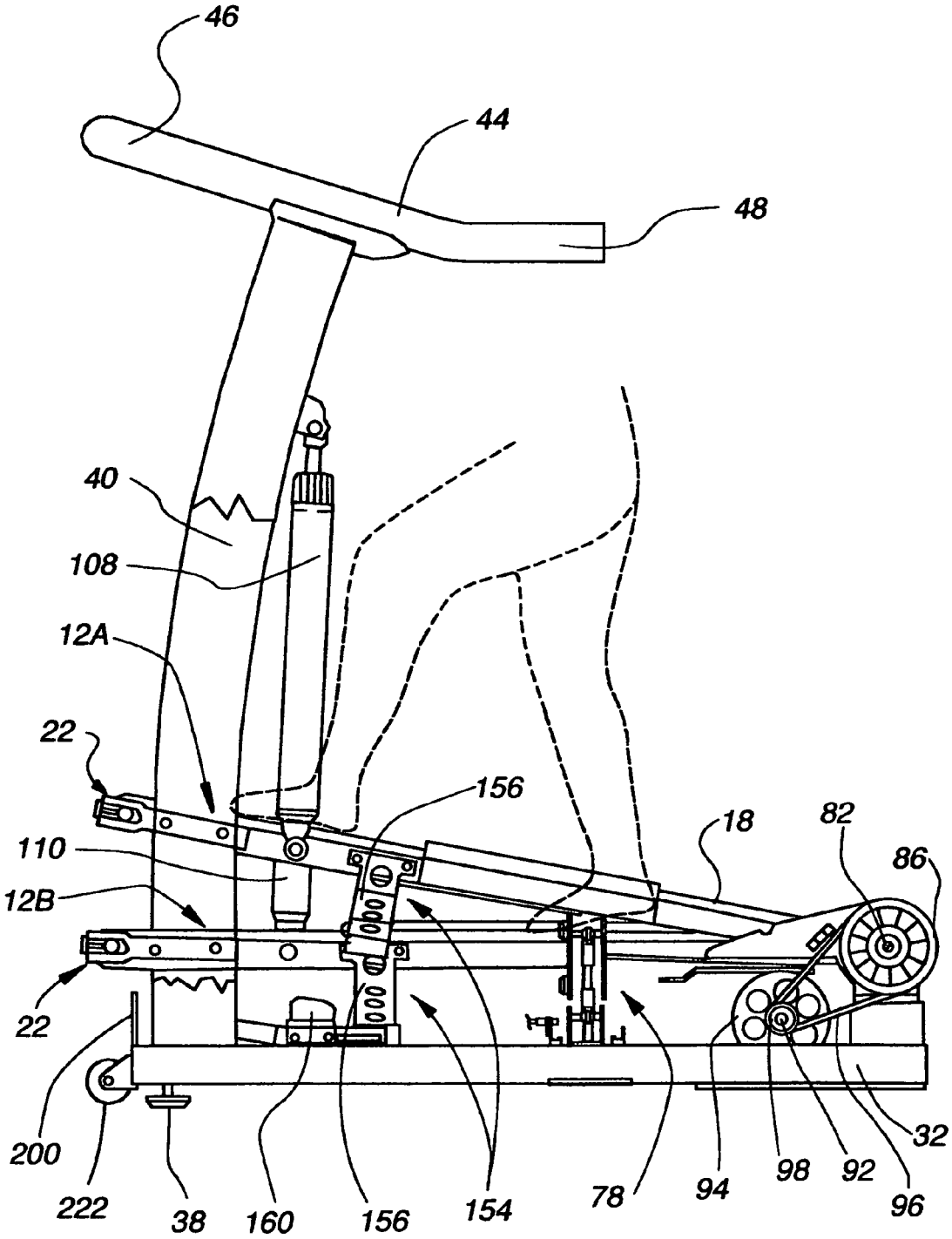
FIG. 25B is a left side view of the exercise device in the orientation shown in FIG. 25A and with a representative user.
Figure 25C:
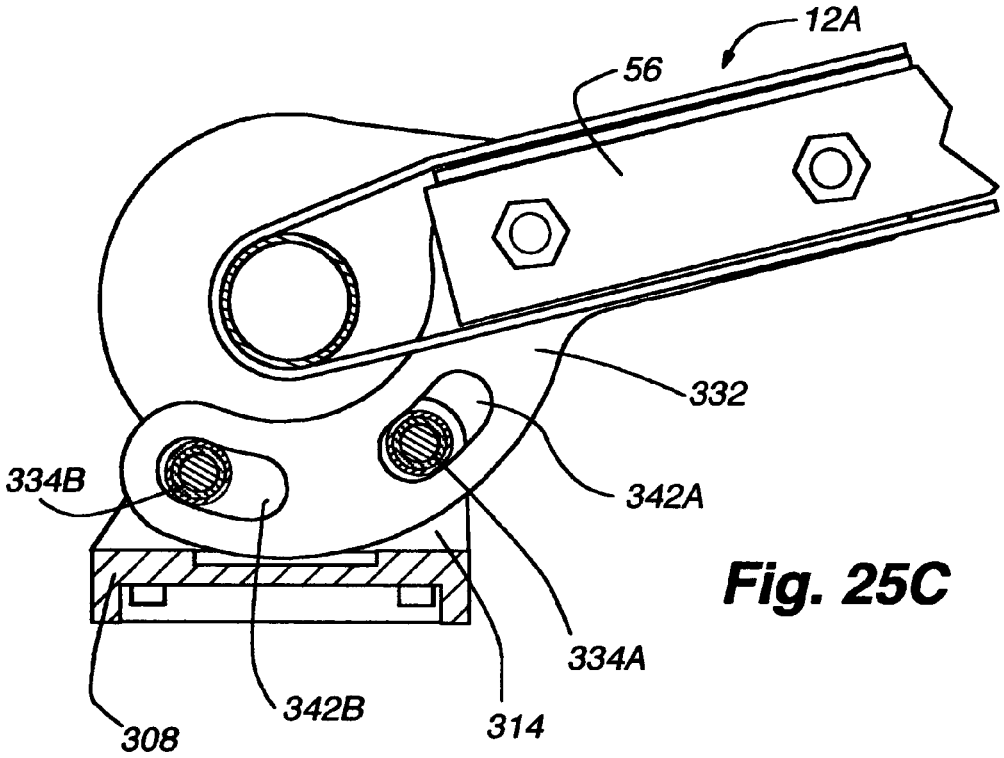
FIG. 25C is a cross sectional view showing the orientation of the left inner bracket corresponding the left treadle position in FIG. 25A, taken along line 25C-25C in FIG. 10A.
Figure 25D:
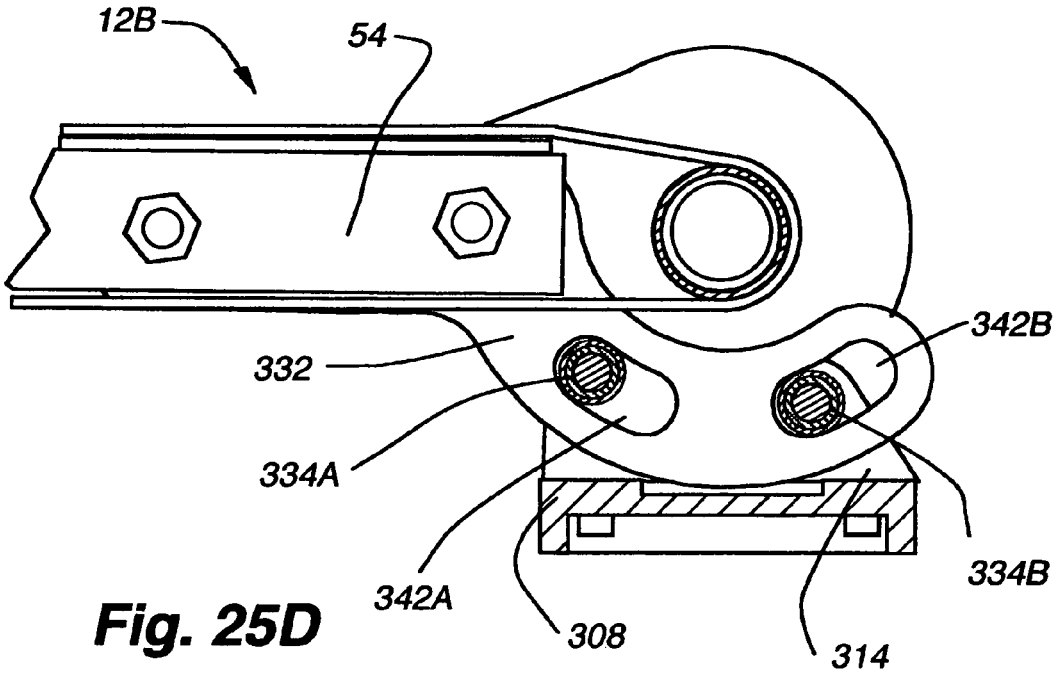
FIG. 25D is a cross sectional view showing the orientation of the right inner bracket corresponding the right treadle position in FIG. 25A, taken along line 25D-25D in FIG. 10A.

FIGS. 19, 25A, and 25B illustrate the right treadle 12B in about its lowest position, and show the left treadle 12A in about its highest position. Referring to FIG. 25C, the studs 334A, 334B on the mounting block 314 are positioned near rear end portions of the slots 342A, 342B in the inner bracket 332 connected with the left treadle. In contrast, as shown in FIG. 25D, the studs 334A, 334B on the mounting block 314 are positioned near forward end portions of the slots 342A, 342B in the inner bracket 332 connected with the right treadle. At this point, the user has stepped down on the front 22 of the left treadle and has begun pressing downward with the left leg. The user is also beginning to lift the right leg. The downward force on the left treadle will be transferred through the interconnection structure 78 to the right treadle to cause the right treadle to begin to rise.

FIGS. 21(A,B)-25(A,B) represent half a cycle of the reciprocating motion of the treadles, i.e., the movement of the left treadle from a lower position to an upper position and the movement of the right treadle from an upper position to a lower position. A complete climbing-type exercise cycle is represented by the movement of one treadle from some position and back to the same position in a manner that includes a full upward stroke of the treadle (from the lower position to the upper position) and a full downward stroke of the treadle (from the upper position to the lower position). For example, a step cycle referenced from the lower position of the left treadle (the upper position of the right treadle) will include the movement of the left treadle upward from the lower position to the upper position and then downward back to its lower position. In another example, a step cycle referenced from the mid-point position of the left treadle (see FIG. 23) will include the upward movement of the treadle to the upper position, the downward movement from the upper position, past the mid-point position and to the lower position, and the upward movement back to the mid-point position. The order of upward and downward treadle movements does not matter. Thus, the upward movement may be followed by the downward movement or the downward movement may be followed by the upward movement.

Referring to FIG. 15 and others, in one particular configuration, the exercise device includes a step sensor 144, which provides an output pulse corresponding with each downward stroke of each treadle. The step sensor is implemented with a second reed switch 146 including a magnet 148 and a pick-up 150. The magnet is connected to the end of a bracket 152 that extends upwardly from the rocker arm 112. The bracket orients the magnet so that it swings back and forth past the pick-up, which is mounted on a bracket 157 connected with the rocker cross member 114. The reed switch 146 triggers an output pulse each time the magnet 148 passes the pick-up 150. Thus, the reed switch transmits an output pulse when the right treadle 12B is moving downward, which corresponds with the magnet passing downwardly past the pick-up, and the reed switch also transmits an output pulse when the left treadle 12A is moving upward, which corresponds with the movement to the magnet upwardly past the pick-up. The output pulses are used to monitor the oscillation and stroke count of the treadles as they move up and down during use. With additional sensors arranged generally vertically, it is also possible to determine the depth or vertical stroke dimension. The output pulses, alone or in combination with the belt speed signal, may be used to provide an exercise frequency display and may be used in various exercise related calculations, such as in determining the user's calorie burn rate.

As best shown in FIGS. 3, 6, and 21A-25, in one particular implementation, each treadle includes a bottom-out assembly 154. The bottom-out assembly includes a generally V-shaped bracket 156 interconnected between the inside and outside members of the treadle frame. The vertex region of the V-shaped bracket is oriented downwardly and generally defines a flat mounting surface 158. A block 160 is fixed to the lower downwardly facing portion of the mounting surface. When the exercise device is assembled it is preferable to arrange the treadles by way of the turnbuckles (134, 136) so that the block 160 is maintained slightly above the underlying lock-out cross member 162 when the treadle is in its lowest position. A bumper 164 may be fixed to the cross member 162 to cushion the treadle should it bottom out. In one example, the block is fabricated with a hard, non-flexible, plastic. The block may also be fabricated with a solid or flexible resilient polymer material. In a flexible resilient form, the block will provide some cushioning to enhance the cushioning provided by the bumper, or provide cushions when a bumper is not used, should the block bottom-out on the lock-out cross member during use.

As mentioned above, the exercise device 10 may be configured in a "lock-out" position where the treadle assemblies do not pivot upward and downward. In one particular lock-out orientation, the treadle assemblies are pivotally fixed so that the tread belts are parallel and at about a 10% grade with respect to the rear of the exercise device. Thus, in a forward facing use, the user may simulate striding uphill, and in a rearward facing use the user may simulate striding downhill.

Figure 26A:
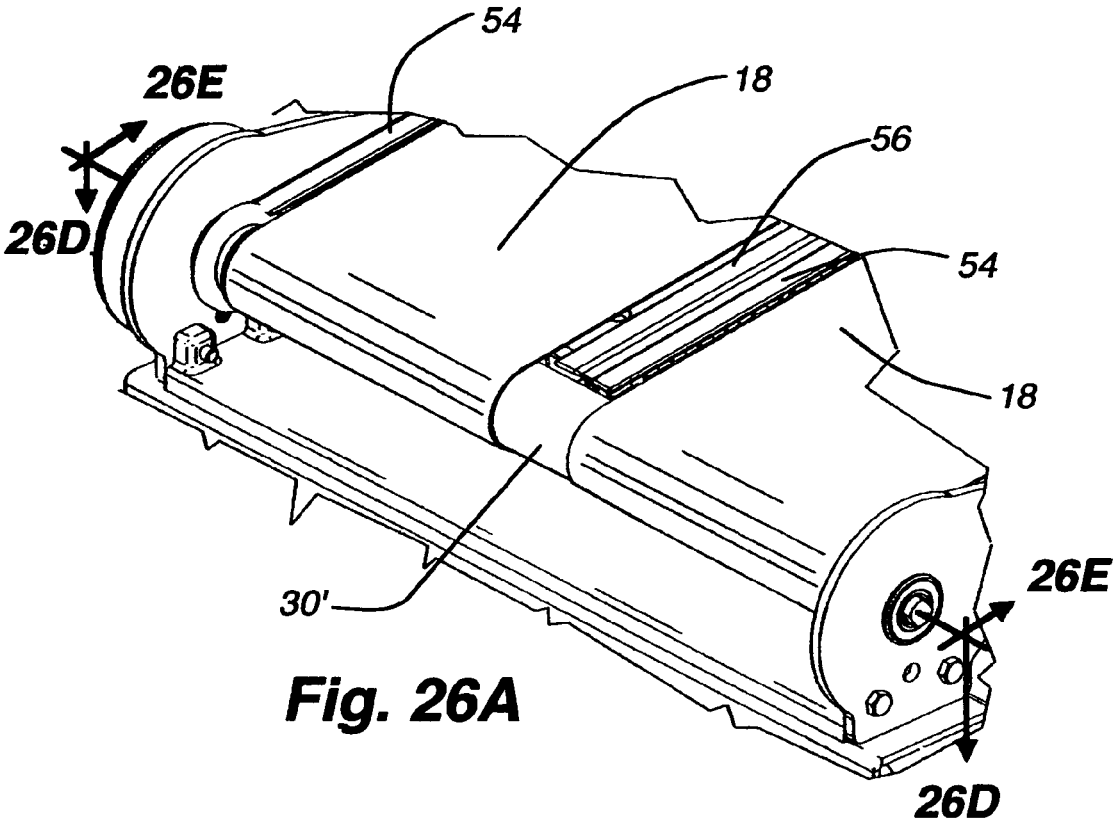
FIG. 26A is detailed isometric view of a second embodiment of rear roller.
Figure 26B:
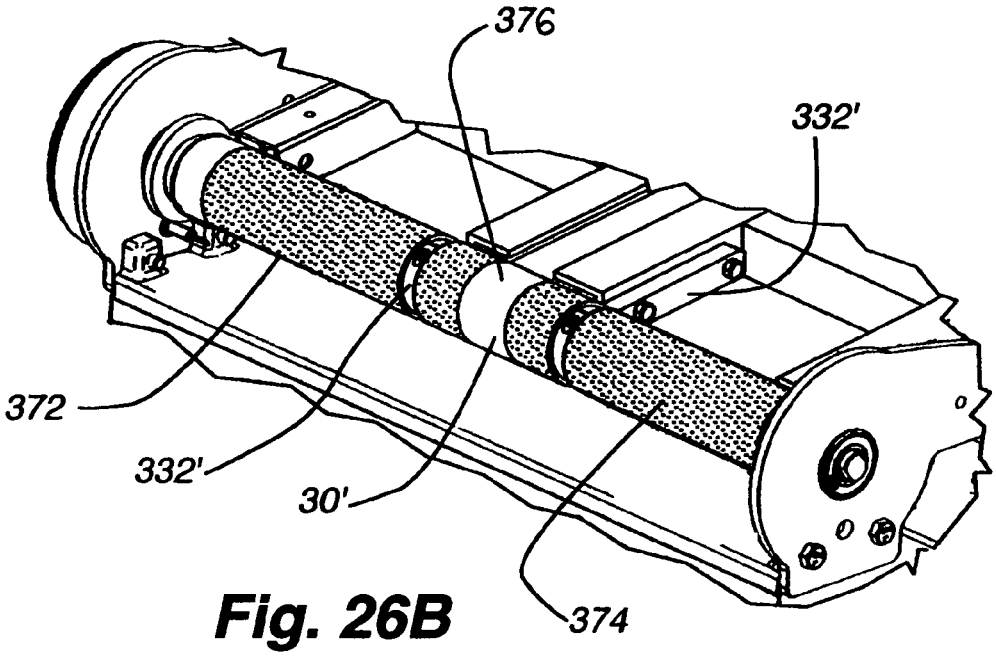
FIG. 26B is a detailed view of the rear roller shown in FIG. 26A with treadle belts removed.
Figure 26C:
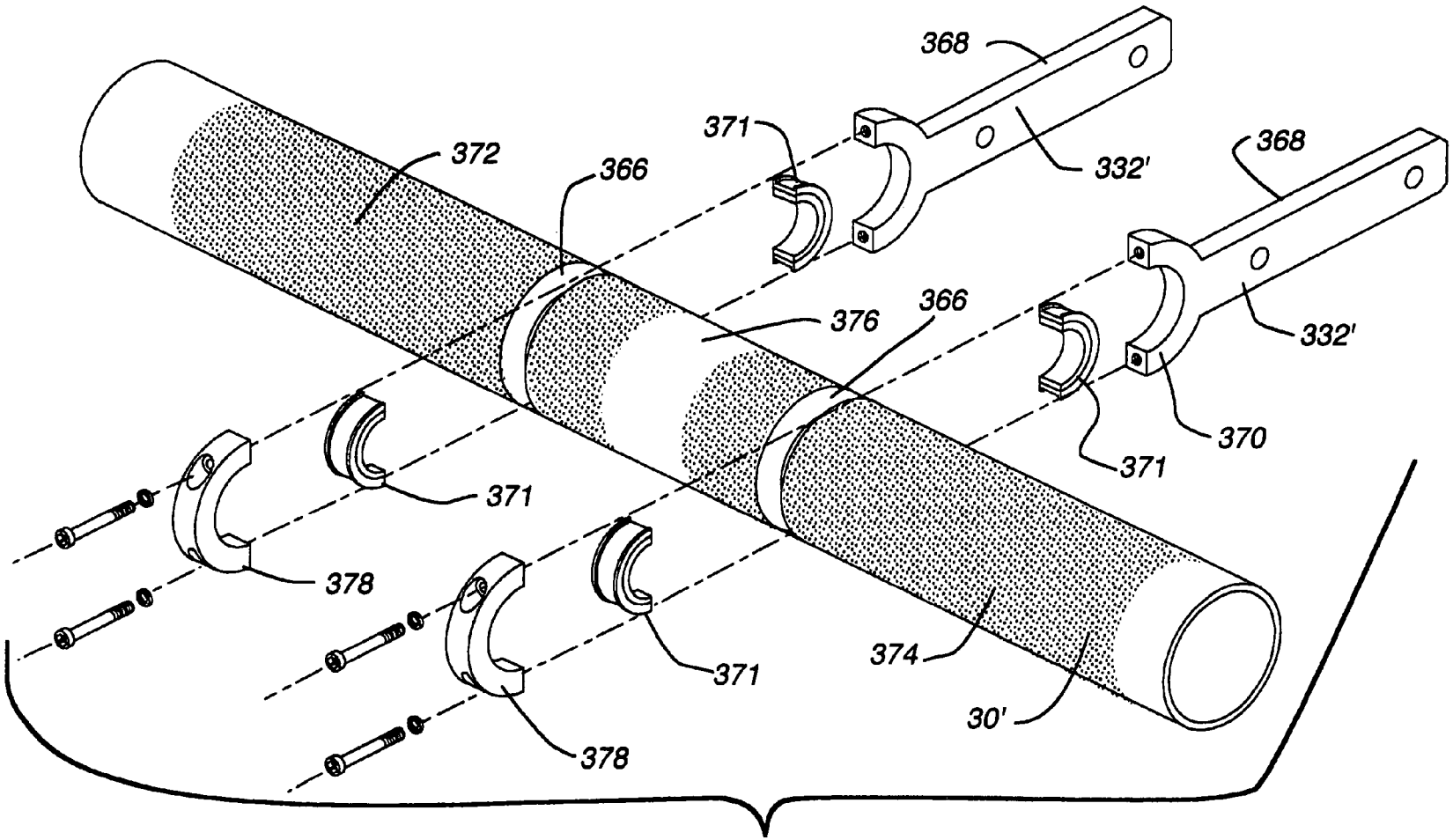
FIG. 26C is an exploded view of the rear roller shown in FIG. 26B.
Figure 26D:
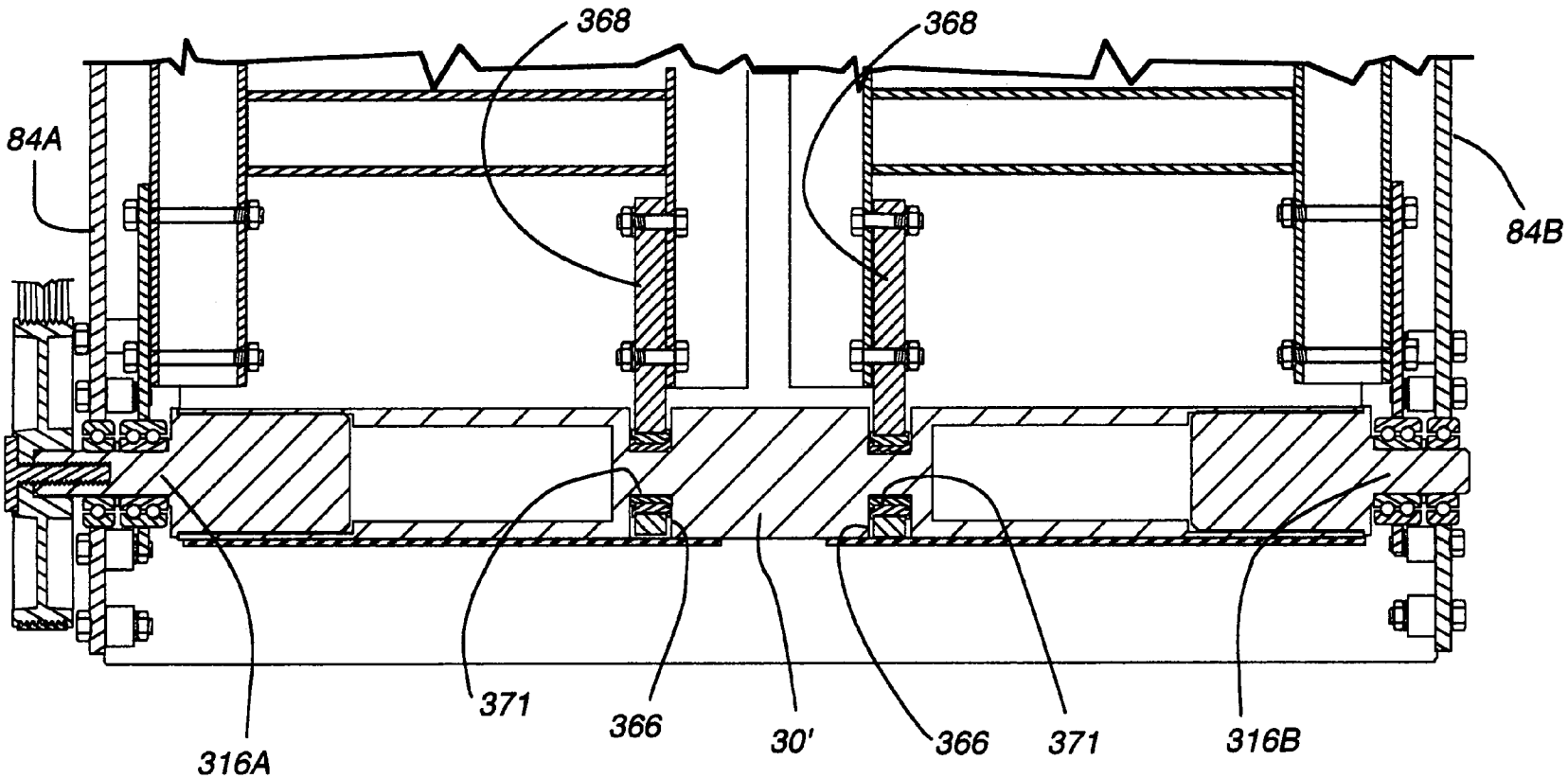
FIG. 26D is a cross-sectional view of the rear roller depicted in FIG. 26A, taken along line 26D-26D.
Figure 26E:
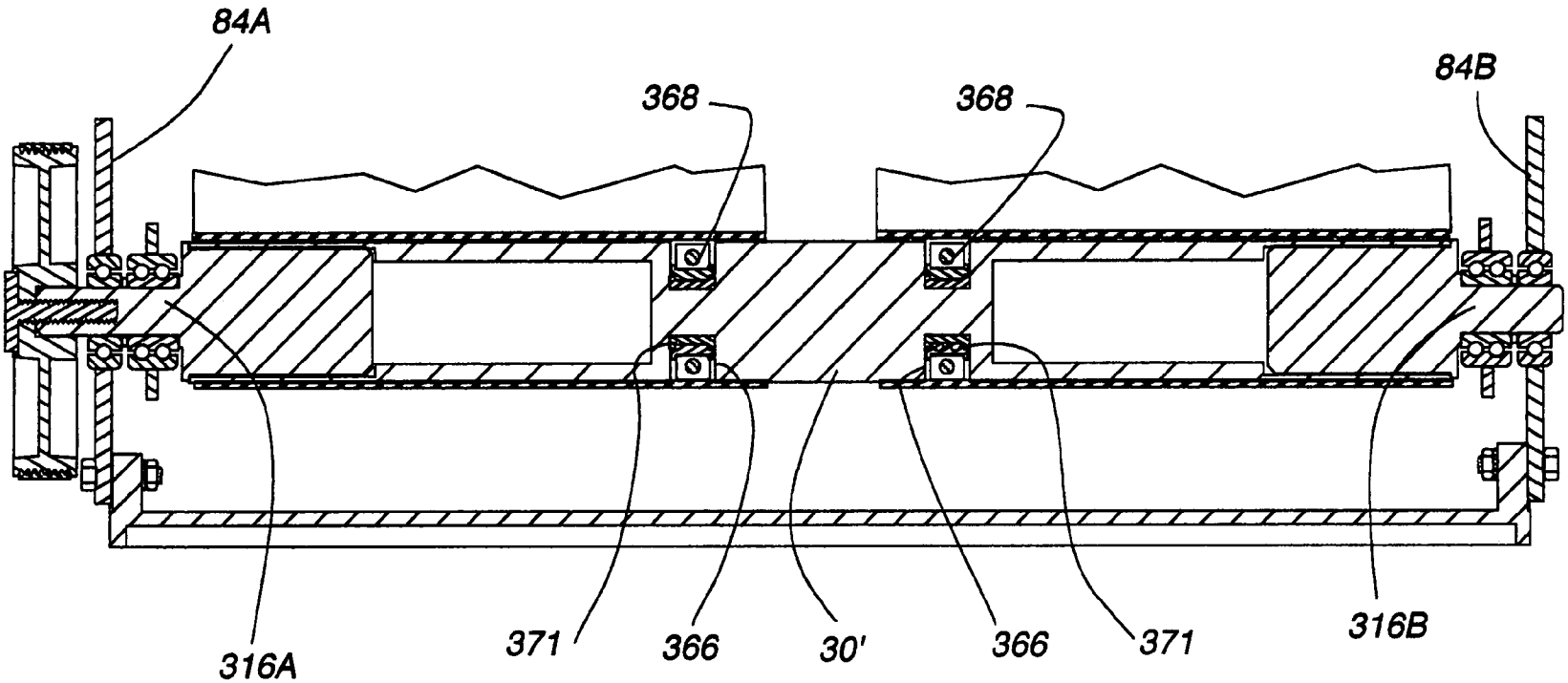
FIG. 26E is a cross-sectional view of the rear roller depicted in FIG. 26A, taken along line 26E-26E.

A second embodiment of the exercise device having a single rear roller 30' is shown in FIGS. 26A-26E. As shown in FIGS. 26B and 26C, the inner longitudinal members 54, 56 of the treadle frames 52 are pivotally supported by inner brackets 332' extending therefrom. Instead of being supported by a virtual pivot structure, as described above with reference to the first embodiment, the inner brackets are rotatably coupled with the rear roller 30'. As shown in FIG. 26C-26E, annular channels 366 are formed in the rear roller and are surrounded by each inner bracket. More particularly, each inner bracket includes an extended portion 368 connected with a rear bearing end 370 which are coupled with the rear roller about the annular channels through bearings 371. As such, the inner brackets pivot about the rotational axis of the rear roller. Each rear bearing end has a profile that does not extend beyond the outer diameter of the rear roller except where the rear bearing end connects with the extended portion of the inner bracket. The profile structures of the rear bearing ends allow the belt to pass over the annular channels without contacting the bearing ends.

As shown in FIGS. 26B-26E show the single rear roller according the second embodiment, which includes three sections. A first section 372 is defined by a portion of the rear roller 30' adjacent the rear end of the left treadle 12A, a second section 374 is defined by a portion of the rear roller 30' adjacent the rear end of the right treadle 12B, and a third section 376 is defined by a portion of the rear roller between the first and second sections. Axle ends 316A, 316B extend outward from opposing ends of the rear roller and are rotatably supported by left and right drive brackets, as described above.

As previously mentioned, each bearing end receives a portion of the rear roller corresponding with the annular channels. As shown in FIG. 26C, each bearing end has a selectively removable portion 378. When connecting the rear bearing end with the rear roller, the removable portion is disconnected from the inner bracket, creating an opening in the bearing end. The bearing end is then placed in the annular channel, and the removable portion is reconnected. Once connected, the rear roller rotates within the bearing ends. As such, there is no frame member supporting the adjacent bearing ends. Instead, the bearing ends are supported by the rear roller. As previously mentioned, the outer circumferential surface of the bearing ends do not extend beyond the annular channels, and as such, do not interrupt the belt motion, while at the same time provide adequate support to the inner edges of the treadles. The inner brackets on each treadle frame can be separately attached to the treadle frame, as shown, or can be integrally formed with the frame, such as be welding or the like.

The inner support structure shown in FIGS. 26A-26E allows the insides of the treadles to be positioned relatively close to one another since the support structure for the inside longitudinal members is integrated into the rear roller in such a way that the inner edges are adequately supported. As such, there are no dimensional restrictions to require the inside longitudinal members of the treadles be spaced apart.

Figure 27:
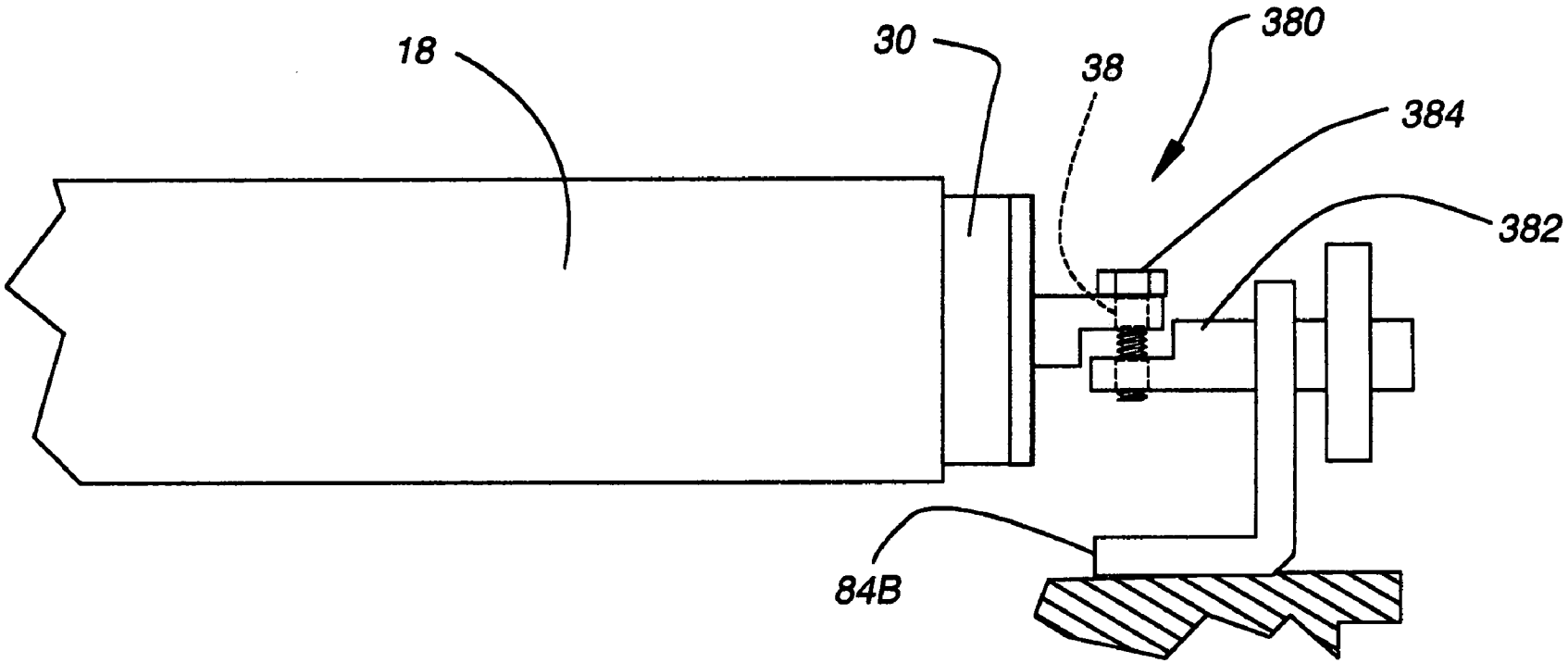
FIG. 27 is a rear view of an adjustable axle support structure.

As previously mentioned, the rear roller according to the above described embodiments can be pivotally supported by the drive brackets in various ways. For example, FIG. 27 shows the rear roller 30 supported by an adjustable axle support 380, which allows the vertical height of one end of the rear roller to be adjusted. Although FIG. 27 shows the adjustable axle support connected with the right end of the rear roller, it is to be appreciated that the adjustable axle support can be connected with the left end or both ends of the rear roller. As shown in FIG. 27, the adjustable axle support 380 includes an axle cradle 382 fixedly connected with the right drive bracket 84B. A vertically oriented bolt or set screw 384 couples the right axle end extending from the rear roller with the axle cradle. More particularly, the bolt is threaded through an aperture 386 in the right axle end with the bottom of the bolt extending from the aperture and engaging the axle cradle. As such, turning the bolt in one direction or the other raises or lowers the right axle end. Because the right axle end is coupled with the axle cradle by the bolt, the right axle end does not rotate with the rear roller. As such, the rear roller is rotatably supported by the axle end through a bearing or similar structure. It is to be appreciated that the rear roller shown in FIG. 27 can be supported by a single axle extending through the rear roller or can be supported by stub ends as described above. When the rear roller shown in FIG. 27 is supported by stub ends, the axle ends are not fixedly connected with the end caps, but instead, are rotatably coupled with the end caps through a bearing. Although the adjustable axle support provides for the vertical height adjustment of one end of the rear roller, it is to be appreciated that the adjustable axle support can be configured to provide fore and aft adjustments or a combination of fore and aft and vertical adjustment capabilities of either end or a both ends of the rear roller.

Although various representative embodiments of this invention have been described above with a certain degree of particularity, those skilled in the art could make numerous alterations to the disclosed embodiments without departing from the spirit or scope of the inventive subject matter set forth in the specification and claims. All directional references (e.g., upper, lower, upward, downward, left, right, leftward, rightward, top, bottom, above, below, vertical, horizontal, clockwise, and counterclockwise) are only used for identification purposes to aid the reader's understanding of the embodiments of the present invention, and do not create limitations, particularly as to the position, orientation, or use of the invention unless specifically set forth in the claims. Joinder references (e.g., attached, coupled, connected, and the like) are to be construed broadly and may include intermediate members between a connection of elements and relative movement between elements. As such, joinder references do not necessarily infer that two elements are directly connected and in fixed relation to each other.

In some instances, components are described with reference to "ends" having a particular characteristic and/or being connected with another part. However, those skilled in the art will recognize that the present invention is not limited to components which terminate immediately beyond their points of connection with other parts. Thus, the term "end" should be interpreted broadly, in a manner that includes areas adjacent, rearward, forward of, or otherwise near the terminus of a particular element, link, component, part, member or the like. In methodologies directly or indirectly set forth herein, various steps and operations are described in one possible order of operation, but those skilled in the art will recognize that steps and operations may be rearranged, replaced, or eliminated without necessarily departing from the spirit and scope of the present invention. It is intended that all matter contained in the above description or shown in the accompanying drawings shall be interpreted as illustrative only and not limiting. Changes in detail or structure may be made without departing from the spirit of the invention as defined in the appended claims.

What is claimed is:

1. An exercise device comprising:

a frame;

a first roller including a cylindrical hollow tube having a first end portion and a second end portion, a first cap end connected with the first end portion, and a second cap end connected with the second end portion, the first cap end and the second cap end rotatably supported by the frame to define an unobstructed longitudinal axis of the first roller between the first cap end and the second cap end;

a first treadle assembly including a second roller and a first endless belt in rotatable engagement with the second roller and the first roller, the first treadle assembly arranged to pivot relative to the frame; and a second treadle assembly including a third roller and a second endless belt in rotatable engagement with the third roller and the first roller, the second treadle assembly arranged to pivot relative to the frame.

2. The exercise device of claim 1, wherein:

the first cap end comprises a first portion connected with a first cap portion, and a first extension connected with the first cap portion, the first portion configured to fit within the first end portion of the first roller, the first cap portion including a first outer dimension that is greater than a first inner dimension of the first roller at the first end portion;

wherein the second cap end comprises a second portion connected with a second cap portion, and a second extension connected with the second cap portion, the second portion configured to fit within the second end portion of the first roller, the second cap portion including a second outer dimension that is greater than a second inner dimension of the first roller at the second end portion; and wherein the first extension and the second extension are rotatably supported by the frame.

3. The exercise device of claim 2, wherein:

the first treadle assembly is pivotally coupled to the frame through the first extension; and the second treadle assembly is pivotally coupled to the frame through the second extension.

4. The exercise device of claim 1, further comprising:

an interconnection assembly operably coupled with the first treadle assembly and the second treadle assembly.

5. An exercise device comprising:

a frame;

a first roller including a cylindrical hollow tube having a first end portion and a second end portion, a first cap end connected with the first end portion, and a second cap end connected with the second end portion, the first cap end and the second cap end rotatably supported by the frame to define an unobstructed longitudinal axis of the first roller between the first cap end and the second cap end;

a first treadle assembly including a second roller and a first endless belt in rotatable engagement with the second roller and the first roller;

a second treadle assembly including a third roller and a second endless belt in rotatable engagement with the third roller and the first roller; and wherein the first treadle assembly and the second treadle assembly are pivotally supported by the first roller.

6. The exercise device of claim 5, wherein:

the first cap end comprises a first portion connected with a first cap portion, and a first extension connected with the first cap portion, the first portion configured to fit within the first end portion of the first roller, the first cap portion including a first outer dimension that is greater than a first inner dimension of the first roller at the first end portion;

wherein the second cap end comprises a second portion connected with a second cap portion, and a second extension connected with the second cap portion, the second portion configured to fit within the second end portion of the first roller, the second cap portion including a second outer dimension that is greater than a second inner dimension of the first roller at the second end portion; and wherein the first extension and the second extension are rotatably supported by the frame.

7. The exercise device of claim 6, wherein:

the first treadle assembly is pivotally coupled to the frame through the first extension; and the second treadle assembly is pivotally coupled to the frame through the second extension.

8. The exercise device of claim 7, wherein the first roller includes a first annular channel and a second annular channel; and wherein the first treadle assembly is pivotally connected with the first annular channel and the second treadle assembly is pivotally connected with the second annular channel.

9. The exercise device of claim 5, further comprising:

an interconnection assembly operably coupled with the first treadle assembly and the second treadle assembly.

10. The exercise device of claim 1 further comprising:

a first axle end and a second axle end rotatably supporting the first roller; and an adjustable axle support through which the first axle end is coupled with the frame.

11. The exercise device of claim 10, the adjustable axle support comprising:

an axle cradle connected with the frame;

a bolt having threadedly engaged with the first axle end, the bolt having a head end and a distal end engaging the axle cradle; and wherein turning the head end of the bolt moves the first axle end in a first direction relative to the axle cradle.

12. The exercise device of claim 11, wherein the first direction is a vertical direction relative to the axle cradle.

13. The exercise device of claim 1, wherein the first cap end is secured to the first end portion of the first roller and the second cap end is secured to the second end portion of the first roller so that the first roller rotates with the first and second cap ends.

14. The exercise device of claim 2, wherein at least one of the first cap portion and the second cap portion defines an annular rim.

15. The exercise device of claim 2, wherein the first portion of the first cap end is secured to the first end portion of the first roller and the second portion of the second cap end is secured to the second end portion of the first roller so that the first roller rotates with the first and second cap ends.

16. The exercise device of claim 2, wherein the first extension includes an outer dimension that is less than the first outer dimension of the first cap portion.

17. The exercise device of claim 2, wherein the first extension and the second extension are coaxial with the unobstructed longitudinal axis of the first roller.

18. The exercise device of claim 5 further comprising:

a first axle end and a second axle end rotatably supporting the first roller; and an adjustable axle support through which the first axle end is coupled with the frame.

19. The exercise device of claim 18, the adjustable axle support comprising:

an axle cradle connected with the frame;

a bolt having threadedly engaged with the first axle end, the bolt having a head end and a distal end engaging the axle cradle; and wherein turning the head end of the bolt moves the first axle end in a first direction relative to the axle cradle.

20. The exercise device of claim 19, wherein the first direction is a vertical direction relative to the axle cradle.

21. The exercise device of claim 5, wherein the first cap end is secured to the first end portion of the first roller and the second cap end is secured to the second end portion of the first roller so that the first roller rotates with the first and second cap ends.

22. The exercise device of claim 6, wherein at least one of the first cap portion and the second cap portion defines an annular rim.

23. The exercise device of claim 6, wherein the first portion of the first cap end is secured to the first end portion of the first roller and the second portion of the second cap end is secured to the second end portion of the first roller so that the first roller rotates with the first and second cap ends.

24. The exercise device of claim 6, wherein the first extension includes an outer dimension that is less than the first outer dimension of the first cap portion.

25. The exercise device of claim 6, wherein the first extension and the second extension are coaxial with the unobstructed longitudinal axis of the first roller.

* * * * *